US007345657B2

(12) United States Patent
Kimura

(10) Patent No.: US 7,345,657 B2
(45) Date of Patent: Mar. 18, 2008

(54) SEMICONDUCTOR DEVICE AND DISPLAY DEVICE UTILIZING THE SAME

(75) Inventor: Hajime Kimura, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 828 days.

(21) Appl. No.: 10/743,347

(22) Filed: Dec. 23, 2003

(65) Prior Publication Data

US 2006/0187730 A1 Aug. 24, 2006

(30) Foreign Application Priority Data

Dec. 27, 2002 (JP) ..... 2002-380252

(51) Int. Cl.
*G09G 3/30* (2006.01)

(52) U.S. Cl. ..... 345/76; 345/77

(58) Field of Classification Search ..... 345/76, 345/77, 78, 79, 80, 589, 605; 315/169.1, 315/169.3

See application file for complete search history.

(56) References Cited

U.S. PATENT DOCUMENTS

| | | | | |
|---|---|---|---|---|
| 7,154,454 | B2 * | 12/2006 | Okabe et al. | 345/76 |
| 7,193,619 | B2 * | 3/2007 | Kimura | 345/204 |
| 7,209,101 | B2 * | 4/2007 | Abe | 345/76 |
| 7,256,756 | B2 * | 8/2007 | Abe | 345/76 |
| 2001/0038098 | A1 | 11/2001 | Yamazaki et al. | |
| 2002/0021293 | A1 | 2/2002 | Tam | |
| 2002/0033718 | A1 | 3/2002 | Tam | |
| 2002/0047120 | A1 | 4/2002 | Inukai | |
| 2003/0189206 | A1 | 10/2003 | Koyama | |
| 2005/0190177 | A1 * | 9/2005 | Yumoto | 345/211 |

FOREIGN PATENT DOCUMENTS

| | | |
|---|---|---|
| EP | 1 061 497 A1 | 12/2000 |
| EP | 1 170 718 A1 | 1/2002 |
| EP | 1 170 719 A1 | 1/2002 |
| EP | 1 193 676 A2 | 4/2002 |
| EP | 1 233 398 A2 | 8/2002 |
| GB | 2 360 870 A | 10/2001 |
| GB | 2 364 592 A | 1/2002 |

(Continued)

OTHER PUBLICATIONS

International Search Report (Application No. PCT/JP03/16358) dated Mar. 3, 2004.

(Continued)

*Primary Examiner*—Nitin I. Patel
(74) *Attorney, Agent, or Firm*—Fish & Richardson P.C.

(57) ABSTRACT

A source-drain voltage of one of two transistors connected in series becomes quite small in a set operation (write signal), thus the set operation is performed to the other transistor. In an output operation, two transistors operate as a multi-gate transistor, therefore, a current value can be small in the output operation. In other words, a current can be large in the set operation. Therefore, the set operation can be performed rapidly without being easily influenced by an intersection capacitance and a wiring resistance which are parasitic on a wiring and the like. Further, an influence of variations between adjacent ones can be small as one same transistor is used in the set operation and the output operation.

38 Claims, 52 Drawing Sheets

FOREIGN PATENT DOCUMENTS

| | | |
|---|---|---|
| GB | 2 364 593 A | 1/2002 |
| JP | 2001-060076 | 3/2001 |
| JP | 2001-318627 | 11/2001 |
| JP | 2002-023697 | 1/2002 |
| JP | 2002-514320 | 5/2002 |
| JP | 2002-175029 | 6/2002 |
| JP | 2002-517806 | 6/2002 |
| JP | 2002-244617 | 8/2002 |
| JP | 2002-251166 | 9/2002 |
| JP | 2002-278497 | 9/2002 |
| WO | WO 01/06484 A1 | 1/2001 |
| WO | WO 01/75853 A1 | 10/2001 |
| WO | WO 02/05254 A1 | 1/2002 |
| WO | WO 02/05255 A1 | 1/2002 |

OTHER PUBLICATIONS

International Preliminary Examination Report dated Mar. 2, 2004 and Partial English Language Translation.

* cited by examiner (A) In inputting a signal (B) In completing to input a signal (C) In emitting light (D)

(E)

(A) In inputting a signal (B) In completing to input a signal (C) In emitting light (D)

(E)

(A) In inputting a signal (B) In completing to input a signal (C) In emitting light (D)

(E)

SEMICONDUCTOR DEVICE AND DISPLAY DEVICE UTILIZING THE SAME

TECHNICAL FIELD

The present invention relates to a structure of a semiconductor device. More particularly, the invention relates to a structure of an active matrix semiconductor device including a thin film transistor (hereinafter referred to as a TFT) formed on an insulator such as a glass and plastic.

BACKGROUND ART

In recent years, a self-luminous type display device such as an electro luminescence (EL) display device and an FED (Field Emission Display) has been actively developed. A self-luminous display device is advantageous since it is highly visible, suitable for thin design as it does not require a backlight required in a liquid crystal display device (LCD) and the like, and its viewing angle is almost unlimited.

An EL element denotes an element having a light emitting layer in which a luminescence is obtained by applying electric field. The light emitting layer emits light when returning from a singlet excited state to a base state (fluorescence) and when returning from a triplet excited state to the base state (phosphorescence). The semiconductor device of the invention may employ either of the aforementioned light emitting systems.

The EL element typically has a laminated structure of a pair of electrodes (anode and cathode) and a light emitting layer sandwiched between them. One typical laminated structure is "anode/hole transporting layer/light emitting layer/electron transporting layer/cathode". This structure is highly effective in emitting light, therefore, most EL elements which are presently under study employ this structure.

Other than the aforementioned structure, layers may be laminated between the anode and the cathode in the order of "hole injection layer/hole transporting layer/light emitting layer/electron transporting layer" or "hole injection layer/hole transporting layer/light emitting layer/electron transporting layer/electron injection layer". Any of the aforementioned structures may be used in the EL element used in the semiconductor device of the invention. Further, a fluorescent pigment and the like may be doped to the light emitting layer.

In this specification, all kinds of layers provided between the anode and the cathode in the EL element are collectively referred to as an EL layer. Therefore, the aforementioned hole injection layer, hole transporting layer, light emitting layer, electron transporting layer, and electron injection layer are all included in the EL layer. A light emitting element formed of an anode, an EL layer, and a cathode is referred to as an EL element.

FIG. 5 shows a pixel structure of a typical semiconductor device. An EL display device is taken here as an example of a typical semiconductor device. A pixel shown in FIG. 5 comprises a source signal line 501, a gate signal line 502, a switching TFT 503, a driving TFT 504, a capacitor 505, an EL element 506, and power supplies 507 and 508.

Hereinafter described are connections between each component. A TFT includes three terminals: a gate, a source, and a drain, however, the source and drain cannot be distinguished because of the structure of TFT. Therefore, one of the source and drain is referred to as a first electrode and the other is referred to as a second electrode when describing the connections between the elements. Meanwhile, when describing the potential and the like of each terminal regarding ON and OFF of a TFT, description will be made as a source, a drain and the like.

A gate electrode of the switching TFT 503 is connected to the gate signal line 502, a first electrode thereof is connected to the source signal line 501, and a second electrode thereof is connected to a gate electrode of the driving TFT 504. A first electrode of the driving TFT 504 is connected to the power supply 507 and a second electrode thereof is connected to one electrode of the EL element 506. The other electrode of the EL element 506 is connected to the power supply 508. The capacitor 505 is connected between the gate electrode and the first electrode of the driving TFT 504 and holds a gate-source voltage of the driving TFT 504.

When a potential of the gate signal line 502 changes and the switching TFT 503 is turned ON, an image signal inputted to the source signal line 501 is inputted to the gate electrode of the driving TFT 504. A gate-source voltage of the driving TFT 504 is determined by a potential of the inputted image signal, and a current flowing between the source and drain of the driving TFT 504 (hereinafter referred to as a drain current) is determined accordingly. This current is supplied to the EL element 506 and it emits light.

A TFT formed of polycrystalline silicon (polysilicon, hereinafter referred to as P—Si) has high field effect mobility and can flow a large on-current, therefore, it is suited as a transistor used in a semiconductor device. On the other hand, its electric characteristics tend to vary easily due to a defect in the crystal grain boundary.

Provided that characteristics such as a threshold value of a TFT which forms a pixel or on-current vary in each pixel shown in FIG. 5, a drain current of the TFT varies accordingly even when the same image signal is inputted. Thus, a luminance of the EL element 506 varies.

In order to solve such a problem, it is preferable that a desired amount of current is supplied to the EL element regardless of the characteristics of the TFT. In view of this, various kinds of current write type pixels have been suggested which can control the amount of current flowing to the EL element regardless of the characteristics of the TFT.

In the current write type pixel, an image signal inputted from the source signal line to the pixel is inputted as current whereas it is typically inputted as analog or digital voltage data. Accordingly, a desired current value to be supplied to the EL element can be set as a signal current outside the pixel and an equivalent current is supplied to the pixel. Therefore, this method has an advantage that luminance is not affected by the variation of the characteristics of a TFT.

Several examples of typical current write type pixels are shown below and the structures, operations and characteristics thereof are described hereafter.

FIG. 6 shows a first configuration example (refer to Patent Document 1). The pixel shown in FIG. 6 comprises a source signal line 601, first to third gate signal lines 602 to 604, a current source line 605, TFTs 606 to 609, a capacitor 610, an EL element 611, and a signal current input current source 612.

[Patent Document 1]

Published Japanese Translation of PCT International Publication for Patent Applications No. 2002-517806

A gate electrode of the TFT 606 is connected to the first gate signal line 602, a first electrode thereof is connected to the source signal line 601, and a second electrode thereof is connected to a first electrode of the TFT 607, a first electrode of the TFIT 608, and a first electrode of the TFT 609. A gate electrode of the TFT 607 is connected to the second gate signal line 603 and a second electrode thereof is connected to a gate electrode of the TFT 608. A second electrode of the TFT 608 is connected to the current source line 605. A gate electrode of the TFT 609 is connected to the third gate signal line 604 and a second electrode thereof is connected to an anode of the EL element 611. The capacitor 610 is connected between the gate electrode and an input electrode of the TFT 608 and holds a gate-source voltage of the TFT 608. The current source line 605 and a cathode of the EL element 611 are inputted with predetermined potentials and have a potential difference to each other.

An operation from a write of a signal current to light emission is described with reference to FIG. 7. Reference numerals in FIG. 7 correspond to the ones in FIG. 6. FIGS. 7A to 7C each schematically shows a current flow. FIG. 7D shows a relation of current flowing each path when a signal current is written. FIG. 7E shows a voltage accumulated in the capacitor 610 when a signal current is written, that is a gate-source voltage of the TFT 608.

First, a pulse is inputted to the first gate signal line 602 and the second gate signal line 603 and the TFTs 606 and 607 are turned ON. At this time, a current flowing through the source signal line, that is a signal current is referred to as $I_{data}$.

As the current $I_{data}$ flows through the source signal line, it is divided into $I_1$ and $I_2$ in the pixel as shown in FIG. 7A. This relation is shown in FIG. 7D. It is needless to say that $I_{data}=I_1+I_2$ is satisfied.

A charge is not yet held in the capacitor 610 right after the TFT 606 is turned ON, therefore, the TFT 608 is OFF. Therefore, $I_2=0$ and $I_{data}=I_1$ are satisfied. That is to say, current only flows into the capacitor 610 in the meantime.

After that, as the charge is gradually accumulated in the capacitor 610, a potential difference starts to generate between both electrodes (FIG. 7E). When the potential difference between the both electrodes reaches Vth (a point A in FIG. 7E), the TFT 608 is turned ON and $I_2$ generates. As described above, as $I_{data}=I_1+I_2$ is satisfied, current still flows and a charge is accumulated in the capacitor while $I_1$ decreases gradually.

The charge keeps being accumulated in the capacitor 610 until the potential difference between the both electrodes, that is a gate-source voltage of the TFT 608 reaches a desired voltage, that is a voltage (VGS) which can make the TFT 608 flow the current $I_{data}$. When the charge stops being accumulated (a point B in FIG. 7E), the current $I_2$ stops flowing and the TFT 608 flows a current corresponding to VGS at that time and $I_{data}=I_2$ is satisfied (FIG. 7B). Thus, a write operation of a signal is terminated. At last, selections of the first gate signal line 602 and the second gate signal line 603 are terminated to turn OFF the TFTs 606 and 607.

In this manner, an operation to make the TFT 608 flow the current $I_{data}$ by accumulating a charge in the capacitor is hereinafter referred to as a set operation.

Subsequently, a light emitting operation starts. A pulse is inputted to the third gate signal line 604 to turn on the TFT 609. As the capacitor 610 holds VGS which is written before, the TFT 608 is ON and the current $I_{data}$ flows from the current source line 605. Thus, the EL element 611 emits light. Provided that the TFT 608 is set to operate in a saturation region, $I_{data}$ keeps flowing without changing even when a source-drain voltage of the TFT 608 changes.

In this manner, an operation to output a current set by the set operation is hereinafter referred to as an output operation.

FIG. 17 shows a second configuration example (refer to Patent Document 2). A pixel in FIG. 17 comprises a source signal line 1701, first to third gate signal lines 1702 to 1704, a current source line 1705, TFTs 1706 to 1709, a capacitor 1710, an EL element 1711, and a signal current input current source 1712.

[Patent Document 2]

Published Japanese Translation of PCT International Publication for Patent Applications No. 2002-514320

A gate electrode of the TFT 1706 is connected to the first gate signal line 1702, a first electrode thereof is connected to the source signal line 1701, and a second electrode thereof is connected to a first electrode of the TFT 1708 and a first electrode of the TFT 1709. A gate electrode of the TFT 1708 is connected to the second gate signal line 1703 and a second electrode thereof is connected to the current source line 1705. A gate electrode of the TFT 1707 is connected to the third gate signal line 1704, a first electrode thereof is connected to a gate electrode of the TFI 1709, and a second electrode thereof is connected to a second electrode of the TFT 1709 and one electrode of the EL element 1711. The capacitor 1710 is connected between the gate electrode and the first electrode of the TFIT 1709 and holds a gate-source voltage of the TFT 1709. The current source line 1705 and the other electrode of the EL element 1711 are inputted with predetermined potentials respectively and have a potential difference to each other.

An operation from a write of a signal current to light emission is described with reference to FIG. 18. Reference numerals in FIG. 18 correspond to the ones in FIG. 17. FIGS. 18A to 18C each schematically shows a current flow. FIG. 18D shows a relation of current flowing each path when a signal current is written. FIG. 18E shows a voltage accumulated in the capacitor 1710 when a signal current is written, that is a gate-source voltage of the TFIT 1709.

First, a pulse is inputted to the first gate signal line 1702 and the third gate signal line 1704 and the TFTs 1706 and 1707 are turned ON. At this time, a current flowing through the source signal line 1701, that is a signal current is referred to as $I_{data}$.

As for the current $I_{data}$ flowing through the source signal line 1701, its current path is divided into $I_1$ and $I_2$ in the pixel as shown in FIG. 18A. This relation is shown in FIG. 18D. It is needless to say that $I_{data}=I_1+I_2$ is satisfied.

A charge is not yet held in the capacitor 1710 right after the TFT 1706 is turned ON, therefore, the TFT 1709 is OFF. Therefore, $I_2=0$ and $I_{data}=I_1$ are satisfied. That is to say, current only flows into the capacitor 1710 in the meantime.

After that, as the charge is gradually accumulated in the capacitor 1710, a potential difference starts to generate between both electrodes (FIG. 18E). When the potential difference between the both electrodes reaches Vth (a point A in FIG. 18E), the TFT 1709 is turned ON and $I_2$ generates. As described above, as $I_{data}=I_1+I_2$ is satisfied, current still flows and a charge is accumulated in the capacitor while $I_1$ decreases gradually.

The charge keeps being accumulated in the capacitor 1710 until the potential difference between the both electrodes, that is a gate-source voltage of the TFT 1709 reaches a desired voltage, that is a voltage (VGS) which can make the TFT 1709 flow the current $I_{data}$. When the charge stops being accumulated (a point B in FIG. 18E), the current $I_2$ stops flowing and the TFT 1709 flows a current corresponding to VGS at that time and $I_{data}=I_2$ is satisfied (FIG. 18B). Thus, a write operation of a signal is terminated. At last, selections of the first gate signal line 1702 and the third gate signal line 1704 are terminated to turn OFF the TFTs 1706 and 1707. In this manner, a set operation is terminated.

Subsequently, an output operation starts. As the capacitor 1710 holds VGS which is written before, the TFT 1709 is ON and the current $I_{data}$ flows from the current source line 1705. Thus, the EL element 1711 emits light. Provided that the TFT 1709 is set to operate in a saturation region, $I_{data}$ keeps flowing without changing even when a source-drain voltage of the TFT 1709 changes slightly.

FIG. 19 shows a third configuration example (refer to Patent Document 1). A pixel in FIG. 19 comprises a source signal line 1901, first and second gate signal lines 1902 and 1903, a current source line 1704, TFTs 1905 to 1908, a capacitor 1909, an EL element 1910, and a signal current input current source 1911.

[Patent Document 1]

International Publication WO01/06484

A gate electrode of the TFT 1905 is connected to the first gate signal line 1902, a first electrode thereof is connected to the source signal line 1901, and a second electrode thereof is connected to a first electrode of the TFT 1906 and a first electrode of the TFT 1907. A gate electrode of the TFT 1906 is connected to the second gate signal line 1903, a second electrode thereof is connected to a gate electrode of the TFT 1907 and a gate electrode of the TFT 1908. A second electrode of the TFT 1907 and a first electrode of 1908 are both connected to the current source line 1904 and a second electrode of the TFT 1908 is connected to an anode of the EL element 1910. The capacitor 1909 is connected between the gate electrodes of the TFTs 1907 and 1908 and the second electrode of the TFT 1907 and the first electrode of the TFT 1908 and holds a gate-source voltage of the TFTs 1907 and 1908. The current source line 1904 and a cathode of the EL element 1910 are inputted with predetermined potentials respectively and have a potential difference to each other.

An operation from a write of a signal current to light emission is described with reference to FIG. 20. Reference numerals in the drawings correspond to the ones in FIG. 20. FIGS. 20A to 20C each schematically shows a current flow. FIG. 20D shows a relation of current flowing each path when a signal current is written. FIG. 20E shows a voltage accumulated in the capacitor 1909 when a signal current is written, that is a gate-source voltage of the TFTs 1907 and 1908.

First, a pulse is inputted to the first gate signal line 1902 and the second gate signal line 1903 and the TFTs 1905 and 1906 are turned ON. At this time, a current flowing through the source signal line 1901, that is a signal current is referred to as $I_{data}$.

As for the current $I_{data}$ flowing through the source signal line 1901, its current path is divided into $I_1$ and $I_2$ in the pixel as shown in FIG. 20A. This relation is shown in FIG. 20D. It is needless to say that $I_{data}=I_1+I_2$ is satisfied.

A charge is not yet held in the capacitor 1909 right after the TFT 1905 is turned ON, therefore, the TFTs 1707 and 1708 are OFF. Therefore, $I_2=0$ and $I_{data}=I_1$ are satisfied. That is to say, current only flows into the capacitor 1709 in the meantime.

After that, as the charge is gradually accumulated in the capacitor 1909, a potential difference starts to generate between both electrodes (FIG. 20E). When the potential difference between the both electrodes reaches Vth (a point A in FIG. 20E), the TFT 1907 is turned ON and $I_2$ generates. As described above, as $I_{data}=I_1+I_2$ is satisfied, current still flows and a charge is accumulated in the capacitor while $I_1$ decreases gradually.

Here, the TFT 1908 is turned ON while the TFT 1907 is turned ON, and a current starts flowing. However, this current flows through an independent path as shown in FIG. 20A, therefore, a value of $I_{data}$ does not change and does not influence either $I_1$ or $I_2$.

The charge keeps being accumulated in the capacitor 1909 until the potential difference between the both electrodes, that is a gate-source voltage of the TFTs 1907 and 1908 reaches a desired voltage, that is a voltage (VGS) which can make the TFT 1907 flow the current $I_{data}$. When the charge stops being accumulated (a point B in FIG. 18E), the current $I_2$ stops flowing and the TFT 1907 flows a current corresponding to VGS at that time and $I_{data}=I_2$ is satisfied (FIG. 18B). Thus, a write operation of a signal is terminated. At last, selections of the first gate signal line 1902 and the second gate signal line 1903 are terminated to turn OFF the TFTs 1905 and 1906.

At this moment, the capacitor 1909 holds enough charge to apply a gate-source voltage which can flow the current $I_{data}$ through the TFT 1907. As the TFTs 1907 and 1908 form a current mirror, the voltage is applied to the TFT 1908 as well and a current flows through the TFT 1908. FIG. 20 shows this current by $I_{EL}$.

Provided that the TFT 1907 and the TFT 1908 have the same gate length and channel width, $I_{EL}=I_{data}$ is satisfied. That is, a relation between the signal current $I_{data}$ and the current $I_{EL}$ supplied to the EL element can be determined by adjusting the size of the TFTs 1907 and 1908 which form a current mirror.

In this manner, the output operation can be performed while the set operation is performed in the case of the third configuration example.

It is an advantage of the current write type of which example is described above that a gate-source voltage required to flow the current $I_{data}$ is held in the capacitor 610 even when the TFT 608 has variations in characteristics and the like. Therefore, a desired current can be supplied to the EL element accurately and luminance variations due to the variations in characteristics of the TFTs can be suppressed.

DISCLOSURE OF THE INVENTION

[Problems to be Solved by the Invention]

Here, features of each configuration are shown in Table 1.

TABLE 1

| | The first configuration (FIG. 6) | The second configuration (FIG. 17) | The third configuration (FIG. 19) |
|---|---|---|---|
| The relation between an image signal current $I_{data}$ and a current $I_{EL}$ flowing through the EL element | $I_{data} = I_{EL}$ | $I_{data} = I_{EL}$ | $I_{data} \neq I_{EL}$ |
| The relation between a current-voltage | The converting TFT: 608 | The converting TFT: 1709 | The converting TFT: 1907 |

TABLE 1-continued

| | The first configuration (FIG. 6) | The second configuration (FIG. 17) | The third configuration (FIG. 19) |
|---|---|---|---|
| converting TFT and a driving TFT | The driving TFT: 608 → the same | The driving TFT: 1709 → the same | The driving TFT: 1908 |
| An image signal current when writing | Not Flow to the EL element | Flow to the EL element | Not flow to the EL element |
| The number of gate signal lines | 3 | 3 | 2 |

First, a relation between a signal current $I_{data}$ and a current $I_{EL}$ supplied to the EL element is described. A gray scale is expressed by a current value in a semiconductor device of analog gray scale method, therefore, a large current flows in a high gray scale while a small current flows in a low gray scale. That is, a value of a signal current to be written varies depending on gray scale. In that case, when writing a signal of low gray scale to a pixel, it takes longer time than the case of writing a signal of high gray scale to a pixel. Further, the signal of low gray scale is easily influenced by noise because of its small current value.

Next, a relation between a current-voltage converting TFT and a driving TFT is described. Here, the current-voltage converting TFT is a TFT used for converting a signal current inputted from a source signal line into a voltage signal, while the driving TFT is a TFT for flowing a current corresponding to a voltage held in a capacitor. Figure numbers for the current-voltage converting TFT (denoted as a converting TFT) and the driving TFT for each structure are shown in Table 1.

Provided that the converting TFT and the driving TFT are common, the common TFT is in charge of both of the write operation and the light emission operation. Therefore, the influence due to variations in characteristics of TFTs is small. On the other hand, in the case where the converting TFT and the driving TFT are provided independently as shown in the third configuration, there is an influence due to variations in characteristics in the pixels.

A current path at the time of writing a signal current is described now. In the first configuration and the third configuration, the signal current flows from the current source to the current source line, or from the current source line to the current source. On the other hand, in the second configuration, the signal current flows from the current source through the EL element when writing the signal current. In such a configuration, the EL element itself becomes a load in the case where a signal of high gray scale is written after a signal of low gray scale is written and the case where the inverse operation is performed, therefore, the writing time is required to be increased.

The invention provides a semiconductor device which is capable of solving the aforementioned various problems.

[Means for Solving the Problem]

The invention provides a semiconductor device comprising a first transistor, a second transistor, and a switch, in which the first transistor comprises a gate terminal, a first terminal and a second terminal, the second transistor comprises a gate terminal, a first terminal and a second terminal, the gate terminal of the first transistor and the first terminal of the first transistor are connected to each other via the switch, the second terminal of the first transistor is connected to the first terminal of the second transistor, the gate terminal of the first transistor is connected to the gate terminal of the second transistor, and a means for short-circuiting between the first terminal of the first transistor and the second terminal of the first transistor or between the first terminal of the second transistor and the second terminal of the second transistor is provided.

The invention also provides a semiconductor device comprising a first transistor, a second transistor, a first switch and a second switch, in which the first transistor comprises a gate terminal, a first terminal, and a second terminal, the second transistor comprises a gate terminal, a first terminal, and a second terminal, the gate terminal of the first transistor and the first terminal of the first transistor are connected to each other via the first switch, the second terminal of the first transistor is connected to the first terminal of the second transistor, the gate terminal of the first transistor is connected to the gate terminal of the second transistor, and the first terminal of the first transistor and the second terminal of the first transistor, or the first terminal of the second transistor and the second terminal of the second transistor are connected to each other via the second switch.

The invention also provides a semiconductor device comprising a first transistor, a second transistor, a first switch, a second switch, a third switch and a wiring, in which the first transistor comprises a gate terminal, a first terminal and a second terminal, the second transistor comprises a gate terminal, a first terminal and a second terminal, the gate terminal of the first transistor and the first terminal of the first transistor are connected to each other via the first switch, the second terminal of the first transistor is connected to the first terminal of the second transistor, the gate terminal of the first transistor is connected to the gate terminal of the second transistor via the second switch, and the gate terminal of the second transistor is connected to the wiring via the third switch.

The invention also provides a semiconductor device according to the aforementioned configuration in which the first transistor and the second transistor have the same conductivity.

The invention also provides a semiconductor device according to the aforementioned configuration in which a capacitor is provided and the gate terminal of the first transistor and one terminal of the capacitor are connected to each other.

The invention also provides a semiconductor device according to the aforementioned configuration in which the gate terminal of the first transistor is connected to one terminal of the capacitor and the other terminal of the capacitor is connected to the second terminal of the second transistor.

The invention also provides a semiconductor device according to the aforementioned configuration in which the first terminal of the first transistor or the second terminal of the second transistor is connected to a current source circuit.

The invention also provides a semiconductor device according to the aforementioned configuration in which the first terminal of the first transistor or the second terminal of the second transistor is connected to a display element.

That is, according to the invention, a source-drain voltage of one (for example, a second transistor) of two transistors connected in series (a first transistor and the second transistor) becomes extremely small in the set operation, thus the set operation is performed to the other transistor (for example, the first transistor). Then, in the output operation, the two transistors (the first transistor and the second transistor) operate as a multi-gate transistor, therefore, a current value in the output operation can be small. In other words, a current in the set operation can be large. Therefore, the set operation can be performed rapidly without being influenced by an intersection capacitance and a wiring resistance which are parasitic on a wiring and the like.

As the current in the output operation can be large, there is less influence of a minute current due to noise and the like.

Furthermore, a common transistor is used in a part of the set operation and the output operation, therefore, an influence of variations in characteristics of adjacent transistors can be small.

Note that the transistor used in the invention may be any type of transistor formed by any material, any means, or any manufacturing method. For example, it may be a thin film transistor (TFT). It may be a TFT of which semiconductor layer is formed of amorphous crystal, polycrystal, or single crystal. As other transistors, a transistor formed over a single crystalline substrate, a transistor formed over an SOI substrate, a transistor formed over a plastic substrate, or a transistor formed over a glass substrate may be used. Besides, a transistor formed of organic material or carbon nanotube may be used as well. A MOS type transistor or a bipolar type transistor may be used as well.

In the invention, a connection means an electrical connection. Therefore, another element, a switch or the like may be disposed in between.

[Effect of the Invention]

According to the invention, a source-drain voltage of one of two transistors connected in series becomes extremely small in the set operation, thus the set operation is performed to the other transistor. Then, in the output operation, the two transistors operate as a multi-gate transistor, therefore, a current value in the output operation can be small. In other words, a current in the set operation can be large. Therefore, the set operation can be performed rapidly without being influenced by an intersection capacitance and a wiring resistance which are parasitic on a wiring and the like.

As the current in the output operation can be large, there is less influence of a minute current due to noise and the like.

Furthermore, a common transistor is used in a part of the set operation and the output operation, therefore, an influence of variations in characteristics of adjacent transistors can be small.

BEST MODE FOR CARRYING OUT THE INVENTION

Embodiment Mode 1

The invention can be applied not only to a pixel having an EL element but also to various analog circuits having a power supply. In this embodiment mode, the basic principle of the invention is described.

Figure 1:
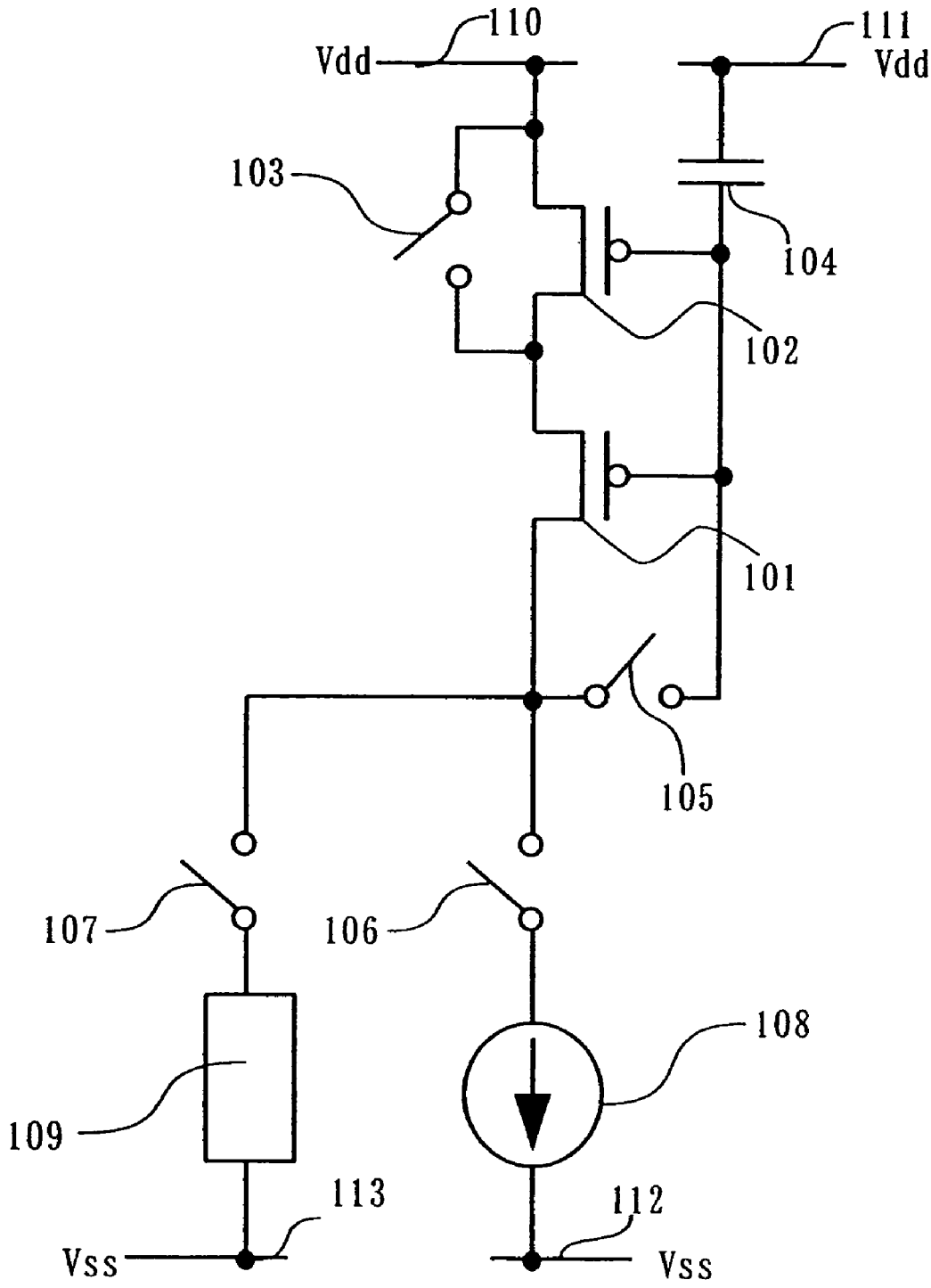
FIG. 1 is a diagram showing a configuration of the current source circuit of the invention.

First, FIG. 1 shows a configuration based on the basic principle of the invention. A current source transistor 101 which constantly operates as a current source (or a part of it) and a switching transistor 102 of which operation changes according to the circumstance are provided, and the current source transistor 101, the switching transistor 102, and a wiring 110 are connected in series.

A gate terminal of the current source transistor 101 is connected to one terminal of a capacitor 104. The other terminal of the capacitor 104 is connected to a wiring 111. Therefore, it is possible to hold a potential of the gate terminal of the current source transistor 101.

Further, the gate terminal and a drain terminal of the current source transistor 101 are connected to each other via a switch 105 and the capacitor 104 can be controlled to hold a charge by ON/OFF of the switch 105. The current source transistor 101 and a wiring 112 are connected to each other via a basic current source 108 and a switch 106. In parallel with the aforementioned, the current source transistor 101 and the wiring 113 are connected to each other via a load 109 and a switch 107. Note that the wirings 110 and 111 are different wirings, however, they may be electrically connected to each other. The wirings 112 and 113 are different wirings, however, they may be electrically connected to each other.

Further, the switching transistor 102 is connected to a means which can switch the transistor to operate as a current source or to operate not to flow a current between a source and drain thereof (or to operate as a switch) according to the circumstance. Here, the case where the switching transistor 102 operates as a current source (or a part of it) is referred to as a current source operation. Moreover, the case where the switching transistor 102 operates not to flow a current between the source and drain there of (or the case of operating as a switch) or the case of operating with a small source-drain voltage is referred to as a short-circuit operation.

In order to perform the current source operation and the short-circuit operation regarding the switching transistor 102 as described above, various configuration can be employed.

In this embodiment mode, FIG. 1 shows a configuration as an example. In FIG. 1, the source terminal and the drain terminal of the switching transistor 102 are designed to be connected via a switch 103. Then, the gate terminal of the switching transistor 102 is connected to the gate terminal of the current source transistor 101. The operation of the switching transistor 102 can be switched between the current source operation and the short-circuit operation by using the switch 103.

Figure 2:
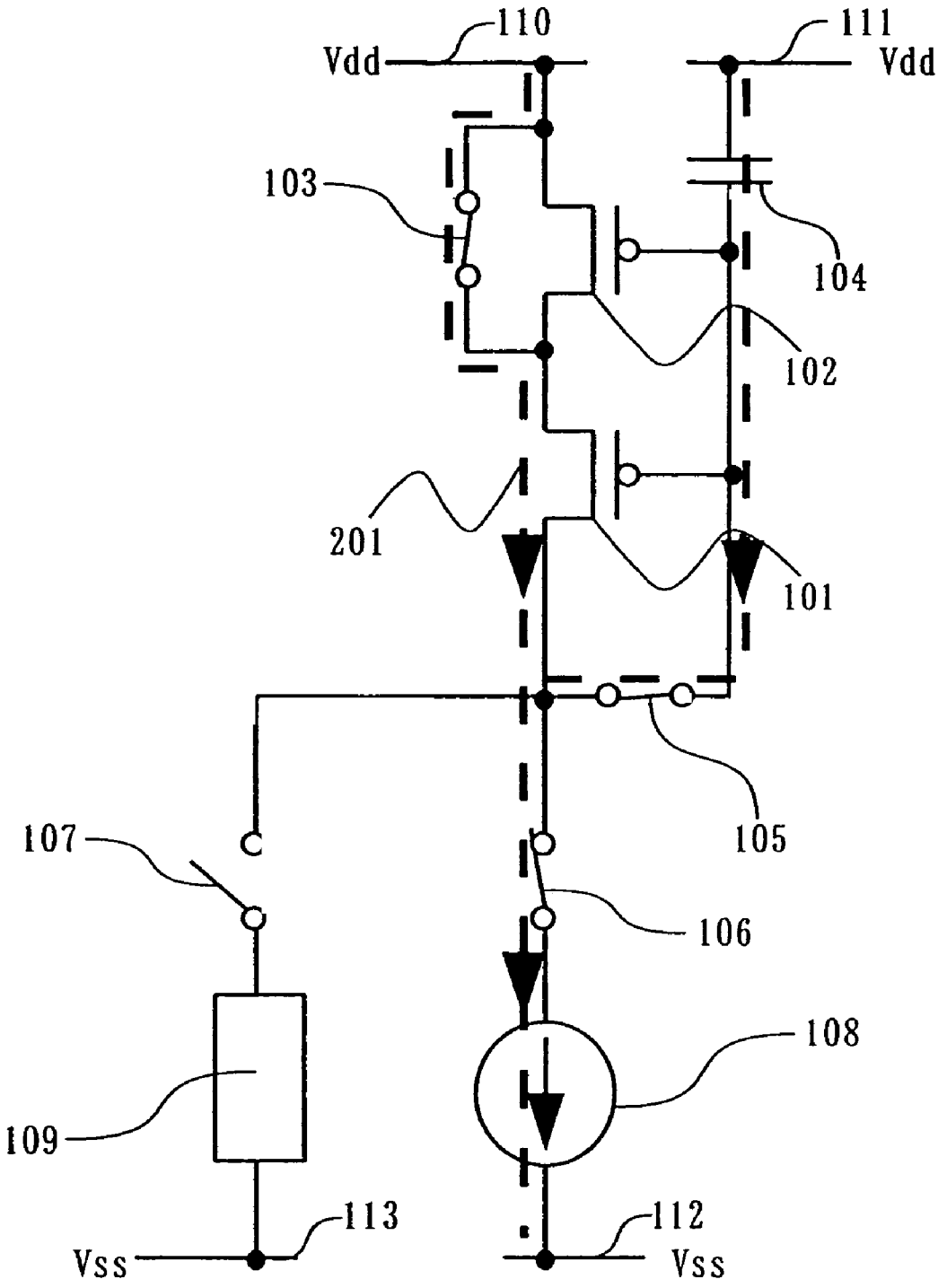
FIG. 2 is a diagram showing an operation of the current source circuit of the invention.

The operation of FIG. 1 is described now. First, the switches 103, 105 and 106 are turned ON and the switch 107 is turned OFF as shown in FIG. 2. A current path at that time is shown by a dashed arrow 201. Then, the source terminal and the drain terminal of the switching transistor 102 have almost the same potentials. That is to say, hardly any current flows between the source and drain of the switching transistor 102 while a current flows to the switch 103. Therefore, a current Ib of the basic current source 108 flows to the capacitor 104 or the current source transistor 101. Then, the current to the capacitor 104 stops flowing when the current flowing between the source and drain of the current source transistor 101 and the current Ib of the basic current source 108 become equal. That is, a stationary state is obtained. The potential of the gate terminal at that time is accumulated in the capacitor 104. That is, a voltage required to flow the current Ib between the source and drain of the current source transistor 101 is applied to the gate terminal. The aforementioned operation corresponds to the set operation. At that time, the switching transistor 102 performs the short-circuit operation.

In this manner, the set operation can be regarded to be terminated when a current does not flow to the capacitor 104 and the stationary state is obtained.

Figure 3:
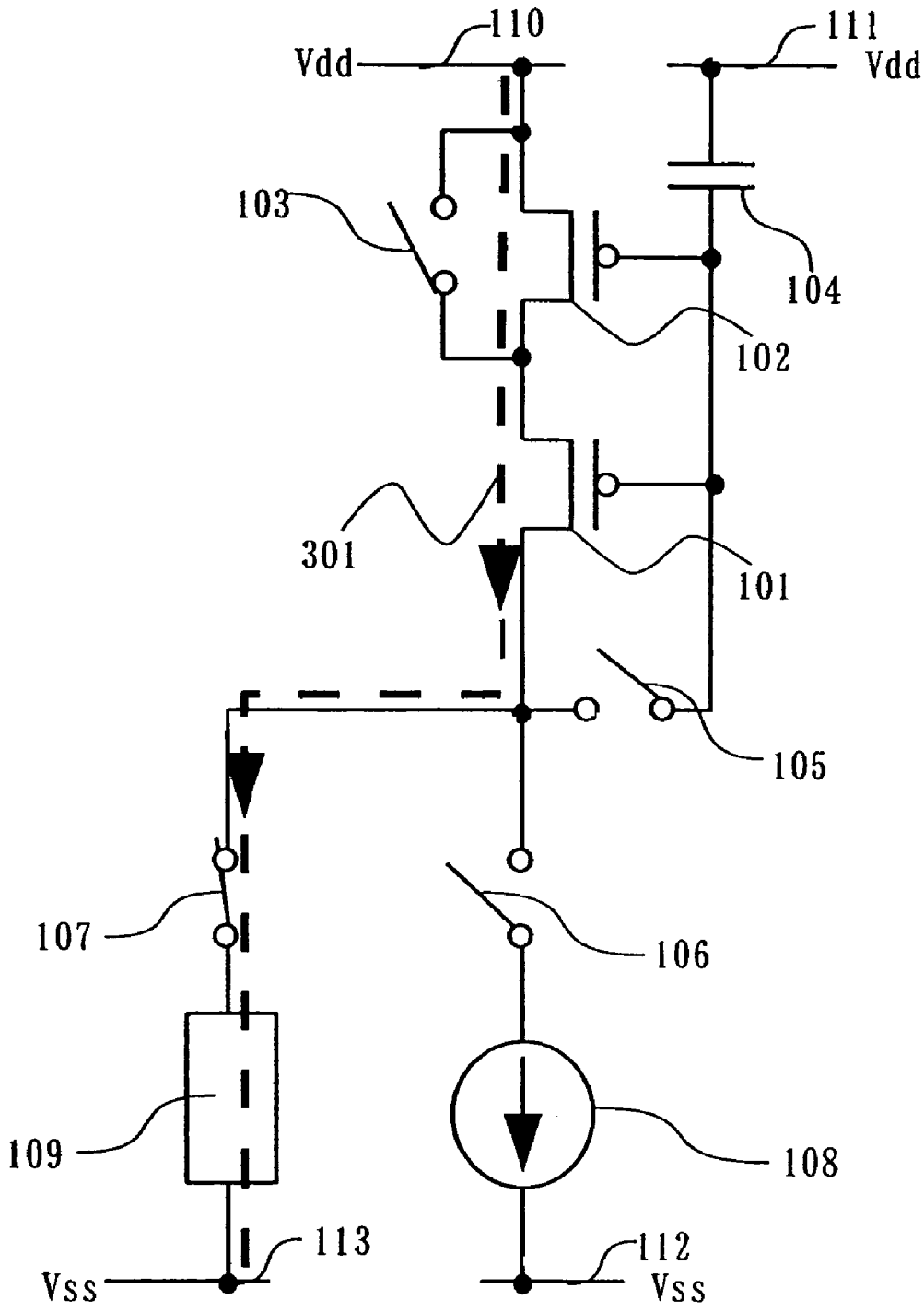
FIG. 3 is a diagram showing an operation of the current source circuit of the invention.

Next, the switches 103, 105, and 106 are turned OFF and the switch 107 is turned ON as shown in FIG. 3. A current path at that time is shown by a dashed arrow 301. Then, a current flows between the source and drain of the switching transistor 102 as the switch 103 is OFF. On the other hand, a charge accumulated in the set operation which is stored in the capacitor 104 is applied to the gate terminals of the current source transistor 101 and the switching transistor 102. The gate terminals of the current source transistor 101 and the switching transistor 102 are connected to each other. As described above, the current source transistor 101 and the switching transistor 102 operate as a multi-gate transistor. Therefore, assuming that the current source transistor 101 and the switching transistor 102 are one transistor, the gate length L of the transistor is longer than L of the current source transistor 101. Generally, as the gate length L of a transistor becomes longer, a current flowing through it becomes smaller. The aforementioned operation corresponds to the output operation. At that time, the switching transistor 102 performs the current source operation.

As described above, by controlling ON/OFF of the switch 103, the current Ib flowing in the set operation can be larger than the current flowing to the load 109 and the like in the output operation. Therefore, the current flowing in the set operation can be large, which can achieve the stationary state rapidly. That is, the set operation can be performed rapidly by reducing an influence of a load (wiring resistance, intersection capacitance and the like) which is parasitic on a wiring through which a current flows.

Moreover, as the current Ib flowing in the set operation is large, an influence of noise and the like can be reduced. That is, even when some minute current flows due to noise and the like, Ib is large enough not to be influenced much by the noise and the like.

Therefore, for example, provided that the load 109 is an EL element, the current Ib which is larger than a current supplied to the EL element can be used for writing a signal in the case where the EL element is required to emit light in a low gray scale. Thus, such troubles that a signal current disappears in noise can be avoided and a rapid write operation can be realized.

Note that the load 109 may be anything. It may be an element such as a resistor, a transistor, an EL element, or a current source circuit formed by a transistor, a capacitor and a switch. It may be a signal line or a signal line and a pixel connected to it. The pixel may include any kind of display element such as an EL element or an element used in an FED.

Note that the capacitor 104 can be substituted by gate capacitance of the current source transistor 101, the switching transistor 102 and the like. In that case, the capacitor 104 can be omitted.

Note that the wiring 110 and the wiring 111 are supplied with a power supply on the high potential side Vdd, however, the invention is not limited to this. Each wring may have the same potential or different potentials. The wiring 111 is only required to be capable of storing a charge of the capacitor 104. Further, the wiring 110 or the wiring 111 is not required to keep the same potential constantly. There is no problem even if the potential is different in the set operation and in the putput operation as long as they operate normally.

Note that the wiring 113 and the wiring 112 are supplied with a power supply on the low potential side Vss, however, the invention is not limited to this. Each wring may have the same potential or different potentials. The wiring 113 or the wiring 112 is not required to keep the same potential constantly. They may have different potentials between the set operation and the output operation as long as they operate normally.

Note that the capacitor 104 is connected to the gate terminal of the current source transistor 101 and the wiring 111, however, the invention is not limited to this. It is most desirable that it is connected to the gate terminal and the source terminal of the current source transistor 101. This is because the operation of a transistor is not easily influenced by other causes as long as a voltage is maintained between the gate terminal and the source terminal since the operation of the transistor is determined by a gate-source voltage. Provided that the capacitor 104 is disposed between the gate terminal of the current source transistor 101 and another wiring, a potential of the gate terminal of the current source transistor 101 may change depending on the value of voltage drop of another wiring.

Note that the current source transistor 101 and the switching transistor 102 operate as a multi-gate transistor in the output operation, therefore, these transistors preferably have the same polarity (have the same conductivity).

Note that the current source transistor 101 and the switching transistor 102 operate as a multi-gate transistor in the output operation, however, a gate width W of each transistor may be either the same or different. Similarly, a gate length L may be either the same or different. However, the gate width W is preferably the same since the gate width W can be considered to be the same as a typical multi-gate transistor. As the gate length L of the switching transistor 102 becomes longer, a current flowing to the load 109 becomes smaller. Therefore, appropriate design may be carried out according to the circumstance.

Such a switch as 103, 105, 106, and 107 may be any switch such as an electrical switch or a mechanical switch. It may be anything as far as it can control a flow of a current. It may be a transistor, a diode, or a logic circuit configured with them. Therefor applying a transistor e, in the case of as a switch, a polarity (conductivity) thereof is not particularly limited because it operates just as a switch. However, when off-current is preferred to be small, a transistor of a polarity with small off-current is favorably used. For example, a transistor which provides an LDD region and the like have small off-current. Further, it is desirable that an n-channel type transistor is employed when a potential of a source terminal of the transistor as a switch is closer to the power source on the low potential side (Vss, Vgnd, 0V and the like), and a p-channel type transistor is desirably employed when the potential of the source terminal is closer to the power source on the high potential side (Vdd and the like). This helps the switch operate efficiently as an absolute value of a gate-source voltage of the transistor can be increased. It is also to be noted that a CMOS type switch can be also applied by using both n-channel type and p-channel type transistors.

Note that FIG. 1 is shown as a circuit of the invention, however, the invention is not limited to this configuration. By changing an arrangement and the number of switches, polarity of each transistor, the number and arrangement of the current source transistor 101, the number and arrangement of the switching transistor 102, a potential of each wiring, a direction of current flow and the like, various circuits can be employed in the configuration. Further, by combining each change also, a configuration using various circuits can be achieved.

For example, such a switch as 103, 105, 106, and 107 may be disposed anywhere as long as it can control ON/OFF of a target current. Specifically, the switch 107 which controls a current flowing to the load 109 is required to be disposed to be in series to the load 109. Similarly, the switch 106 which controls a current flowing to the basic current source 108 is only required to be disposed in series to the basic current source 108. Further, the switch 103 which controls a current flowing to the switching transistor 102 is only required to be in parallel to the switching transistor 102. The switch 105 is only required to be disposed so as to control a charge in the capacitor 104.

Figure 4:
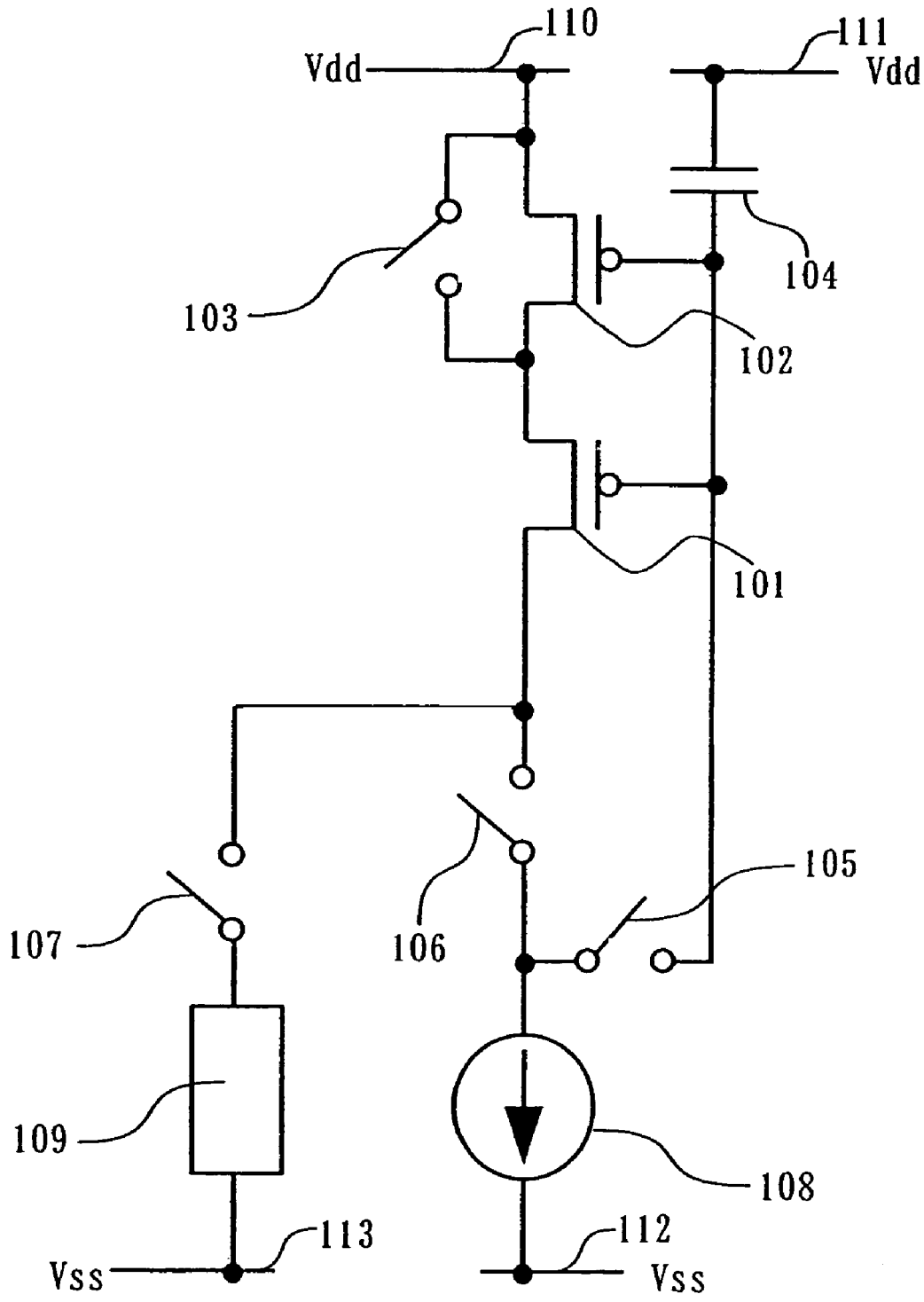
FIG. 4 is a diagram showing a configuration of the current source circuit of the invention.
Figure 5:
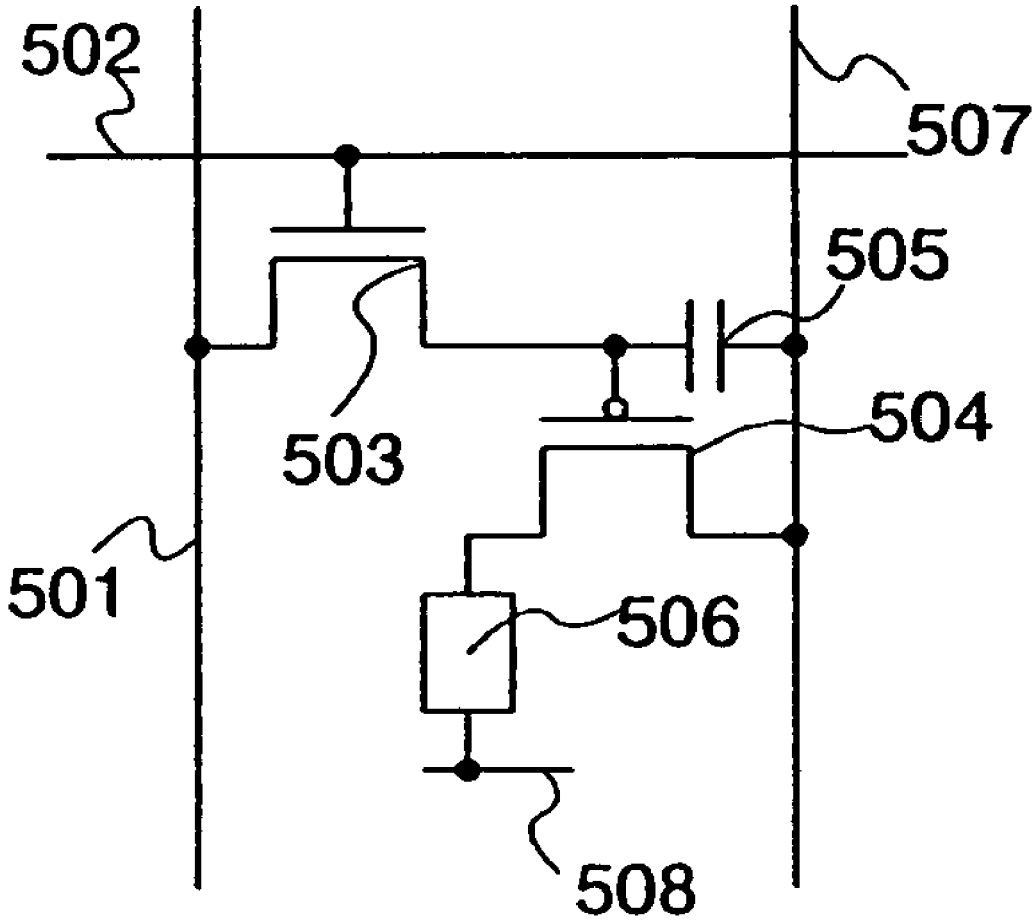
FIG. 5 is a diagram showing a configuration of a conventional pixel.
Figure 6:
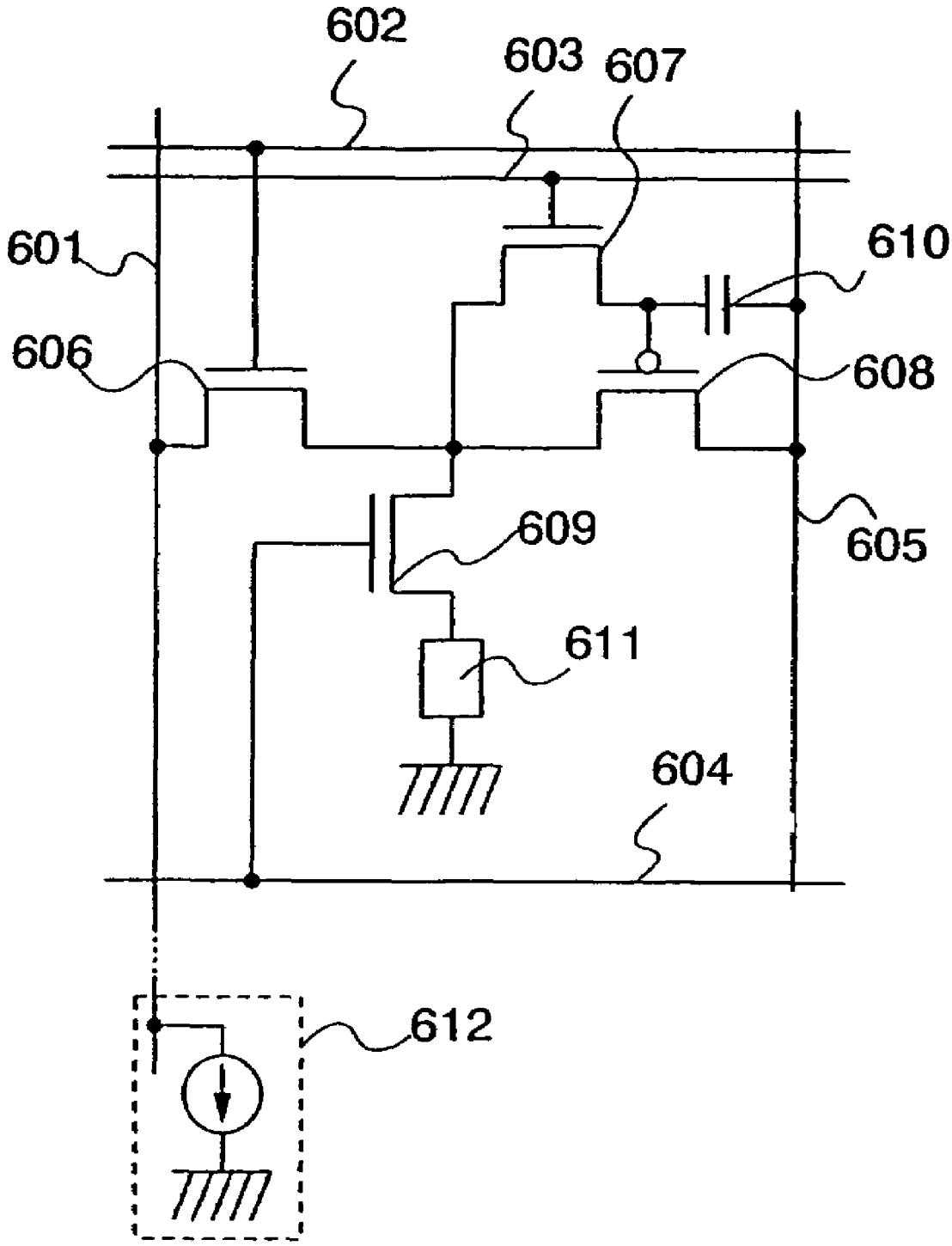
FIG. 6 is a diagram showing a configuration of a conventional pixel.
Figure 7:
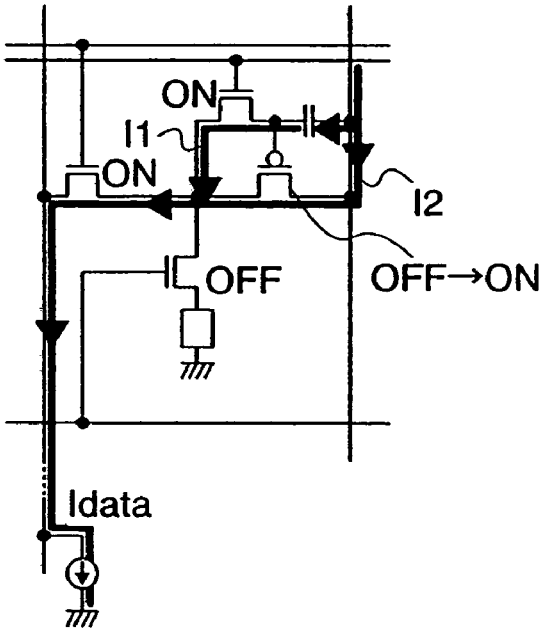
FIGS. 7A to 7E are diagrams showing an operation of a conventional pixel.
Figure 7:
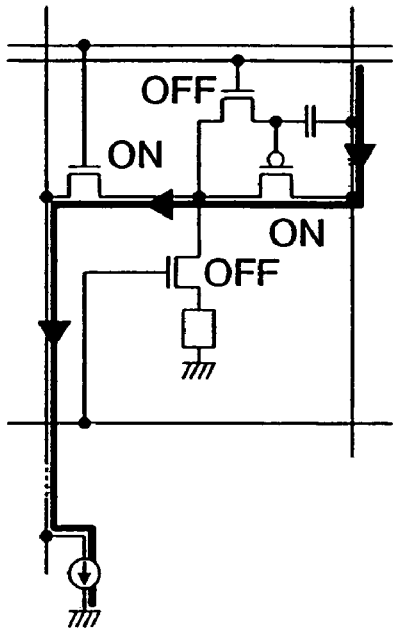
Figure 7:
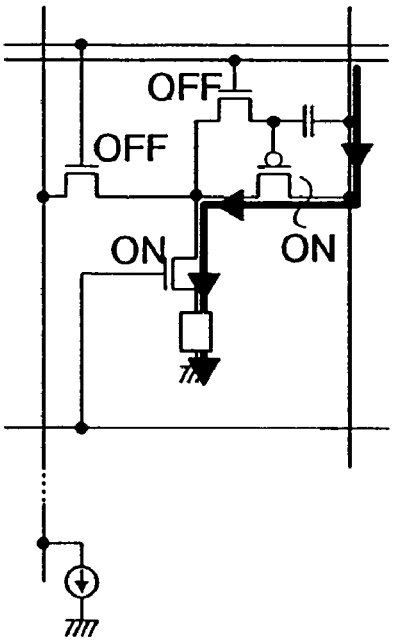
Figure 7:
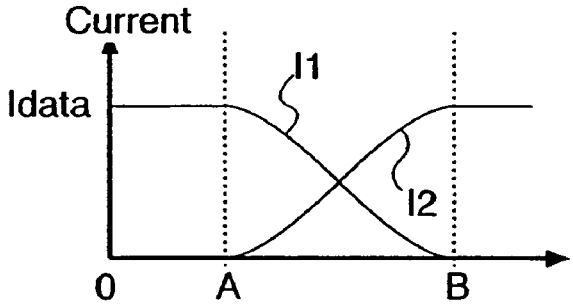
Figure 7:
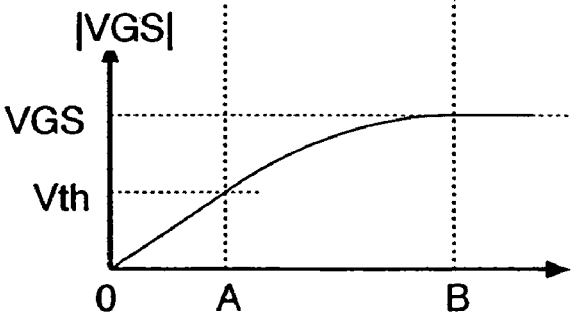
Figure 8:
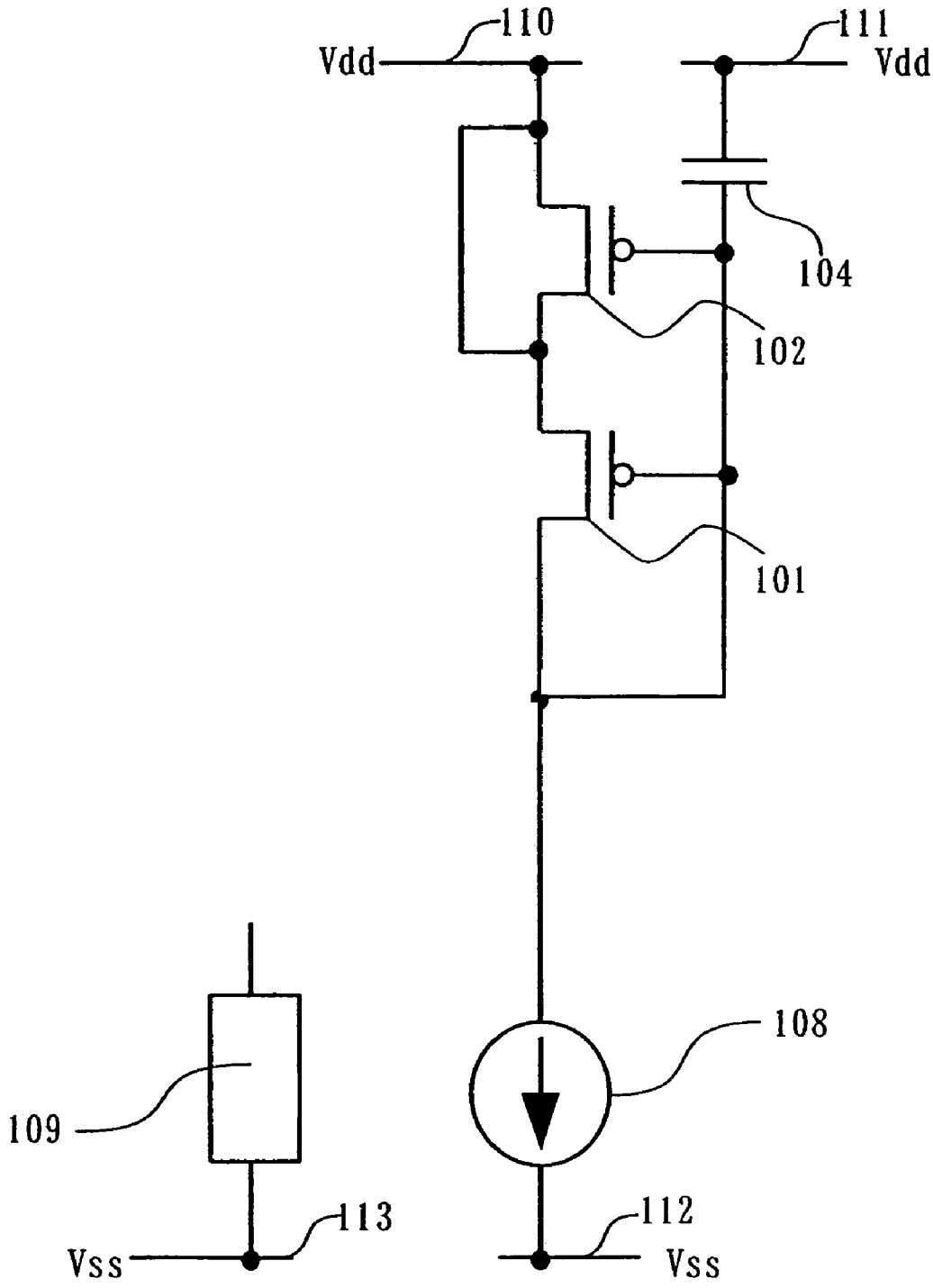
FIG. 8 is a diagram showing a connection state of the current source circuit of the invention.
Figure 9:
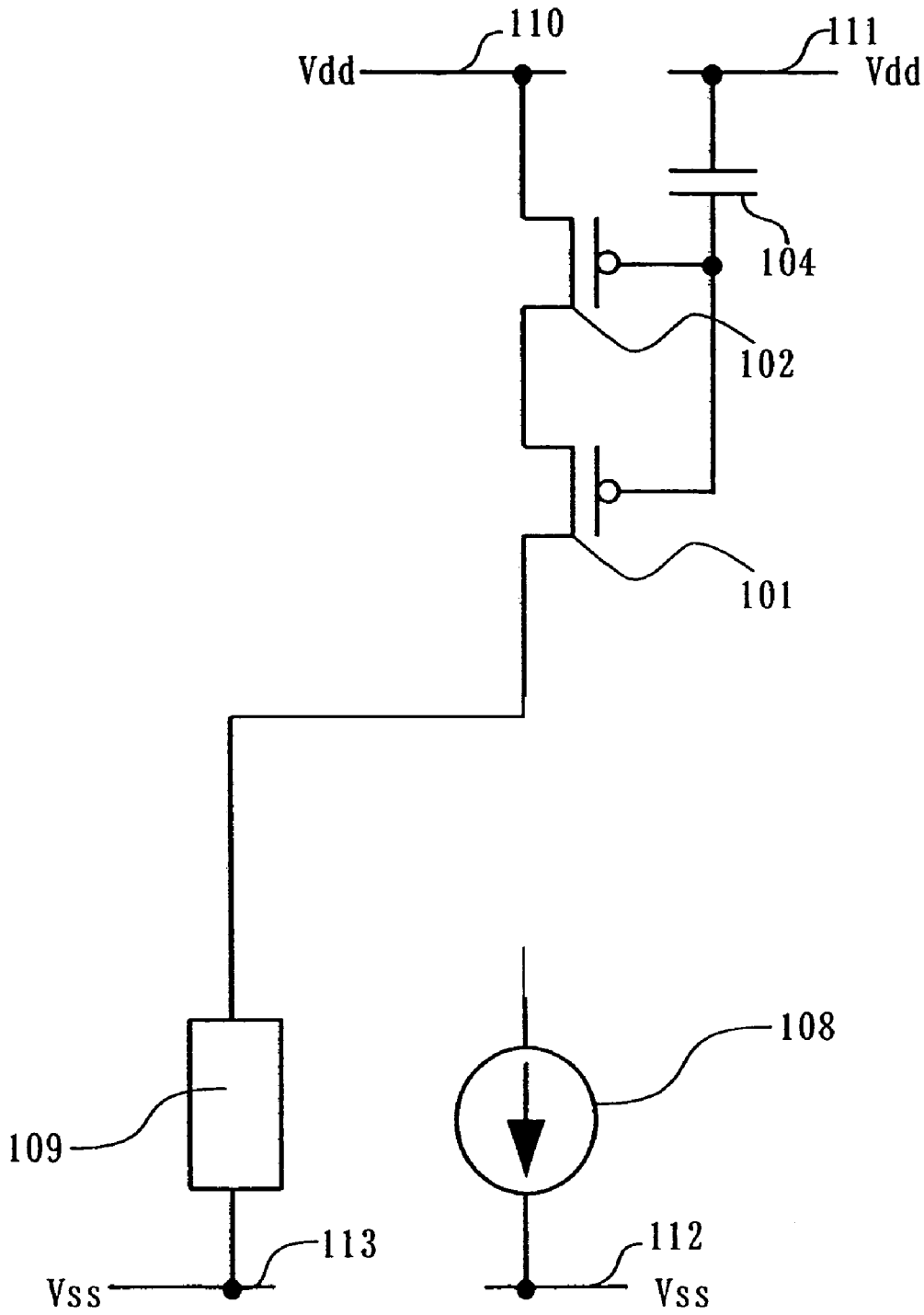
FIG. 9 is a diagram showing a connection state of the current source circuit of the invention.

FIG. 4 shows an example in the case where the switch 105 is disposed differently. That is, such a switch as 103, 105, 106, and 107 may be disposed anywhere as long as they are connected as shown in FIG. 8 in the set operation in which the current Ib from the basic current source 108 flows to the current source transistor 101 and the switching transistor 102 performs a short-circuit operation, and connected as shown in FIG. 9 in the output operation in which the switching transistor 102 performs a current source operation and a current flowing to the switching transistor 102 and the current source transistor 101 flows to the load 109.

Figure 10:
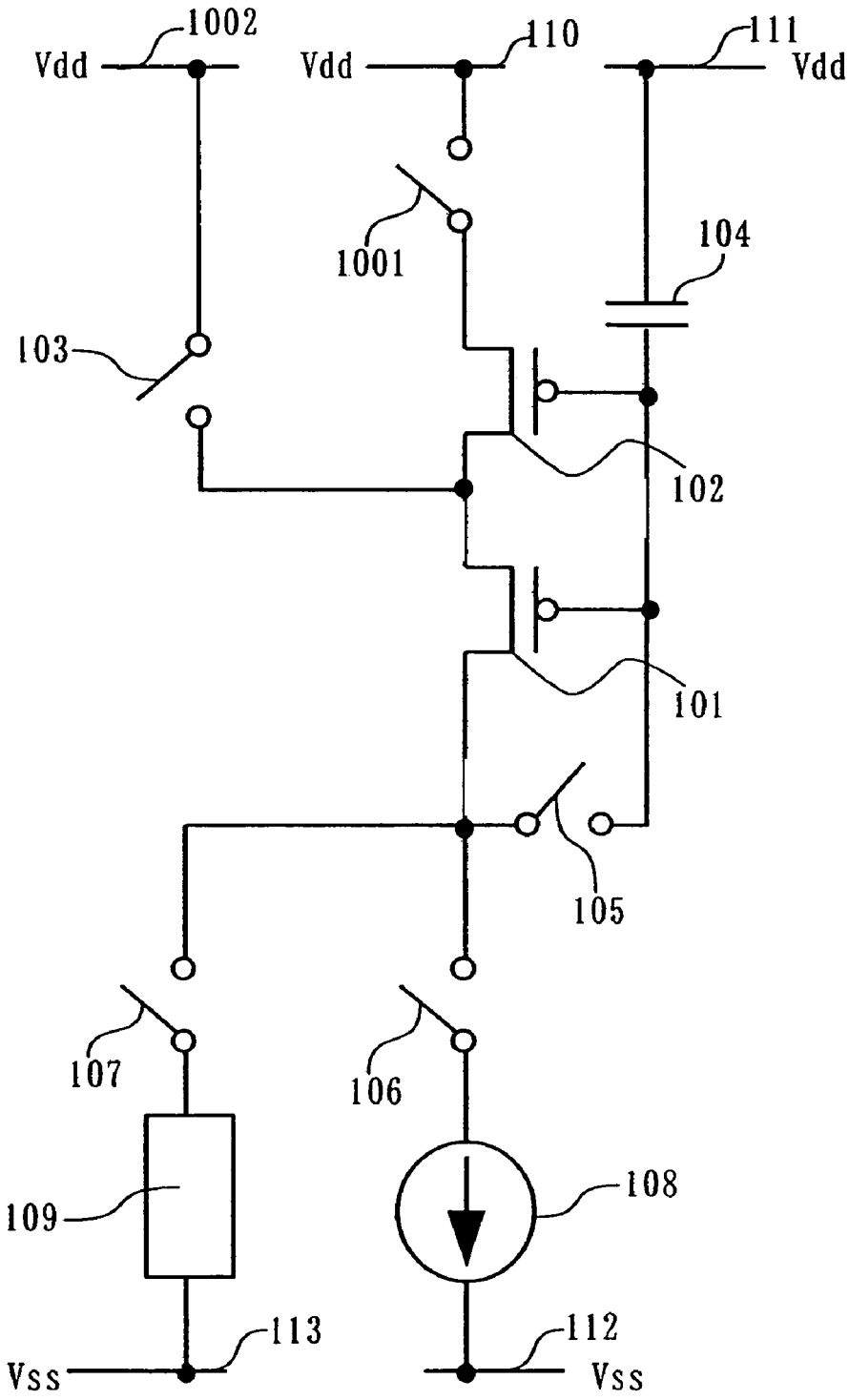
FIG. 10 is a diagram showing a configuration of the current source circuit of the invention.

Next, FIG. 10 shows an example in the case where the switch 103 is connected differently. The switch 103 is connected to a wiring 1002. A potential of the wiring 1002 may be Vdd or other values. Further in FIG. 10, a switch 1001 may be provided additionally or does not have to be provided. The switch 1001 may be disposed on either a source terminal side or a drain terminal side of the switching transistor 102. The switch 1001 is only required to be turned ON/OFF inversely to the switch 103. In this manner, a circuit can be configured by disposing switches in various positions.

Figure 11:
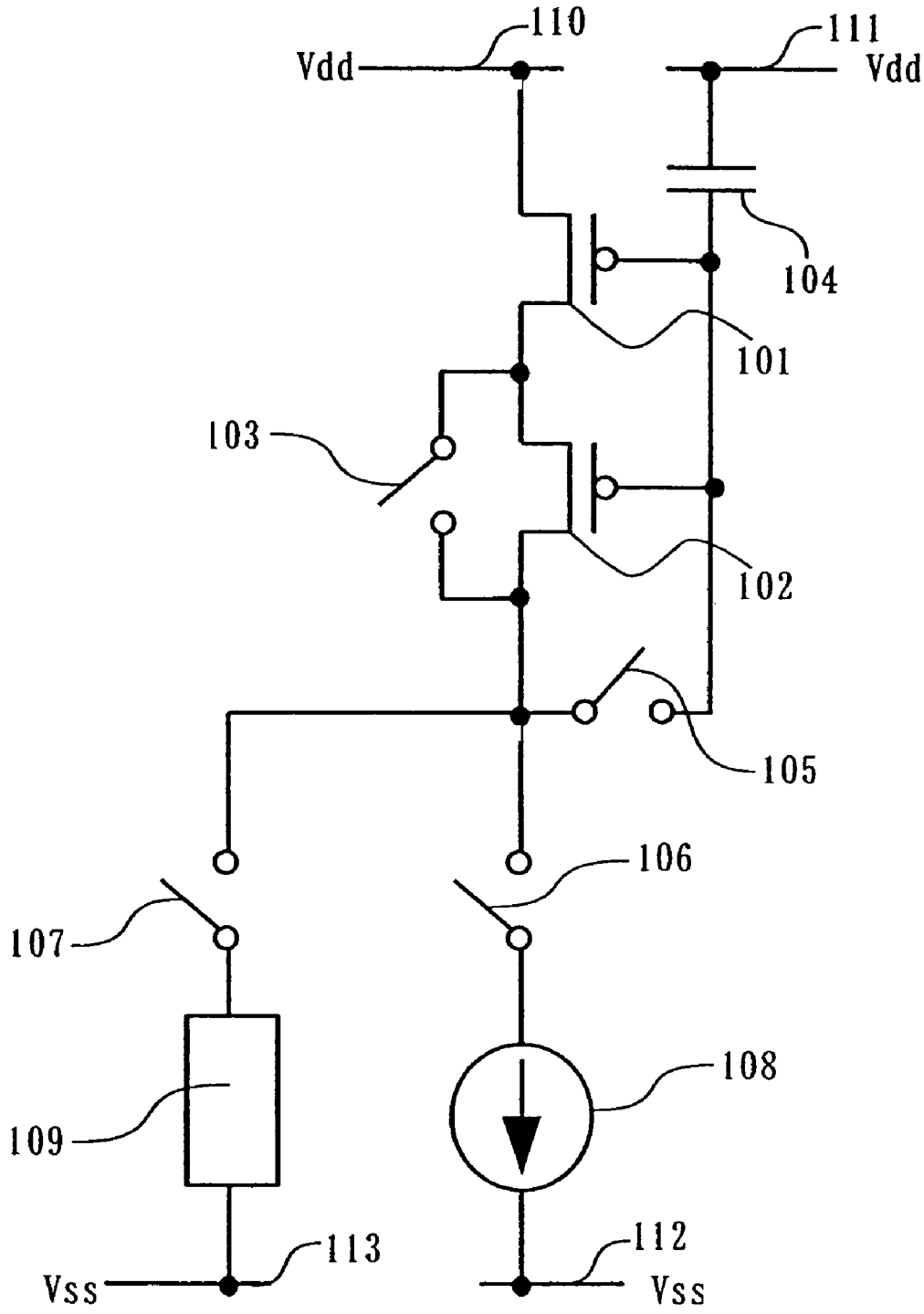
FIG. 11 is a diagram showing a configuration of the current source circuit of the invention.

Next, FIG. 11 shows the case where dispositions of the current source transistor 101 and the switching transistor 102 are interchanged. In FIG. 1, the wiring 110, the switching transistor 102, and the current source transistor 101 are disposed in this order, however, the wiring 110, the current source transistor 101 and the switching transistor 102 are disposed in this order in FIG. 11.

Here, the circuit in FIG. 1 and the circuit in FIG. 11 are compared. In FIG. 1, when the switching transistor 102 performs the short-circuit operation, there is a potential difference between a gate terminal and a source terminal (drain terminal) of the switching transistor 102. Therefore, a charge in a channel region of the switching transistor 102 is stored in the gate capacitance. Then, in the current source operation as well, the charge remains stored in the gate capacitance. Therefore, a potential of the gate terminal of the current source transistor 101 hardly changes between in the short-circuit operation (set operation) and the current source operation (output operation).

In FIG. 11, on the other hand, when the switching transistor 102 performs a short-circuit operation, there is hardly any potential difference between the gate terminal and the source terminal (drain terminal) of the switching transistor 102. Therefore, almost no charge is in the channel region of the switching transistor 102 and a charge is not stored in the gate capacitance thereof. Then, as the switches 105 and 103 are turned OFF in the current source operation, a charge is accumulated in the gate capacitance of the switching transistor 102, which operates as a part of a current source. The charge here is the one accumulated in the capacitor 104 or the gate capacitance in the current source transistor 101. This charge moves to the gate portion of the switching transistor 102. Therefore, the potential of the gate terminal of the current source transistor 101 changes by the moved charge between in the short-circuit operation (set operation) and the current source operation (output operation). As a result, an absolute value of a gate-source voltage of the current source transistor 101 and the switching transistor 102 becomes small in the output operation, which makes a current flowing to the load 109 small.

Therefore, the arrangement of the current source transistor 101 and the switching transistor 102 may be designed according to circumstances. For example, if an EL element as the load 109 emits light even slightly when a black display is required, a contrast is decreased. In that case, it is more preferable to employ the configuration in FIG. 11 as a current is reduced slightly.

Figure 12:
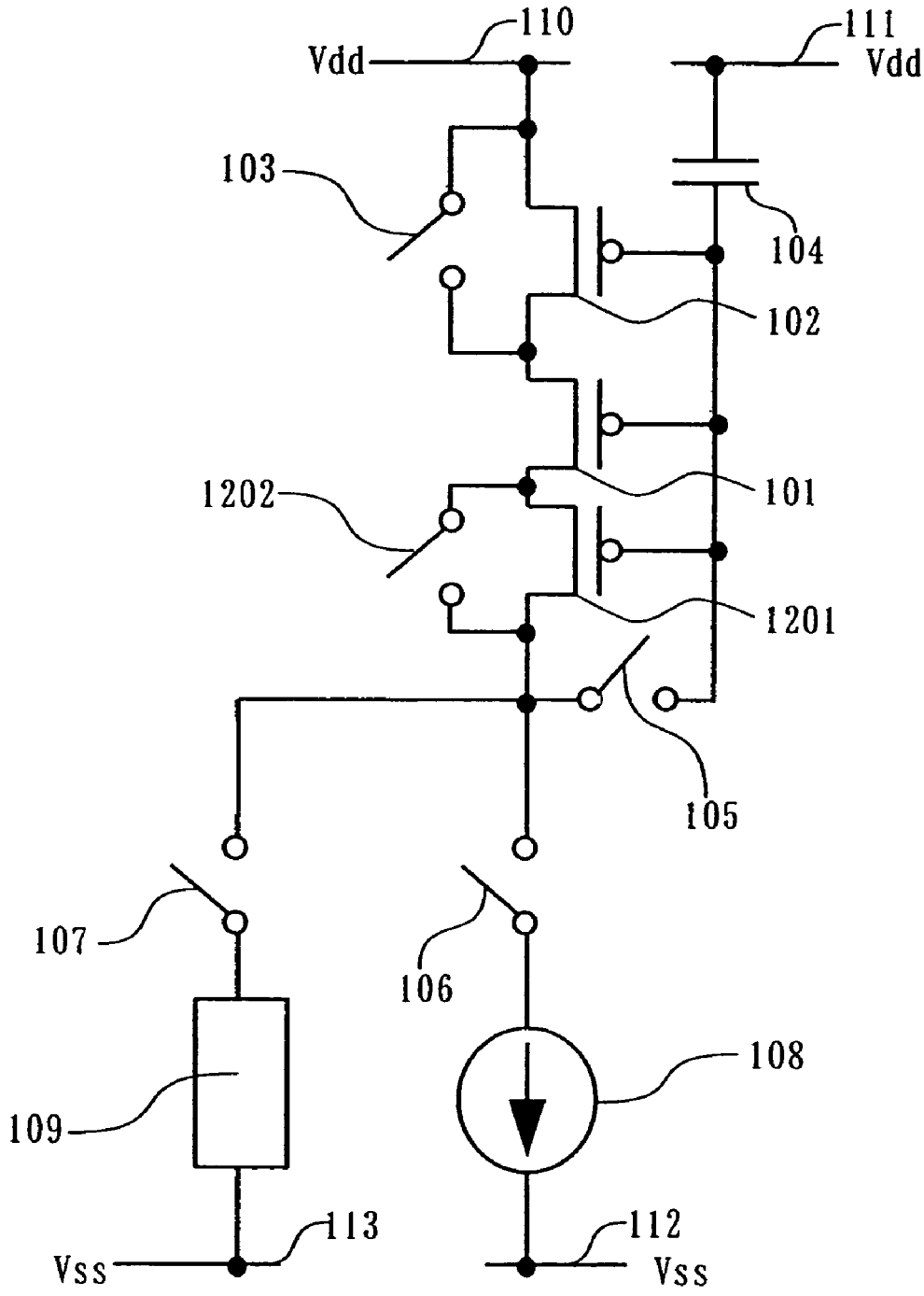
FIG. 12 is a diagram showing a configuration of the current source circuit of the invention.

In FIG. 1, the current source transistor and the switching transistor 102 are disposed one each, however, a plurality of either or both may be disposed as well. Further, the arrangement thereof may be selected arbitrarily. FIG. 12 shows an example in the case where a second switching transistor 1201 and a switch 1202 are disposed.

Figure 13:
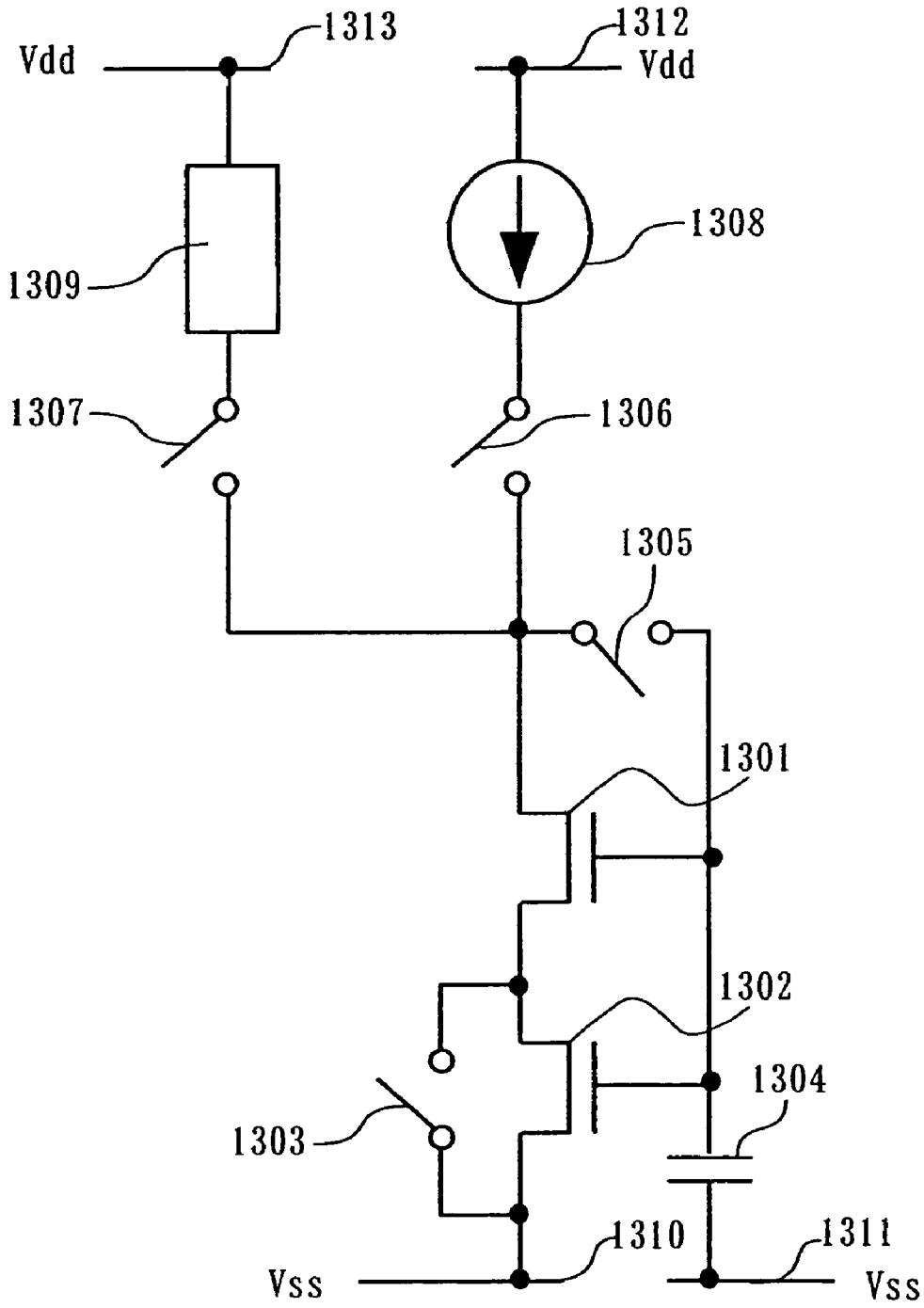
FIG. 13 is a diagram showing a configuration of the current source circuit of the invention.

Note that either of the current source transistor 101 and the switching transistor 102 are p-channel type transistors in FIG. 1, however, the invention is not limited to this. FIG. 13 shows an example in the case where the polarity (conductivity) of the current source transistor 101 and the switching transistor 102 are changed and the connecting structure of the circuit is not changed in FIG. 1. When FIG. 1 and FIG. 13 are compared, it is clear that the change is easily done by changing potentials of the wirings 112, 113, 110, and 111 to the ones of wirings 1312, 1313, 1310, and 1311 and changing the direction of current of the basic current source 108. The connections of a current source transistor 1301, a switching transistor 1302, switches 1303, 1305, 1306, and 1307, a basic current source 1308, a load 1309 and the like are not changed. Note that the wiring 1310 and the wiring 1311 are different wirings, however, they may be electrically connected to each other. Note that the wiring 1312 and the wiring 1313 are different wirings, however, they may be electrically connected to each other.

Figure 14:
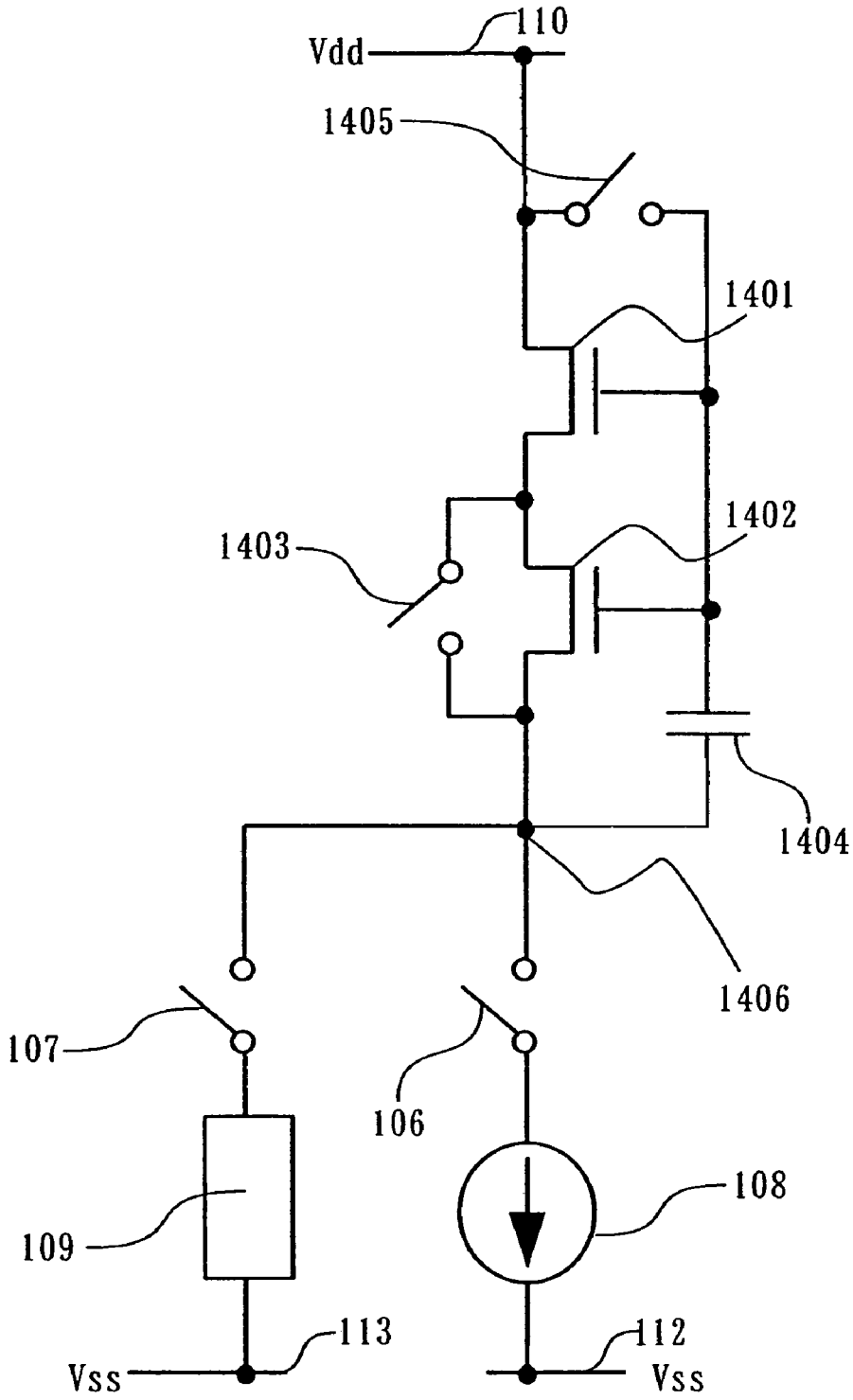
FIG. 14 is a diagram showing a configuration of the current source circuit of the invention.

Further, FIG. 14 shows an example in the case where the polarity (conductivity) of the current source transistor 101 and the switching transistor 102 are changed by changing the connecting structure of the circuit without changing the direction of current in the circuit of FIG. 1. In this case, source terminals and drain terminals of the current source transistor 101 and the switching transistor 102 are inversed. Therefore, connections of a capacitor 1404 and a switch 1405 may be changed accordingly.

There are a current source transistor 1401 which constantly operates as a current source (or a part of it) and a switching transistor 1402 of which operation changes according to the circumstance. The current source transistor 1401, the switching transistor 1402, and the wiring 110 are connected in series. A gate terminal of the current source transistor 1401 is connected to one of the terminals of the capacitor 1404. The other terminal 1406 of the capacitor 1404 is connected to a source terminal of the switching transistor 1402 (the current source transistor 1401). Therefore, the capacitor 1404 can hold a gate-source voltage of the current source transistor 1401. Further, the gate terminal and a drain terminal of the current source transistor 1401 are connected via a switch 1405. The capacitor 1404 can be controlled to hold a charge by ON/OFF of the switch 1405.

Figure 15:
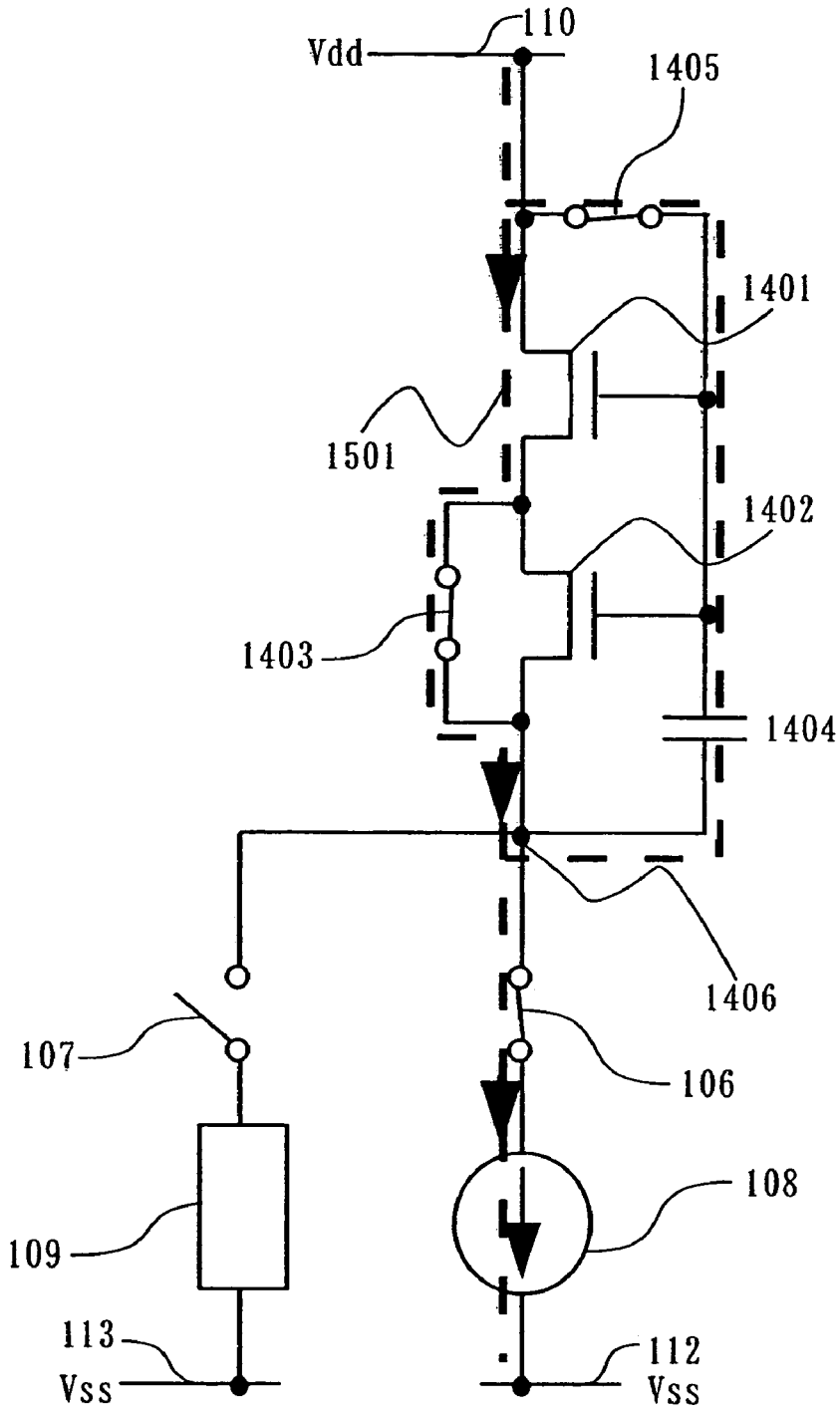
FIG. 15 is a diagram showing an operation of the current source circuit of the invention.

An operation of FIG. 14 is described. However, it is similar to the operation of FIG. 1, therefore, description will be made briefly. First, the switches 1403, 1405, 106 are turned ON and a switch 107 is turned OFF as shown in FIG. 15. A current path at that time is shown by a dashed arrow 1501. Then, when a stationary state is obtained, a current stops flowing to the capacitor 1404. Then, a gate-source voltage of the current source transistor 1401 is accumulated in the capacitor 1404. That is, a voltage required to flow the current Ib between the source and drain of the current source transistor 1401 is applied between the gate and source thereof. The aforementioned operation corresponds to the set operation. At that time, the switching transistor 1402 is performing the short-circuit operation.

Figure 16:
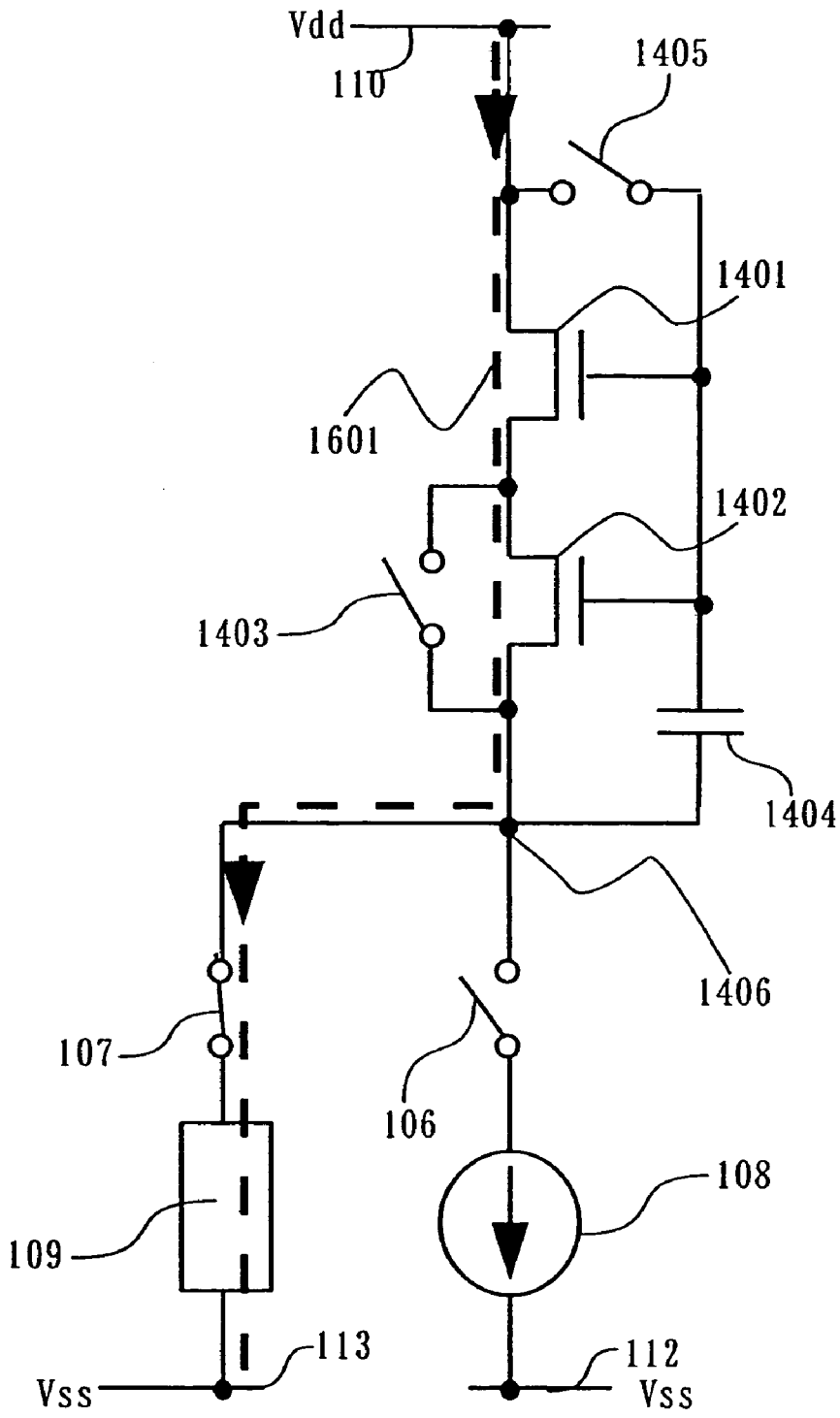
FIG. 16 is a diagram showing an operation of the current source circuit of the invention.
Figure 17:
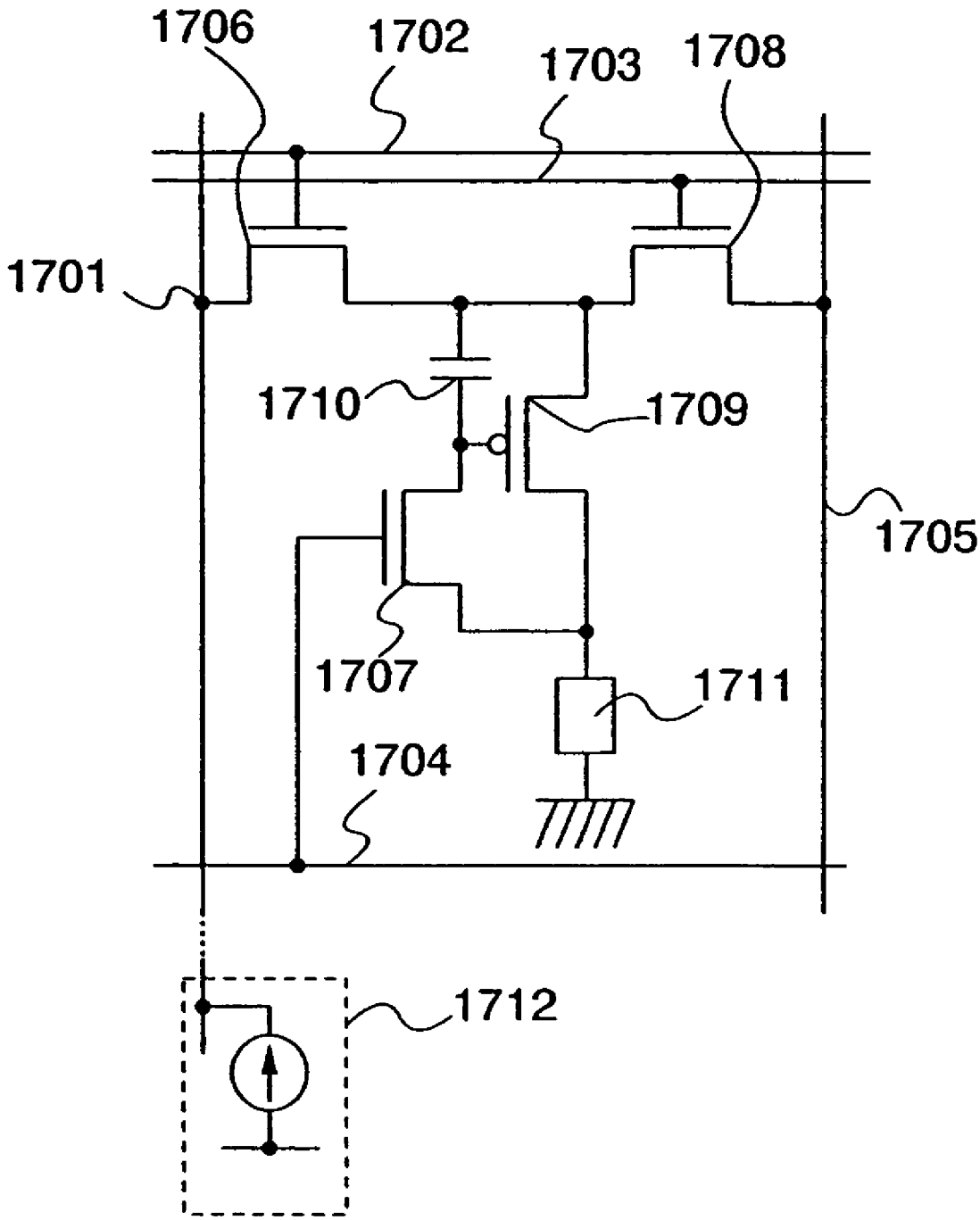
FIG. 17 is a diagram showing a configuration of a conventional pixel.
Figure 18:
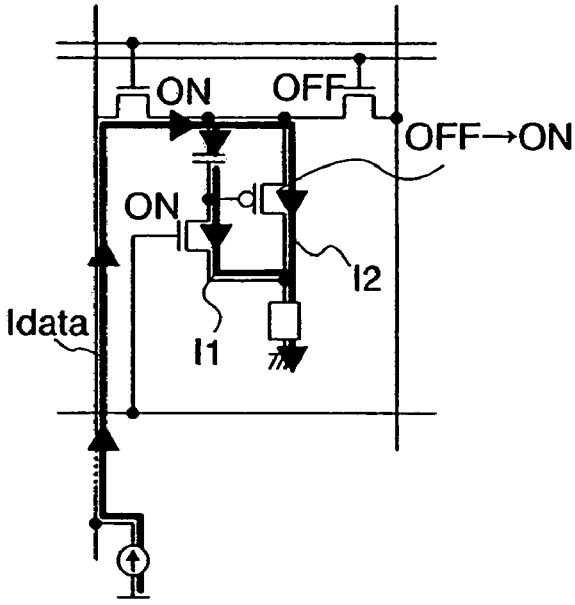
FIGS. 18A to 18E are diagrams showing an operation of a conventional pixel.
Figure 18:
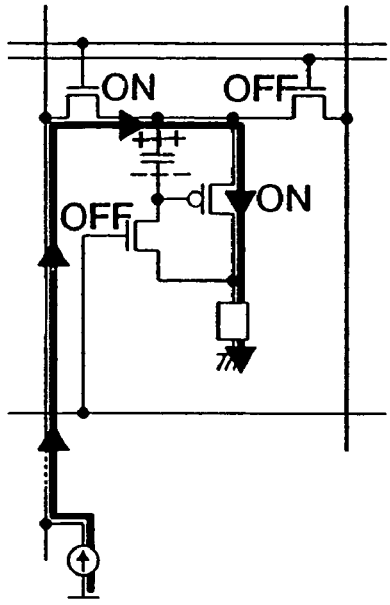
Figure 18:
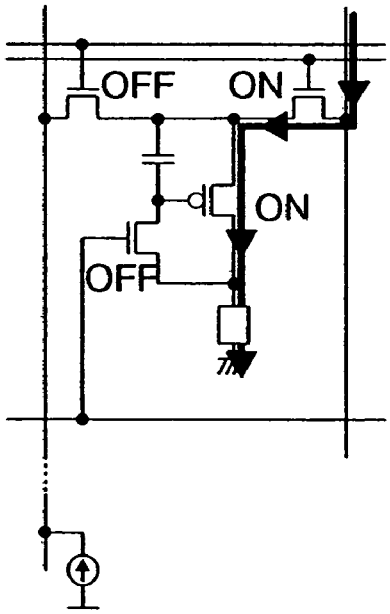
Figure 18:
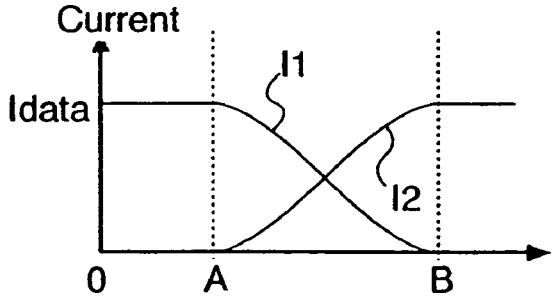
Figure 18:
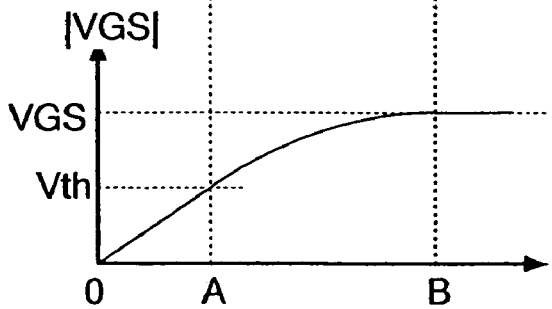
Figure 19:
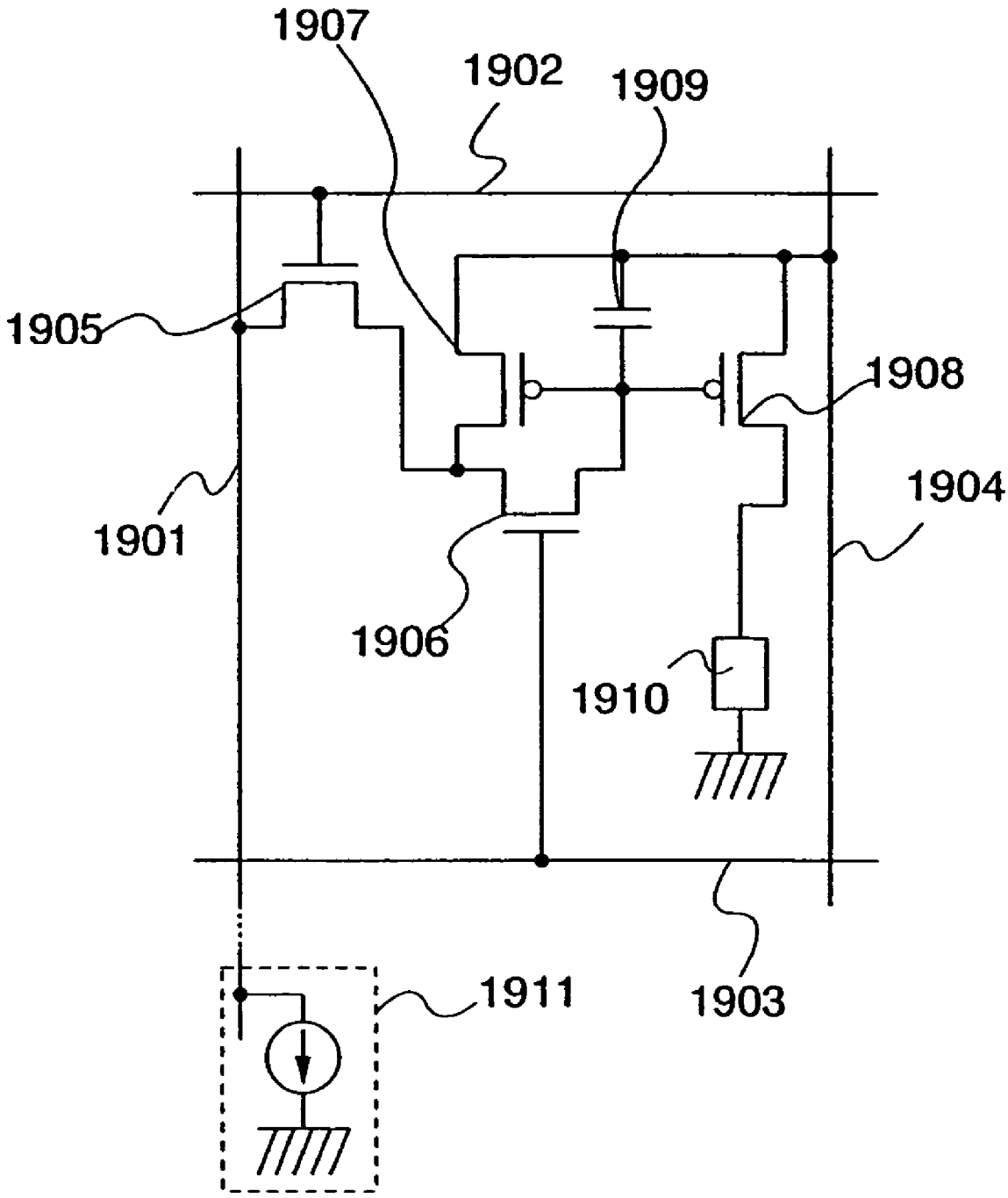
FIG. 19 is a diagram showing a configuration of a conventional pixel.
Figure 20:
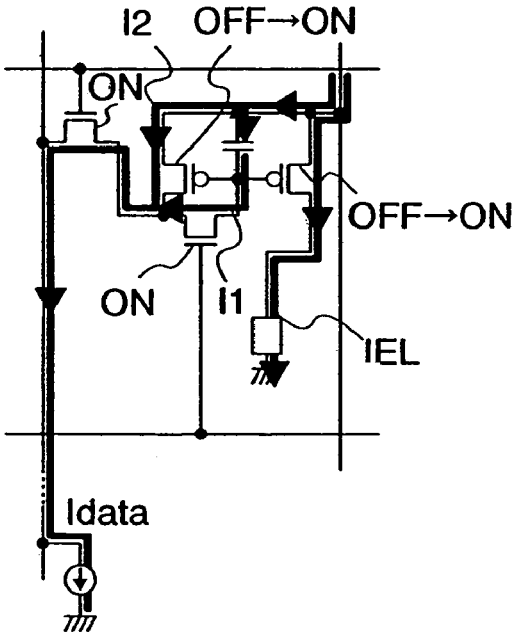
FIGS. 20A to 20E are diagrams showing an operation of a conventional pixel.
Figure 20:
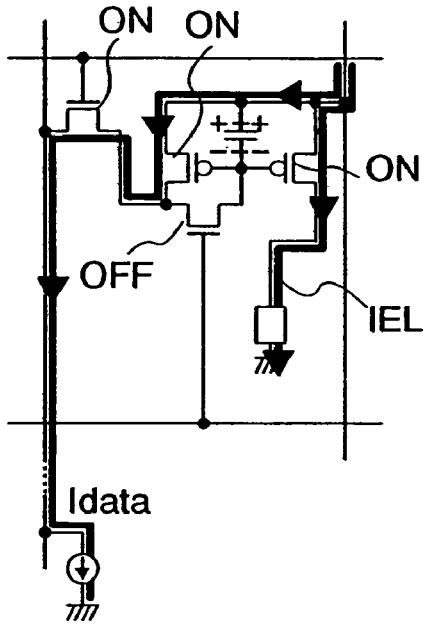
Figure 20:
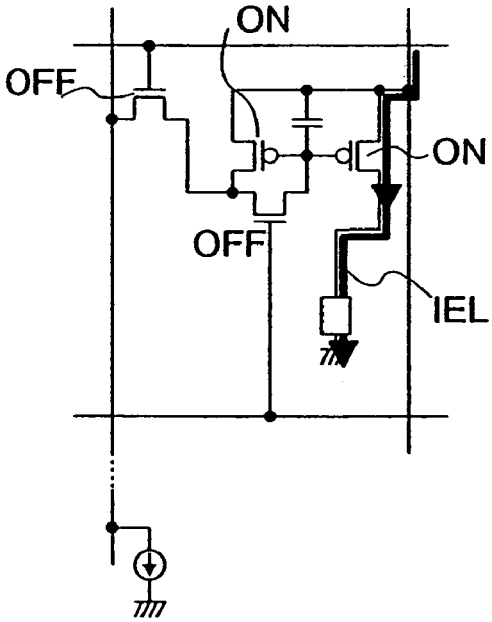
Figure 20:
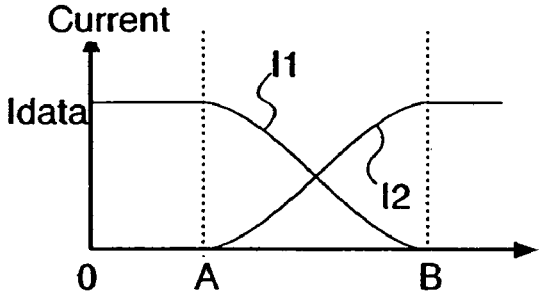
Figure 20:
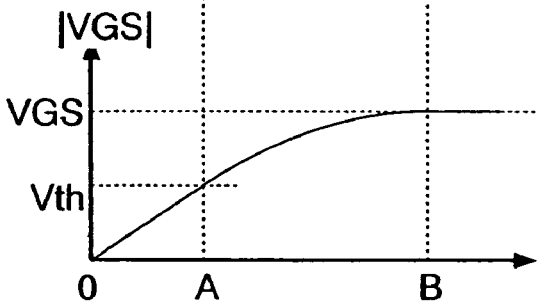

Next, the switches 1403, 1405, and 106 are turned OFF and the switch 107 is turned ON as shown in FIG. 16. A current path at that time is shown by a dashed arrow 1601. Then, the current source transistor 1401 and the switching transistor 1402 operate as a multi-gate transistor. Therefore, a current flows to the load 109, which is smaller than Ib. The aforementioned operation corresponds to the output operation. At that time, the switching transistor 1402 is performing the current source operation.

Note that a potential of the terminal 1406 of the capacitor 1404 is different between the set operation and the output operation in many cases. However, voltage (potential difference) at both terminals of the capacitor 1404 do not change, therefore, a desired current flows to the load 109.

Figure 21:
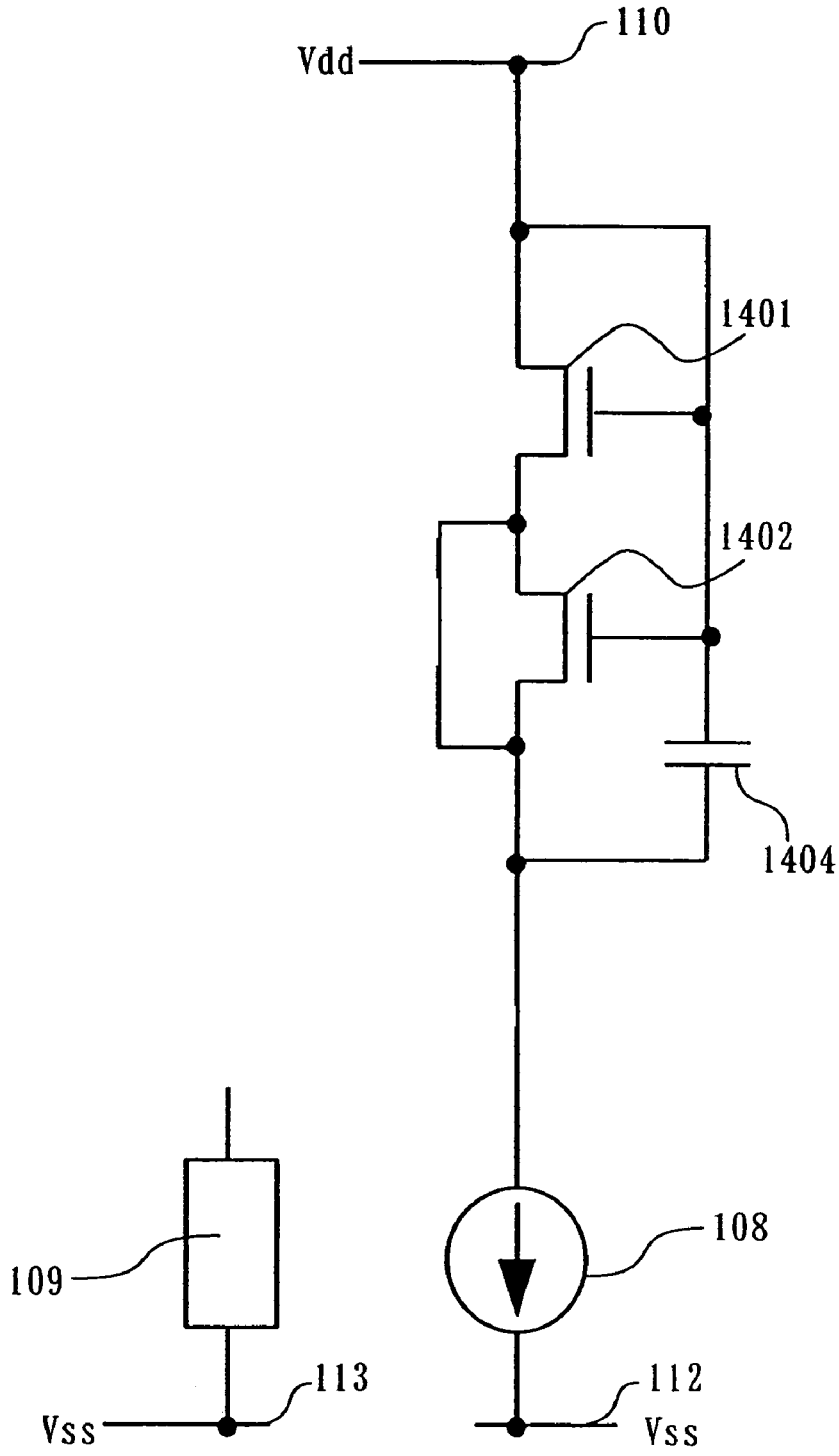
FIG. 21 is a diagram showing a connection state of the current source circuit of the invention.
Figure 22:
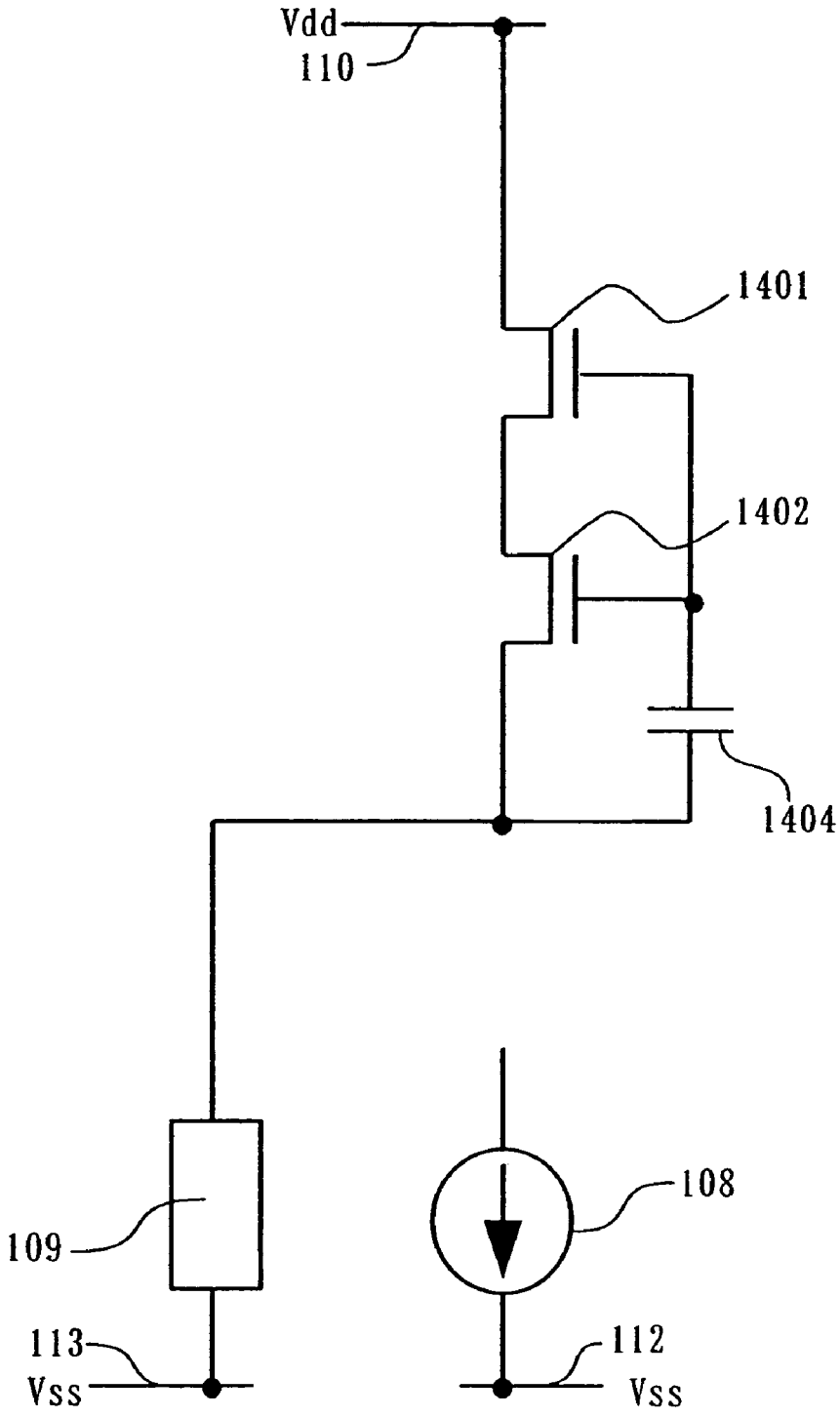
FIG. 22 is a diagram showing a connection state of the current source circuit of the invention.

In this case also, it is needless to say that the switches may be disposed anywhere as long as they are connected as shown in FIG. 21 in the set operation and connected as shown in FIG. 22 in the output operation.

Figure 23:
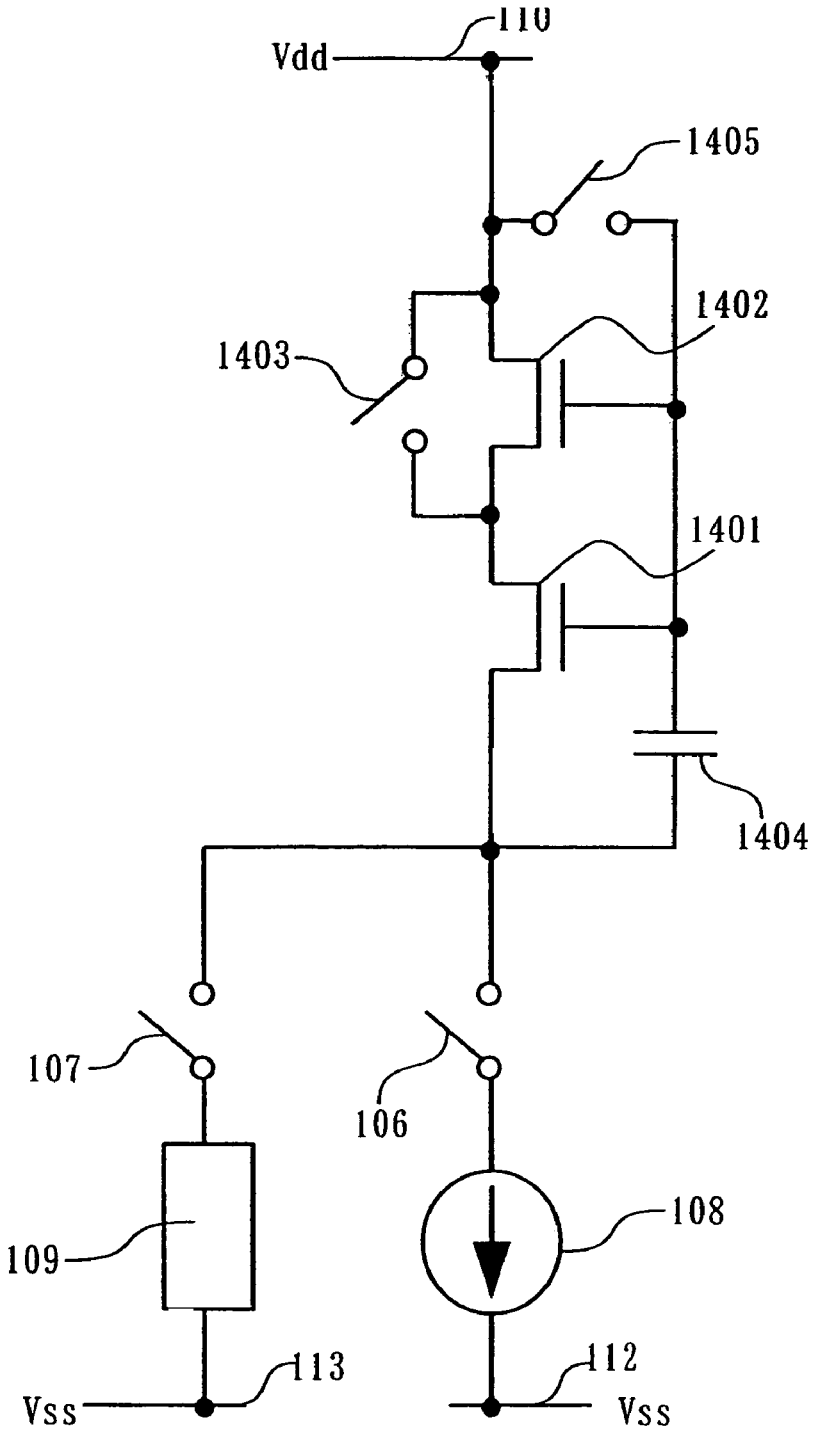
FIG. 23 is a diagram showing a configuration of the current source circuit of the invention.

FIG. 14 shows a circuit corresponding to FIG. 1 while FIG. 23 shows a circuit corresponding to FIG. 11. In FIG. 23, a charge is not accumulated in the gate capacitance of the switching transistor 1402 in the short-circuit operation.

The switching transistors 102 and 1402 perform the short-circuit operation in the set operation and perform the current source operation in the output operation heretofore, however, the invention is not limited to this. For example, the current source operation may be performed in the set operation as a current path shown by a dashed arrow 2401 in FIG. 24. Further, the current source operation may be performed in the short-circuit operation as a current path shown by a wave arrow 2501 in FIG. 25. In this case, a larger current flows in the output operation, which means a signal is amplified. Therefore, it can be applied to various analog circuits.

In this manner, by changing an arrangement and the number of switches, polarity of each transistor, the number and arrangement of the current source transistor, the number and arrangement of the switching transistor, a potential of each wiring, a direction of current flow and the like, not only the circuit of FIG. 1 but also various circuits can be employed for constituting the present invention. Further, by combining each change also, the present invention can be constituted by using further various circuits.

Embodiment Mode 2

In Embodiment Mode 1, the configuration of FIG. 1 is employed for realizing the current source operation and the short-circuit operation respectively to the switching transistor 102. In this embodiment mode, an example of a configuration for realizing the current source operation and the short-circuit operation, which is different from Embodiment Mode 1 is shown.

It should be noted that most of the description which is similar to Embodiment Mode 1 will be omitted here.

Figure 26:
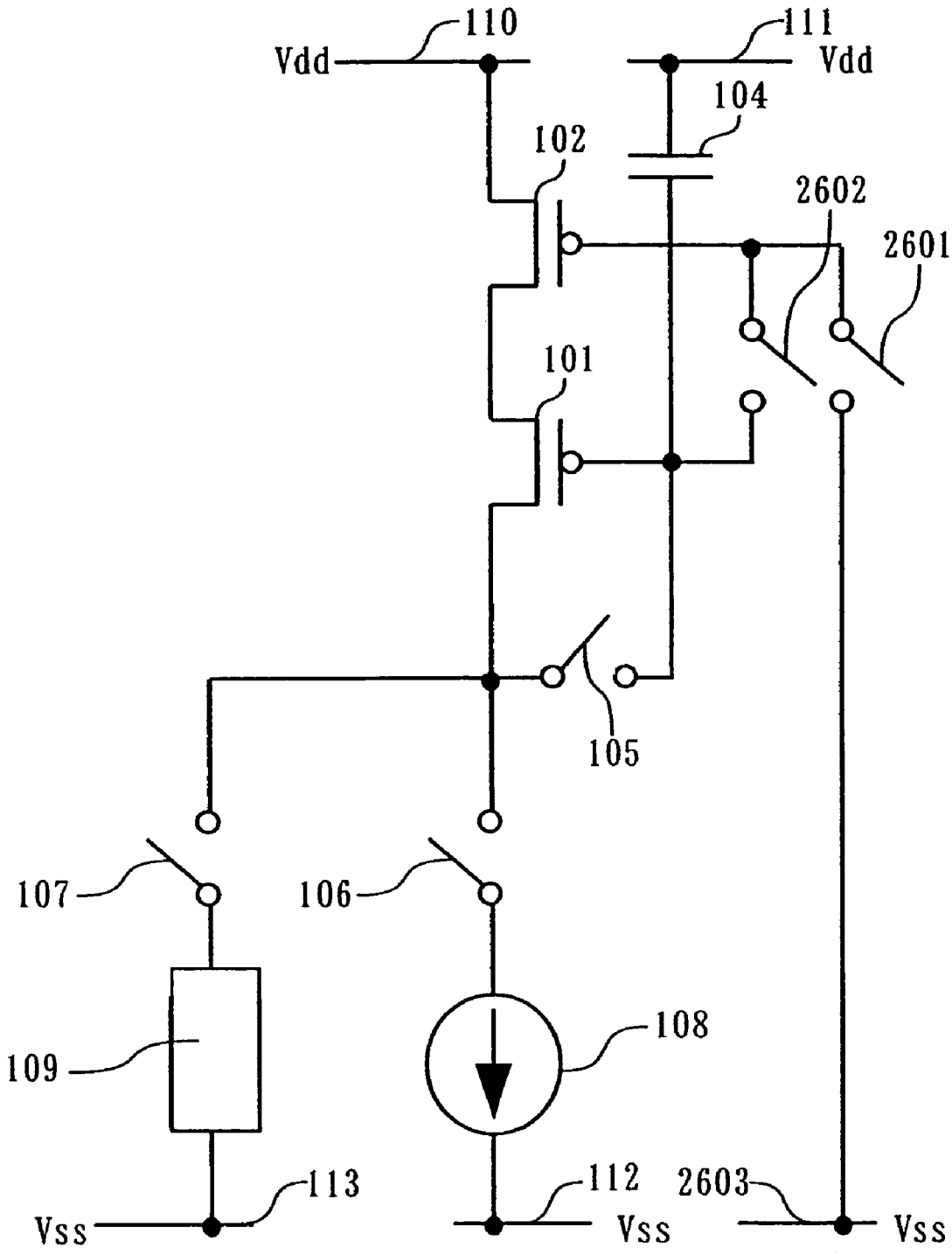
FIG. 26 is a diagram showing a configuration of the current source circuit of the invention.
Figure 27:
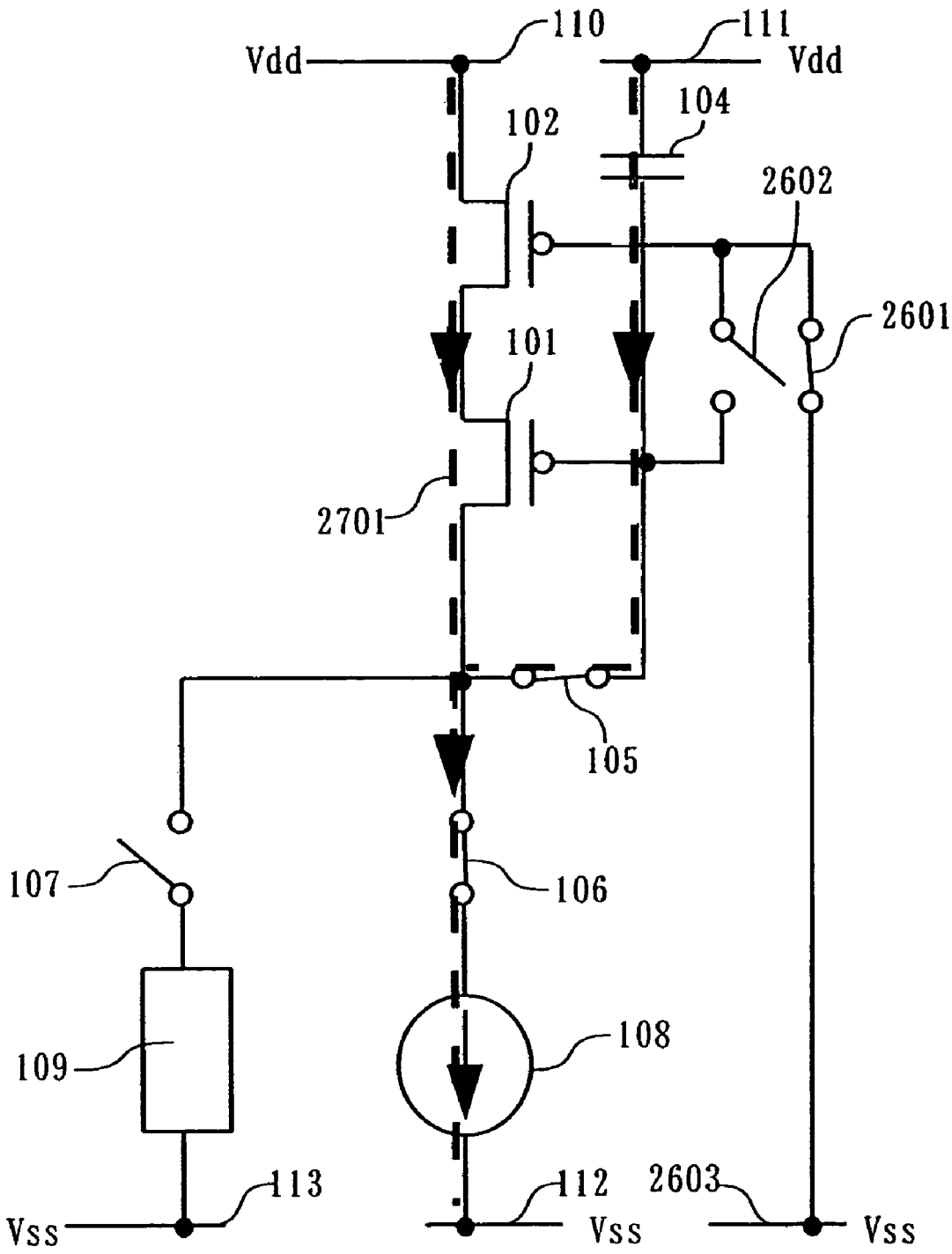
FIG. 27 is a diagram showing an operation of the current source circuit of the invention.

First, FIG. 26 shows a second configuration in which the current source operation and the short-circuit operation are realized respectively to the switching transistor 102.

In FIG. 1, the switch 103 is used so that the switching transistor 102 can perform the short-circuit operation. By controlling the switch 103, a current does not flow between the source and drain of the switching transistor 102 so the source terminal and the drain terminal of the switching transistor 102 have approximately the same potentials.

On the contrary, a voltage of the gate terminal of the switching transistor 102 is controlled so that a large current can flow to the switching transistor 102 in FIG. 26. Specifically, an absolute value of a gate-source voltage of the switching transistor 102 is made large by using a switch 2601. As a result, only a small source-drain voltage of the switching transistor 102 is required when a certain value of current flows. That is, the switching transistor 102 operates just as a switch.

In the current source operation, in FIG. 1, the switch 103 is turned OFF and the current source transistor 101 and the switching transistor 102 operate as a multi-gate transistor since the gate terminals thereof are connected to each other.

In FIG. 26, on the other hand, the current source transistor 101 and the switching transistor 102 of which gate terminals are not connected to each other are connected by using a switch 2602. As a result, they can operate as a multi-gate transistor.

An operation of FIG. 26 is described. First, switches 2601, 105 and 106 are turned ON and the switches 107 and 2602 are turned OFF. A current path at that time is shown by a dashed arrow 2701. Then, the gate terminal of the switching transistor 102 is connected to a wiring 2603. The wiring 2603 is supplied with a power supply on the low potential side (Vss), therefore, an absolute value of a gate-source voltage of the switching transistor 102 becomes quite large. Thus, the switching transistor 102 has quite a large current drive capacity and the source terminal and the drain terminal thereof have approximately the same potentials. Therefore, a current Ib flowing in the basic current source 108 flows to the capacitor 104 and the current source transistor 101, thereby the source terminal of the current source transistor 101 has approximately the same potential as the wiring 110. When a current flowing between the source and drain of the current source transistor 101 and the current Ib flowing in the basic current source 108 become equal, a current stops flowing to the capacitor 104. That is, a stationary state is obtained. Then, a potential of the gate terminal at that time is accumulated in the capacitor 104. That is, a voltage required to flow the current Ib between the source and drain of the current source transistor 101 is applied to the gate terminal thereof. The aforementioned operation corresponds to the set operation. At that time, the switching transistor 102 operates as a switch and performs the short-circuit operation.

Figure 28:
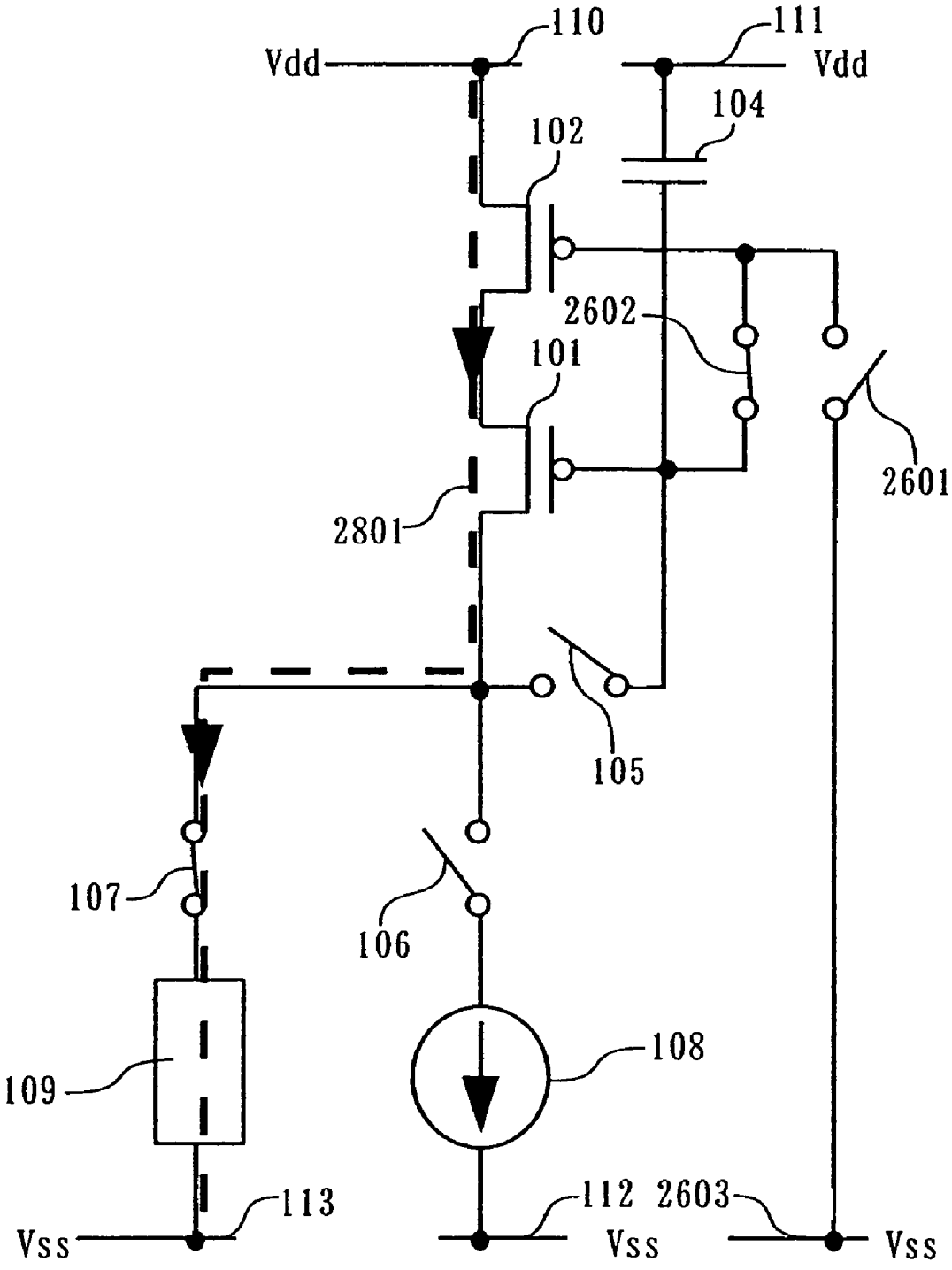
FIG. 28 is a diagram showing an operation of the current source circuit of the invention.

Next, the switches 2601, 105 and 106 are turned OFF and the switches 107 and 2602 are turned ON as shown in FIG. 28. A current path at that time is shown by a dashed arrow 2801. Then, the gate terminal of the switching transistor 102 and the gate terminal of the current source transistor 101 are connected to each other. On the other hand, a charge accumulated in the set operation and stored in the capacitor 104 is applied to the gate terminal of the switching transistor 102. As described above, the current source transistor 101 and the switching transistor 102 operate as a multi-gate transistor. Therefore, assuming that the current source transistor 101 and the switching transistor 102 are one transistor, a gate length L of the transistor becomes longer than L of the current source transistor 101. Therefore, a current flowing to the load 109 becomes smaller than Ib. The aforementioned operation corresponds to the output operation. At that time, the switching transistor 102 is performing the current source operation.

Note that a potential of the wiring 2603 is not limited to Vss. It may have any value which is enough to turn ON the switching transistor 102.

Note that FIG. 26 is shown as a circuit of this embodiment mode, however, the configuration is not limited to this. As in Embodiment Mode 1, by changing the arrangement and the number of switches, polarity of each transistor, the number and the arrangement of the current source transistor 101, the number and the arrangement of the switching transistor 102, a potential of each wiring, a direction of current flow and the like, various circuits can be employed in the configuration. Further, by combining each change also, a configuration using various circuits can be achieved.

Figure 29:
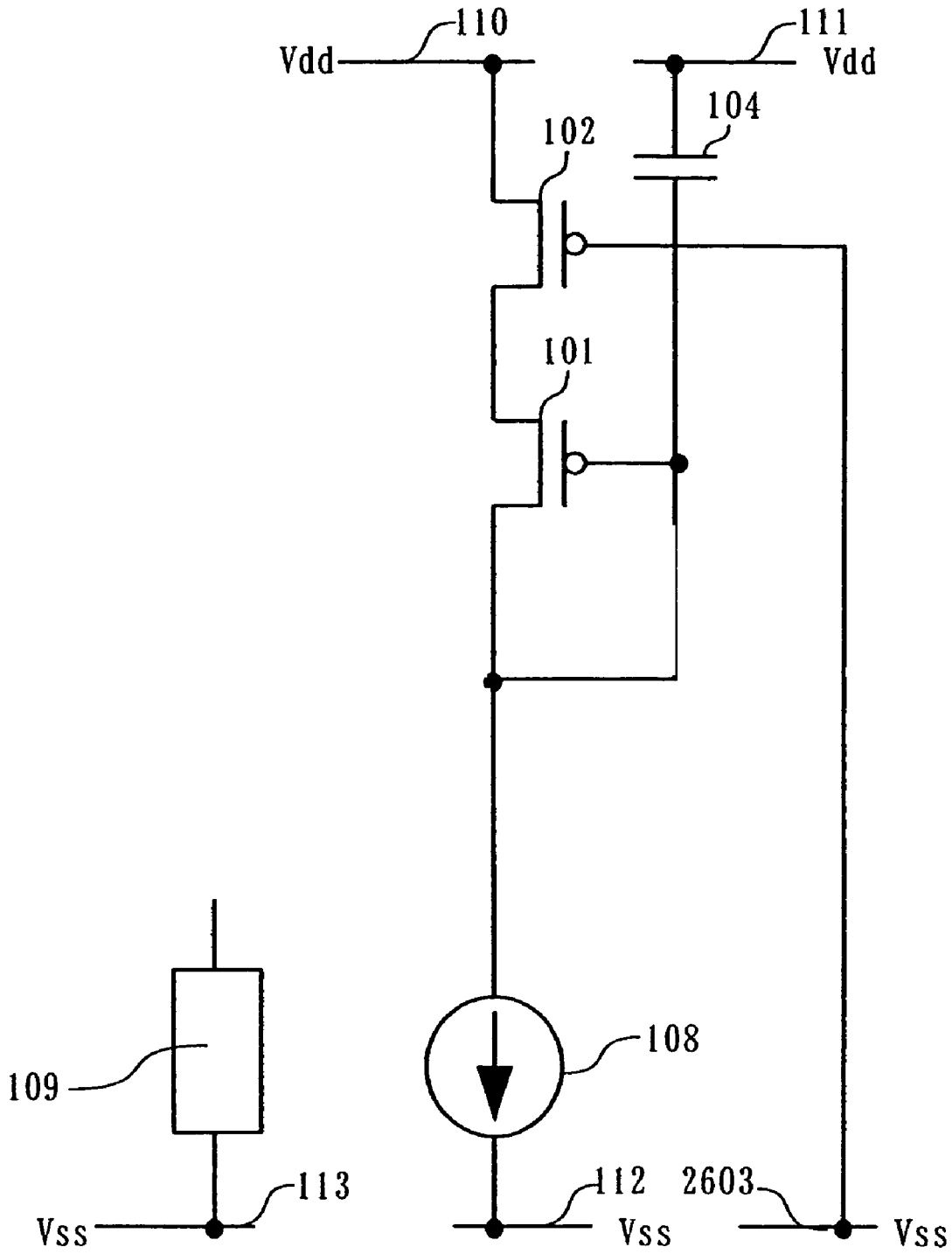
FIG. 29 is a diagram showing a connection state of the current source circuit of the invention.
Figure 30:
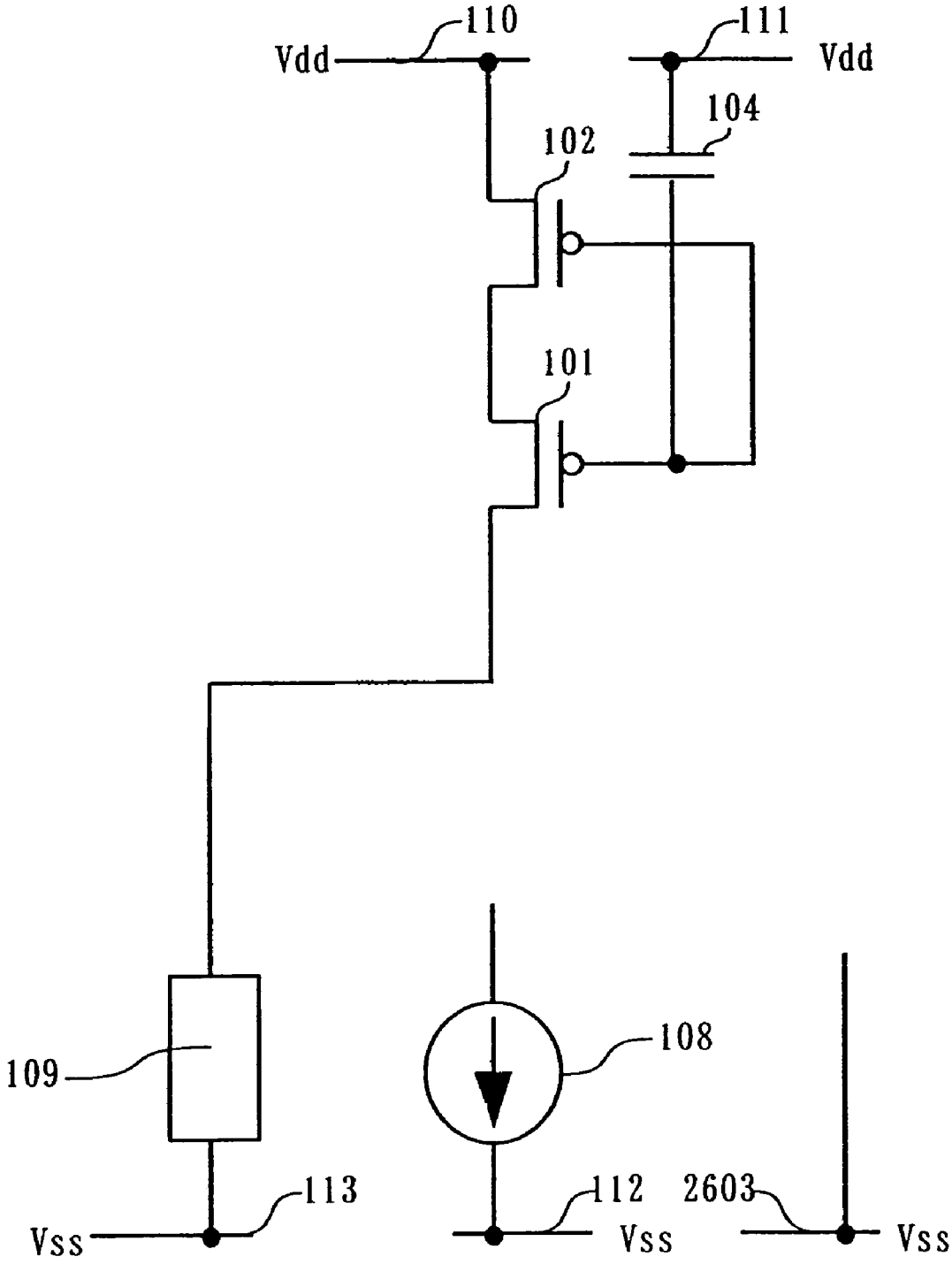
FIG. 30 is a diagram showing a connection state of the current source circuit of the invention.

For example, each switch may be disposed anywhere as long as it is connected as shown in FIG. 29 in the set operation and connected as shown in FIG. 30 in the output operation.

Figure 31:
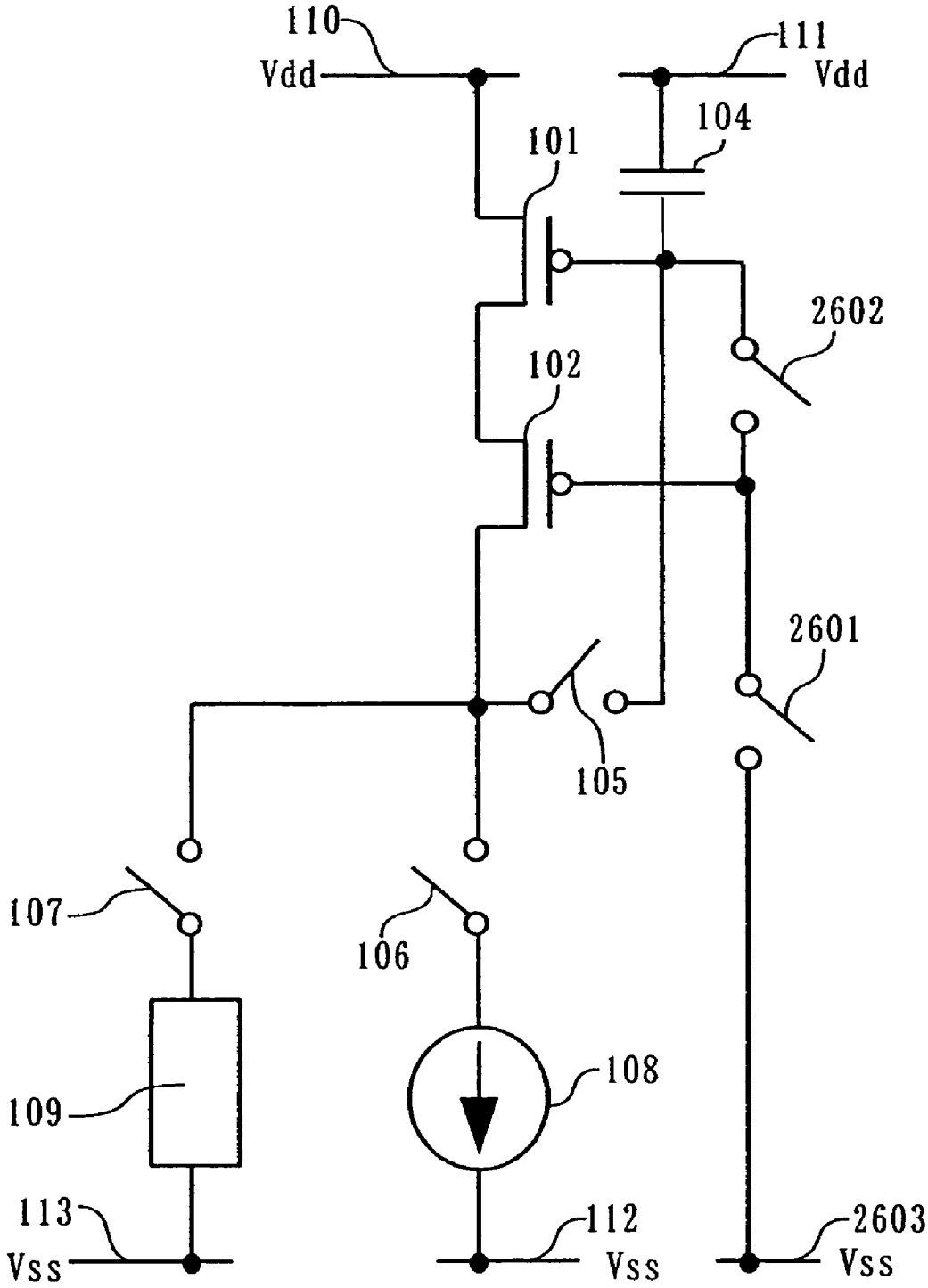
FIG. 31 is a diagram showing a configuration of the current source circuit of the invention.

Further, FIG. 31 shows the case where dispositions of the current source transistor 101 and the switching transistor 102 are interchanged. In FIG. 31, the wiring 110, the current source transistor 101, and the switching transistor 102 are disposed in this order.

Figure 32:
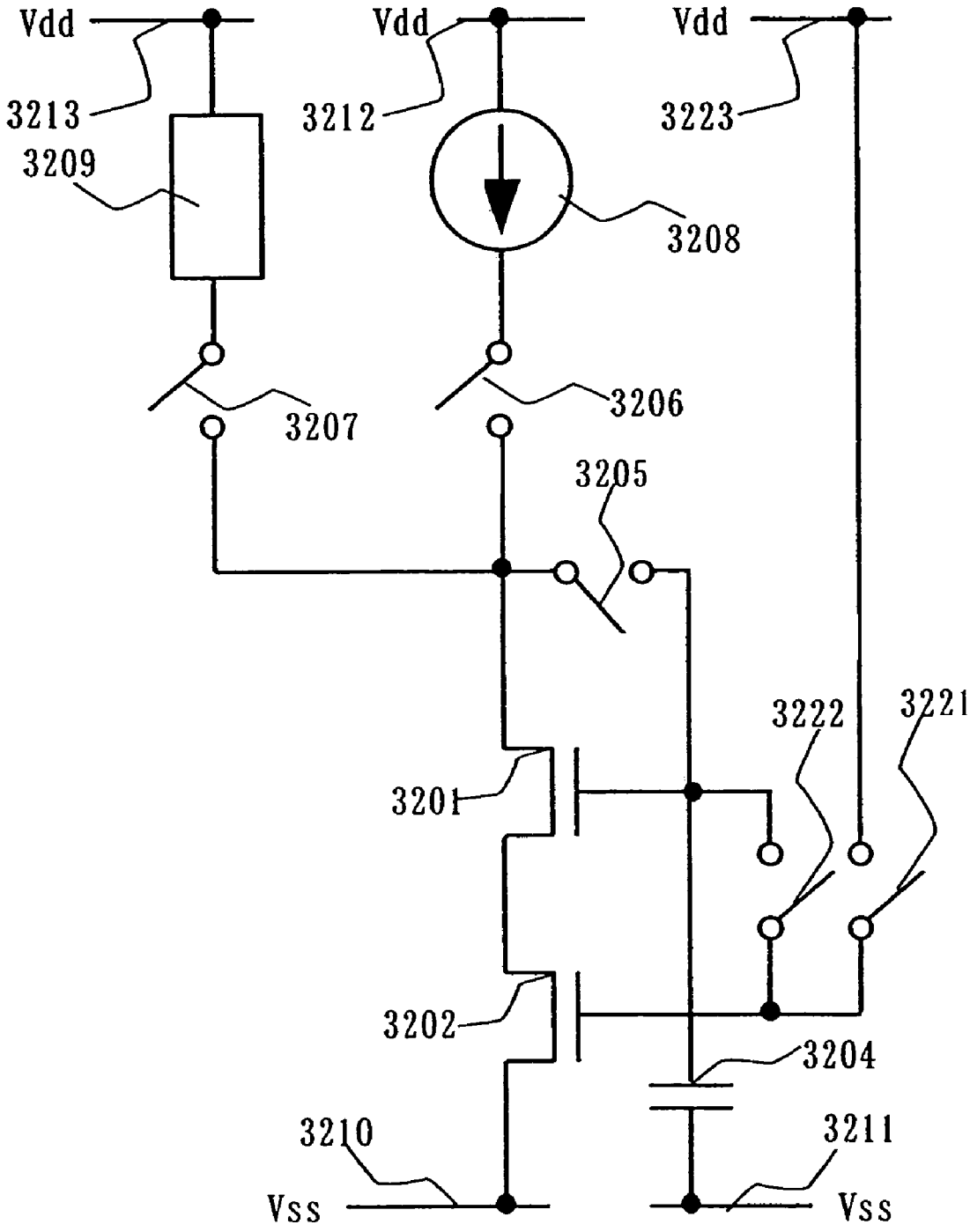
FIG. 32 is a diagram showing a configuration of the current source circuit of the invention.

FIG. 32 shows an example in the case where the polarity (conductivity) of the current source transistor 101 and the switching transistor 102 are changed and the connecting structure of the circuit is not changed in FIG. 26. When FIG. 26 and FIG. 32 are compared, it is clear that the change is easily done by changing potentials of the wirings 112, 113, 110, 111, and 2603 to the ones of wirings 3212, 3213, 3210, 3211, and 3223 and changing the direction of current of the basic current source 108. The connections of a current source transistor 3201, a switching transistor 3202, switches 3221, 3222, 3205, 3206, and 3207, a basic current source 3208, a load 3209 and the like are not changed. Note that the wiring 3210 and the wiring 3211 are different wirings, however, they may be electrically connected to each other. Note that the wiring 3212 and the wiring 3213 are different wirings, however, they may be electrically connected to each other.

Figure 33:
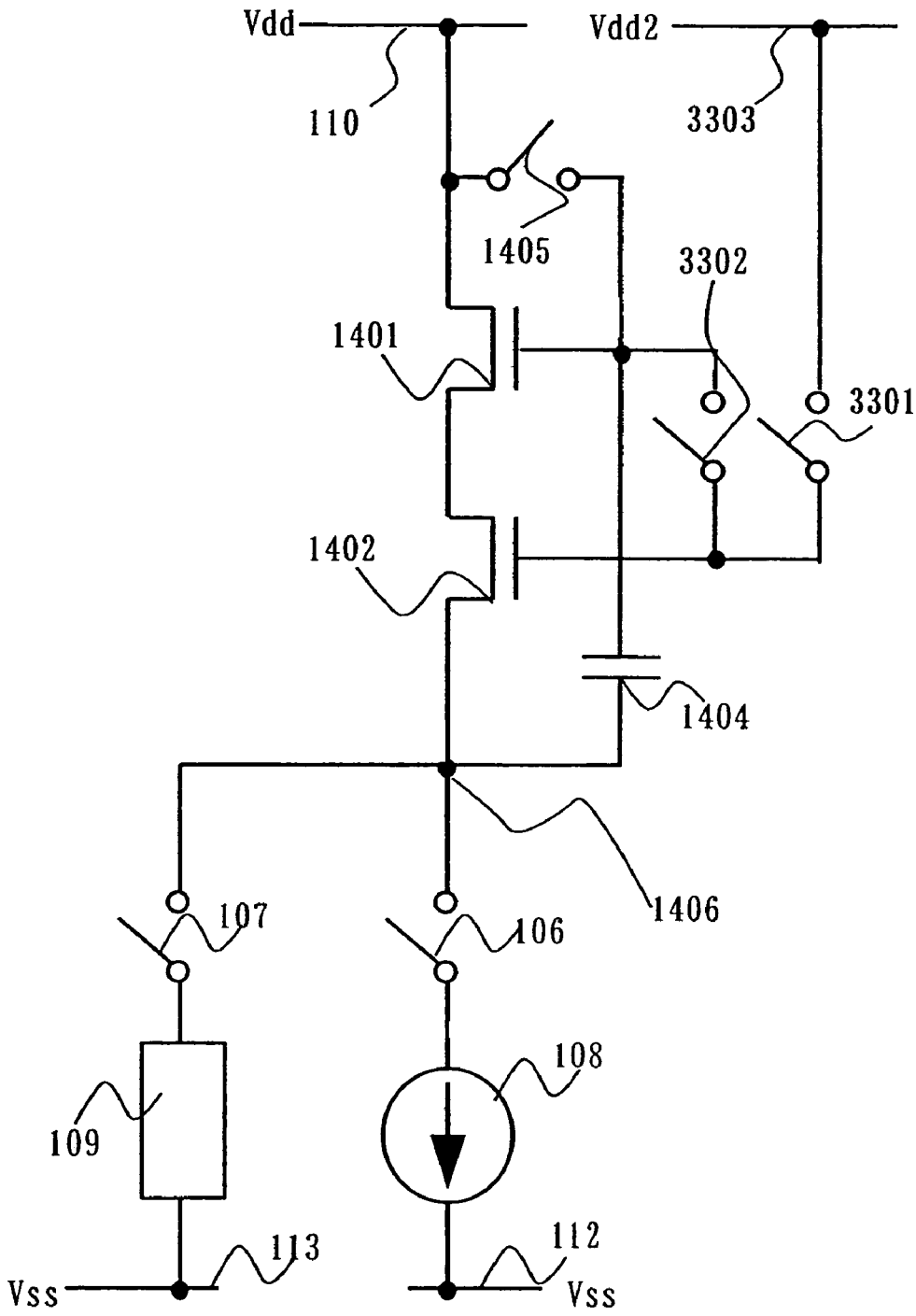
FIG. 33 is a diagram showing a configuration of the current source circuit of the invention.

Further, FIG. 33 shows an example in the case where the polarity (conductivity) of the current source transistor 101 and the switching transistor 102 are changed by changing the connecting structure of the circuit without changing the direction of current in the circuit of FIG. 26.

There are a current source transistor 1401 which constantly operates as a current source (or a part of it) and a switching transistor 1402 of which operation changes according to the circumstance. The current source transistor 1401, the switching transistor 1402, and the wiring 110 are connected in series. A gate terminal of the current source transistor 1401 is connected to one of the terminals of the capacitor 1404. The other terminal 1406 of the capacitor 1404 is connected to a source terminal of the switching transistor 1402 (the current source transistor 1401). Therefore, can be held a gate-source voltage of the current source transistor 1401. Further, the gate terminal and a drain terminal of the current source transistor 1401 are connected via a switch 1405. The capacitor 1404 can be controlled to hold a charge by ON/OFF of the switch 1405. Further, the gate terminal of the switching transistor 1401 and a wiring 3303 are connected via a switch 3301 of which ON/OFF controls the switching transistor 1402. Moreover, the gate terminal of the current source transistor 1401 and the gate terminal of the switching transistor 1402 are connected via a switch 3302.

Figure 34:
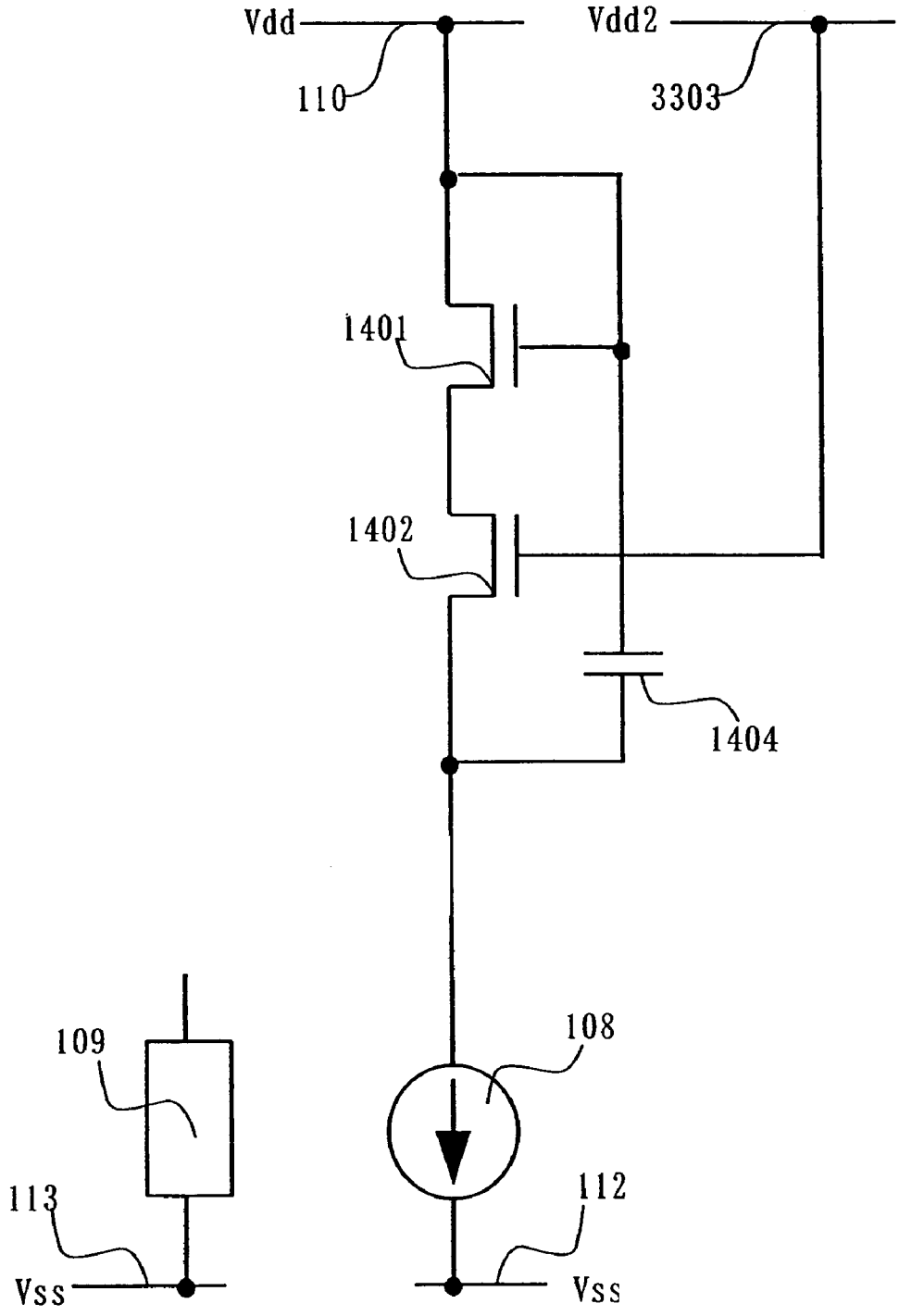
FIG. 34 is a diagram showing a connection state of the current source circuit of the invention.
Figure 35:
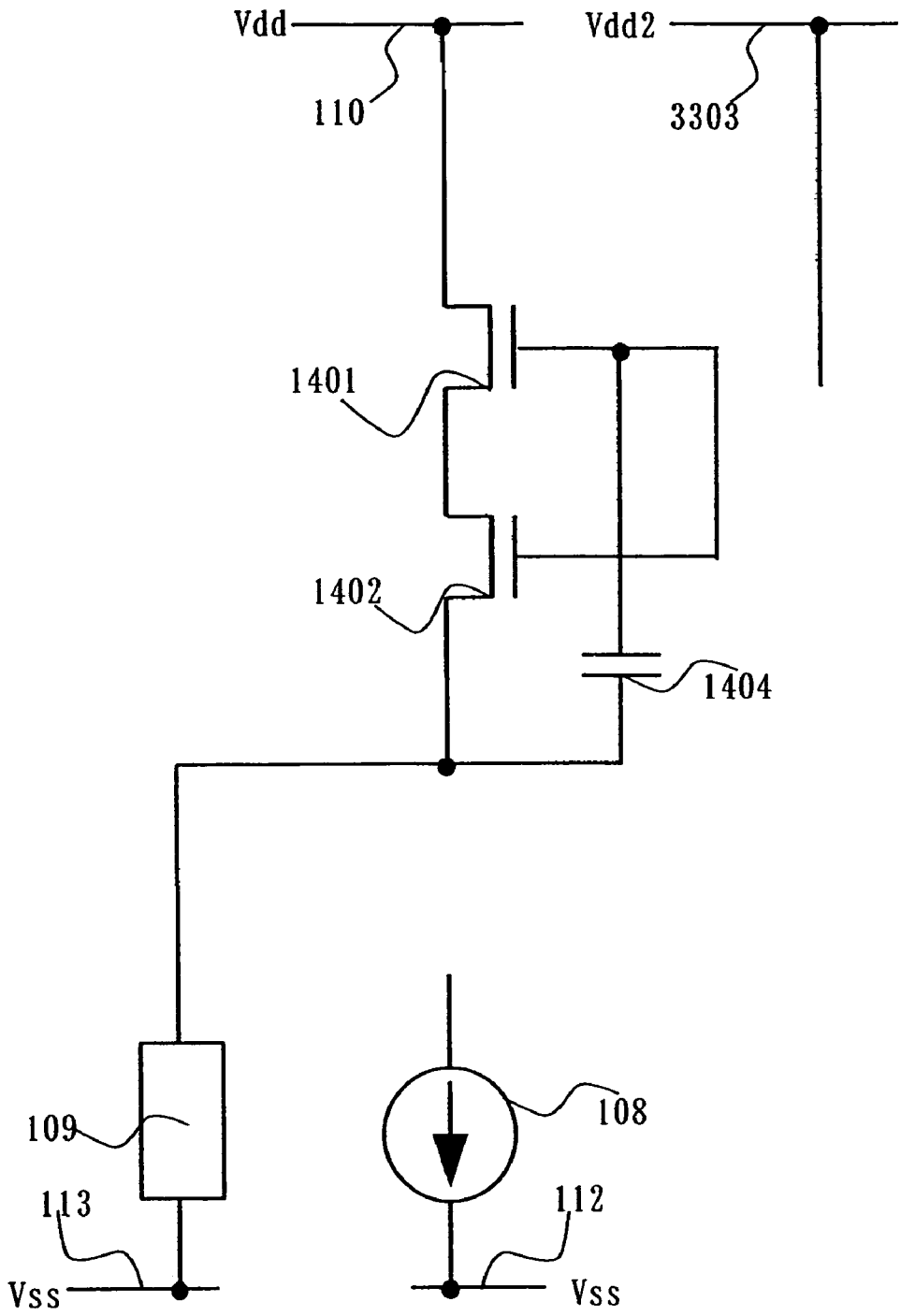
FIG. 35 is a diagram showing a connection state of the current source circuit of the invention.

In this case also, switches may be disposed anywhere as long as they are connected as shown in FIG. 34 in the set operation and connected as shown in FIG. 35 in the output operation.

The wiring 3303 is supplied with Vdd2 which is higher than Vdd. The invention is not limited to this, however, it is preferable to supply as high potential as possible so that a current drive capacity becomes large when the switching transistor 1402 performs the short-circuit operation.

In this manner, by changing the arrangement and the number of switches, polarity of each transistor, the number and the arrangement of the current source transistor, the number and the arrangement of the switching transistor, a potential of each wiring, a direction of current flow and the like, various circuits as well as the circuit of FIG. 26 can be employed for constituting the present invention. Further, by combining each change also, the present invention can be constituted by using further various circuits.

The content described in this embodiment mode corresponds to Embodiment Mode 1 of which content is partially modified. Therefore, the content described in Embodiment Mode 1 can be applied to this embodiment mode as well.

Embodiment Mode 3

Described in this embodiment mode is the case where the circuits described in Embodiment Modes 1 and 2 are changed partially.

The case where the circuit of FIG. 1 is changed partially is described here for simplicity. Therefore, most of the description which is similar to Embodiment Mode 1 will be omitted here. However, it can be applied to various circuits described in Embodiment Modes 1 and 2.

Figure 36:
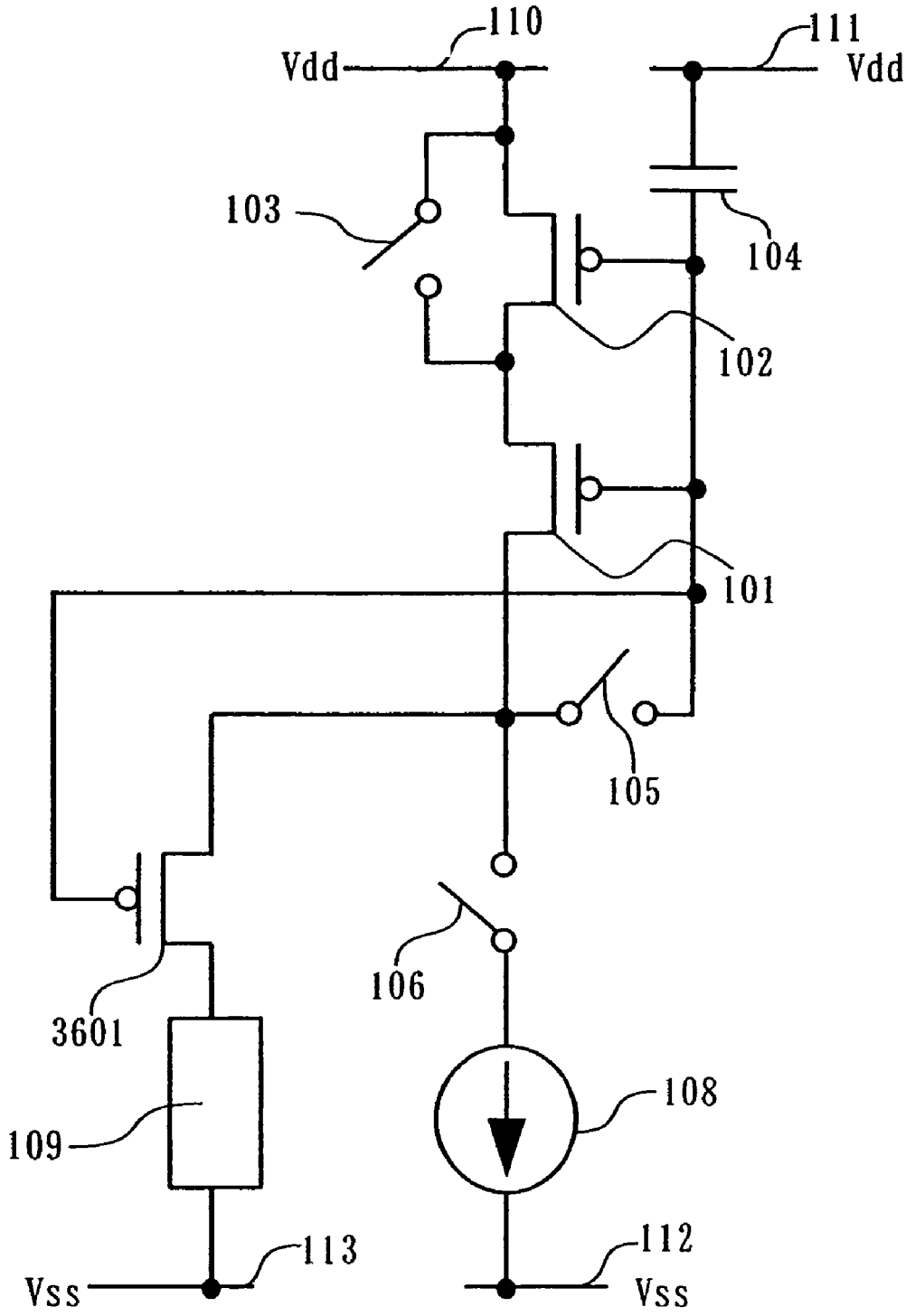
FIG. 36 is a diagram showing a configuration of the current source circuit of the invention.

First, FIG. 36 shows FIG. 1 of which configuration is changed partially. FIG. 36 is different from FIG. 1 in the respect that the switch 107 in FIG. 1 is changed to a multi transistor 3601. The multi transistor 3601 is a transistor having the same polarity (conductivity) as the current source transistor 101 and the switching transistor 102. A gate terminal of the multi transistor 3601 is connected to a gate terminal of the current source transistor 101. The multi transistor 3601 changes its operation according to the circumstance. That is, it operates as a switch in the set operation and as a current source in the output operation as a part of a multi-gate transistor together with the current source transistor 101 and the switching transistor 102.

Figure 37:
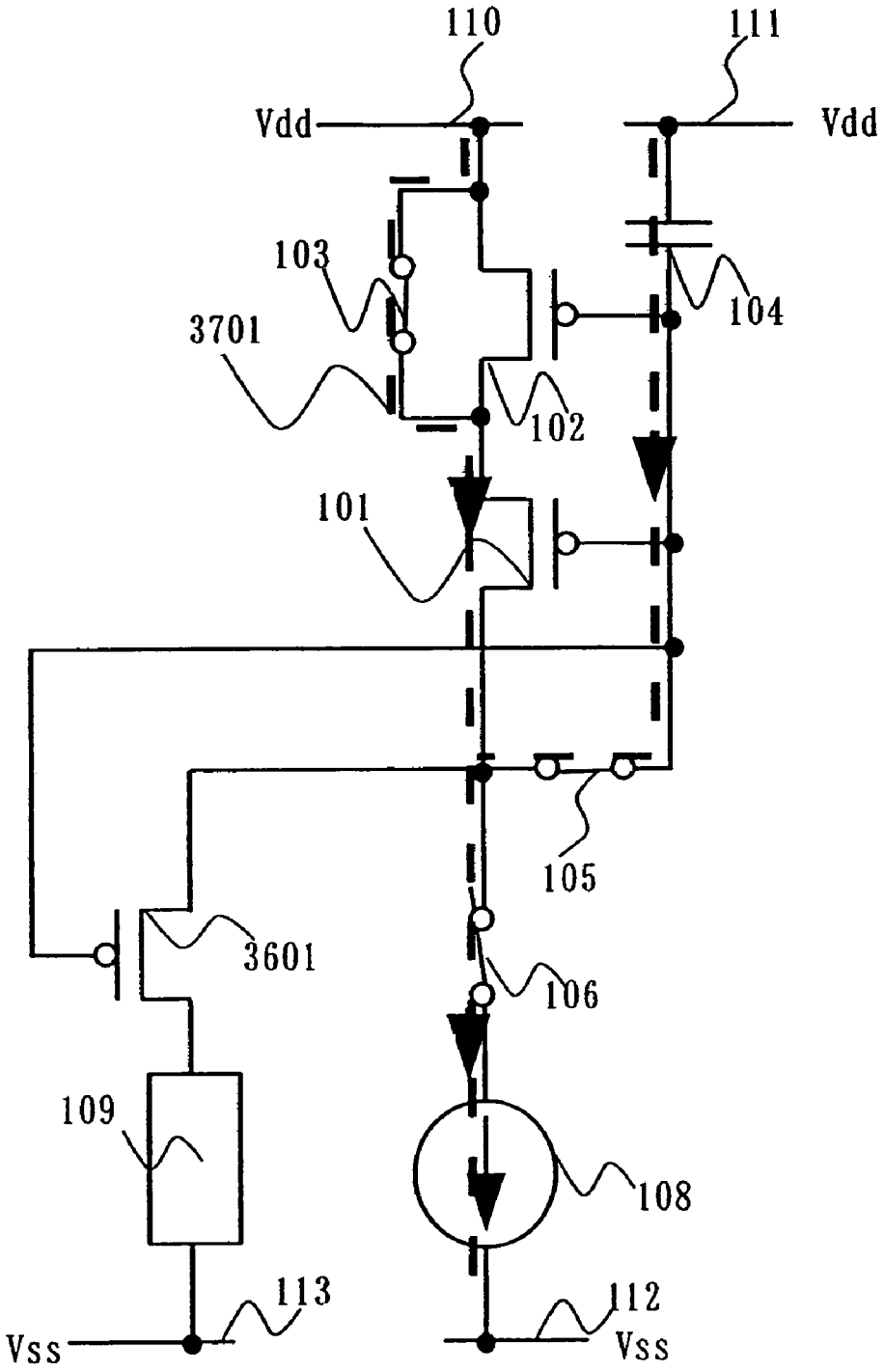
FIG. 37 is a diagram showing an operation of the current source circuit of the invention.

An operation of the circuit of FIG. 36 is described. First, the switches 103, 105, and 106 are turned ON as shown in FIG. 37. Then, the current Ib flowing in the basic current source 108 flows to the capacitor 104 and the current source transistor 101. A current path at that time is shown by a dashed arrow 3701. At this time, a gate terminal and a source terminal of the multi transistor 3601 have approximately the same potentials. That is, a gate-source voltage of the multi transistor 3601 becomes approximately 0 V. Therefore, the multi transistor 3601 is turned OFF. Then, a stationary state is obtained in which a current flowing between the source and drain of the current source transistor 101 and the current Ib flowing in the basic current source 108 become equal and a current stops flowing to the capacitor 104. The aforementioned operation corresponds to the set operation. At this time, the multi transistor 3601 operates as a switch in the OFF state.

Figure 38:
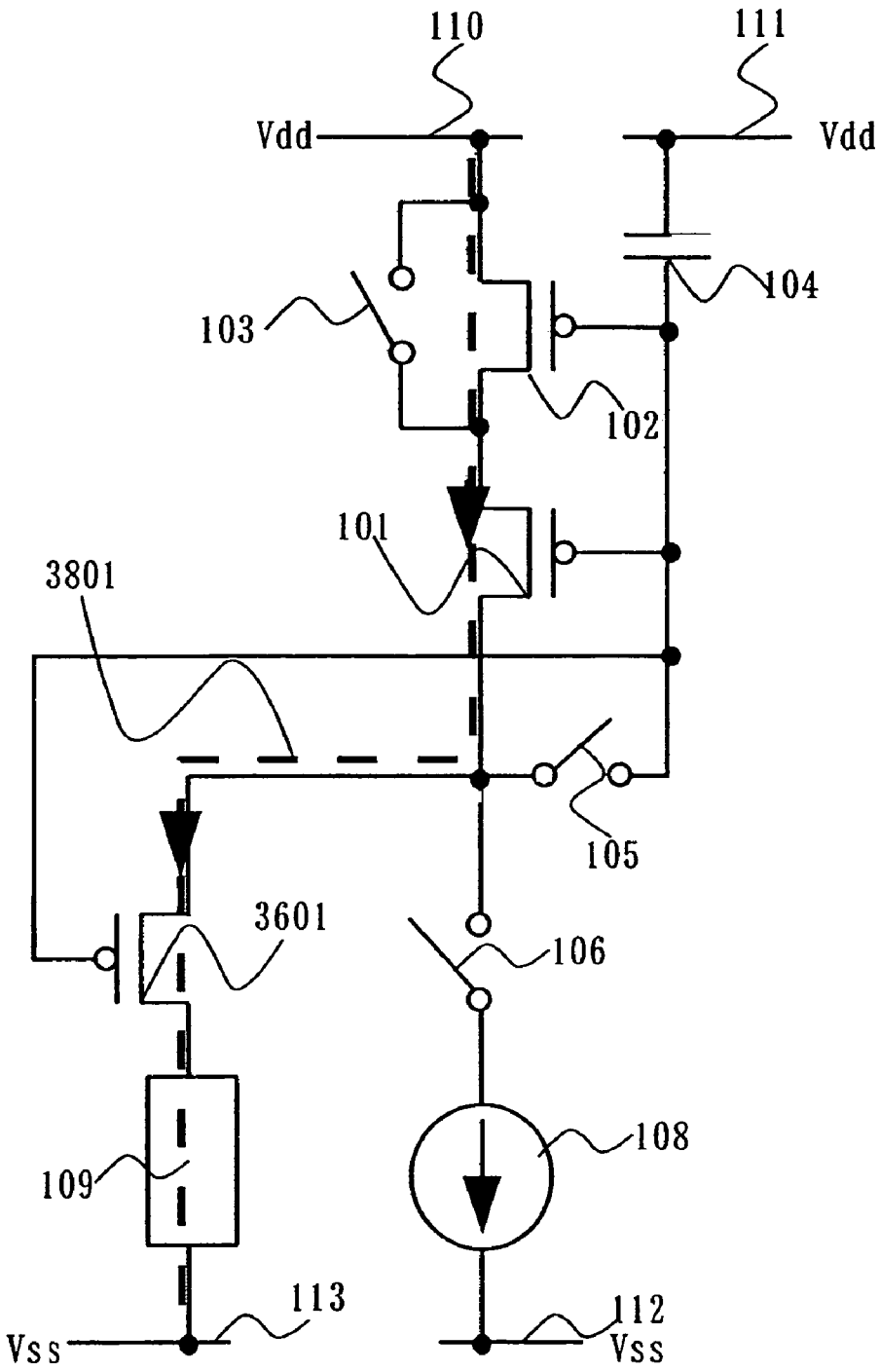
FIG. 38 is a diagram showing an operation of the current source circuit of the invention.

Next, the switches 103, 105 and 106 are turned OFF as shown in FIG. 38. A charge accumulated in the set operation is stored in the capacitor 104 and it is applied to the gate terminals of the current source transistor 101, the switching transistor 102, and the multi transistor 3601. The gate terminals of the current source transistor 101, the switching transistor 102, and the multi transistor 3601 are connected to each other. A current path at that time is shown by a dashed arrow 3801. As described above, the current source transistor 101, the switching transistor 102, and the multi transistor 3601 operate as a multi-gate transistor. Therefore, assuming that the current source transistor 101, the switching transistor 102, and the multi transistor 3601 are one transistor, a gate length L of the transistor is longer than L of the current source transistor 101. Therefore, a current flowing to the load 109 is smaller than Ib. That is, the current flowing to the load 109 becomes smaller than the case of FIG. 1. The aforementioned operation corresponds to the output operation. At that time, the multi transistor 3601 operates as a part of a multi-gate transistor.

In this manner, by changing the switch 107 in FIG. 1 to the multi transistor 3601 in FIG. 36 and connecting the gate terminal of the multi transistor 3601 with the gate terminal of the current source transistor 101, current can be automatically controlled and the current flowing to the load 109 can be made small. In the case of FIG. 1, operations are switched such that a current flows to the load 109 in the output operation and does not flow in the set operation, therefore, a wiring for controlling the switch 107 is required. In the case of FIG. 36, however, as operations can be switched automatically, the wiring for controlling can be omitted.

Note that the current source transistor 101, the switching transistor 102 and the multi transistor 3601 operate as a multi-gate transistor in the output operation, therefore, these transistors preferably have the same polarity (have the same conductivity).

Note that the current source transistor 101, the switching transistor 102 and the multi transistor 3601 operate as a multi-gate transistor in the output operation, however, a gate width W of each transistor may be either the same or different. Similarly, the gate length L may be either the same or different. However, the gate width W is preferably the same as the gate width W can be considered to be the same as a typical multi-gate transistor. As the gate length L of the switching transistor 102 or the multi transistor 3601 becomes longer, a current flowing to the load 109 becomes smaller. Therefore, appropriate design may be carried out according to the circumstance.

Note that FIG. 36 is shown as a circuit of present embodiment mode, however, the invention is not limited to this configuration. By changing the arrangement and the number of switches, polarity of each transistor, the number and the arrangement of the current source transistor 101, the number and the arrangement of the switching transistor 102, the number and the arrangement of the multi transistor 3601, a potential of each wiring, a direction of current flow and the like, various circuits can be employed in the configuration. Further, by combining each change also, a configuration using various circuits can be achieved.

Figure 39:
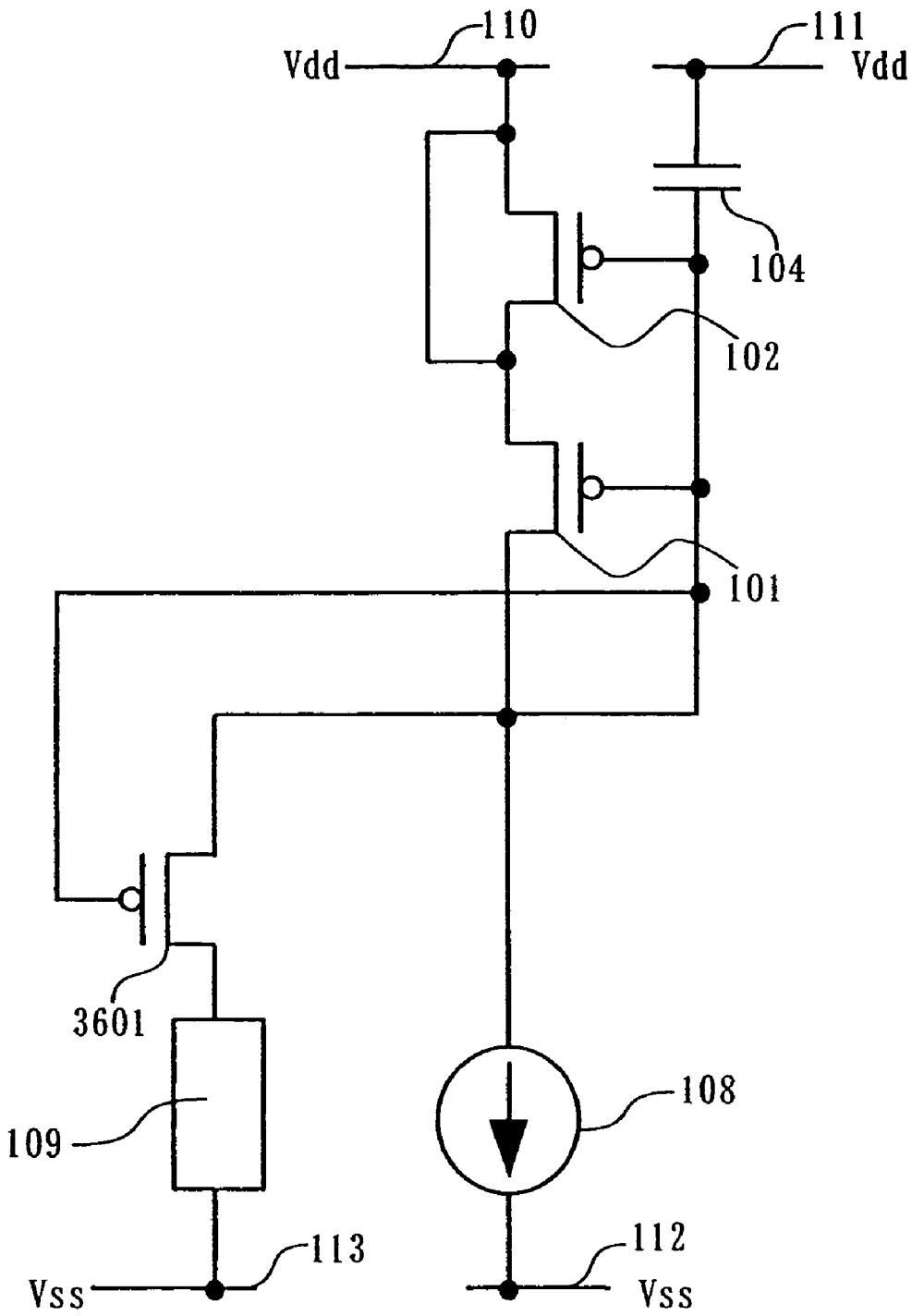
FIG. 39 is a diagram showing a connection state of the current source circuit of the invention.
Figure 40:
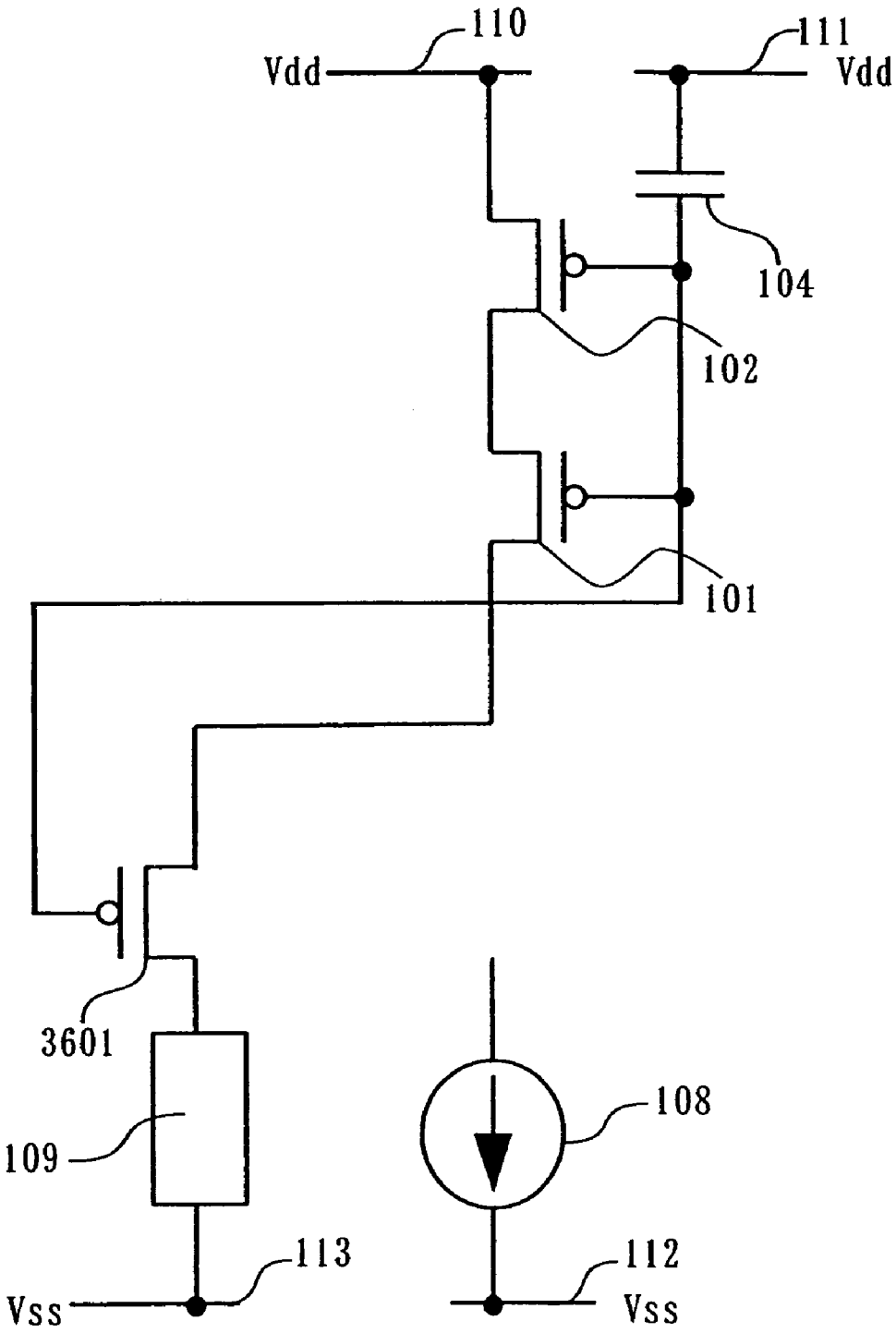
FIG. 40 is a diagram showing a connection state of the current source circuit of the invention.

For example, such a switch as 103, 105, and 106 may be disposed anywhere as long as it can control ON/OFF of a target current. That is, the switches may be disposed anywhere as long as they are connected as shown in FIG. 39 in the set operation and connected as shown in FIG. 40 in the output operation.

The content described in this embodiment mode corresponds to Embodiment Mode 1 of which content is partially modified. Therefore, the content described in this embodiment mode can be applied to Embodiment Modes 1 and 2 as well.

Embodiment Mode 4

In this embodiment mode, a display device, and a configuration and an operation of a signal line driver circuit and the like are described. The circuit of the invention can be applied to a portion of the signal line driver circuit or to a pixel.

Figure 41:
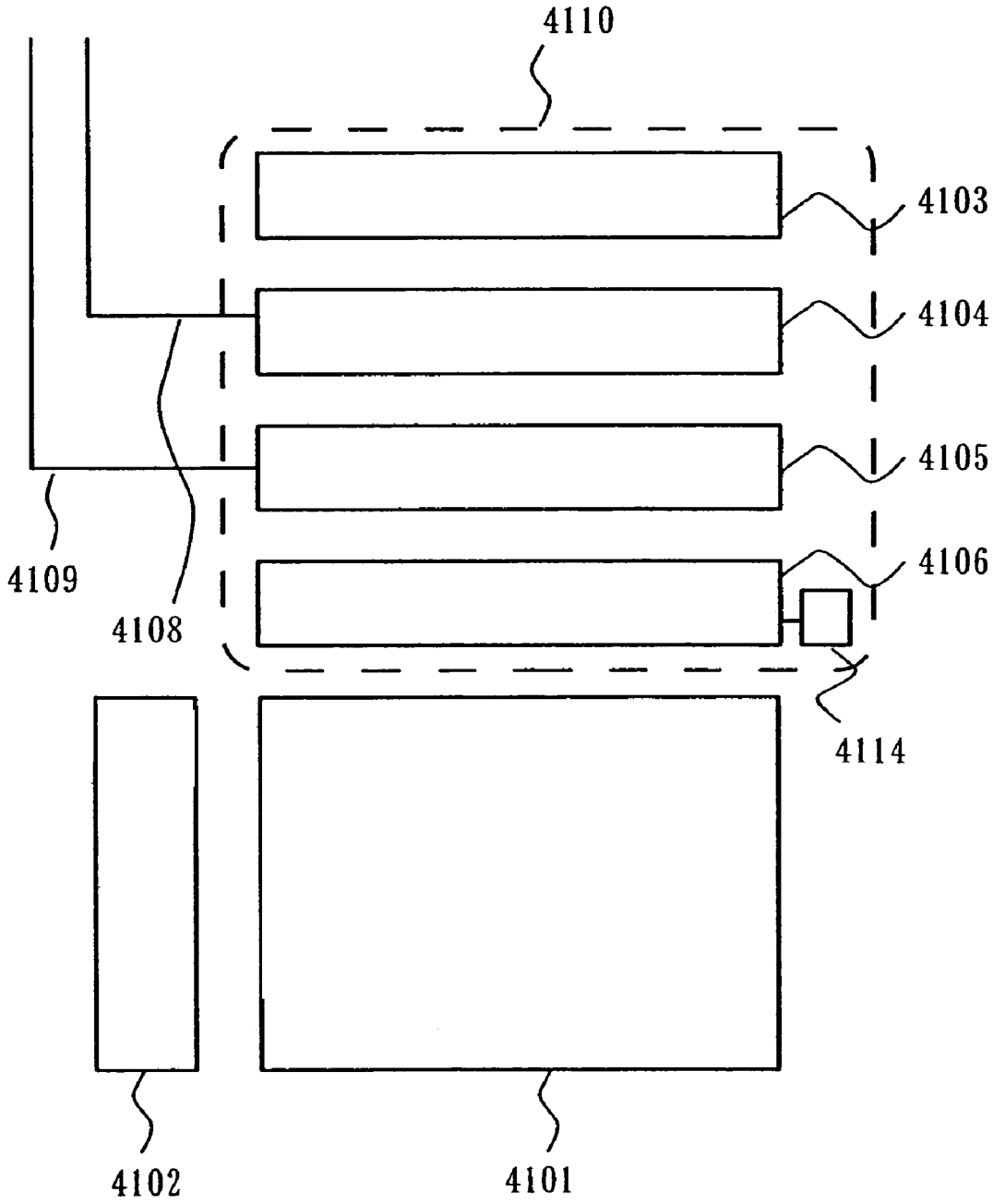
FIG. 41 is a diagram showing a configuration of the display device of the invention.

FIG. 41 shows a display device comprises a pixel arrangement 4101, a gate line driver circuit 4102, and a signal line driver circuit 4110. The gate line driver circuit 4102 sequentially outputs a select signal to the pixel arrangement 4101. The signal line driver circuit 4110 sequentially outputs a video signal to the pixel arrangement 4101. In the pixel arrangement 4101, an image is displayed by controlling the state of light according to a video signal. The video signal inputted from the signal line driver circuit 4110 to the pixel arrangement 4101 is a current. That is, a display element and an element for controlling the display element arranged in each pixel change their states according to the video signal (current) inputted from the signal line driver circuit 4110. Examples of the display element disposed in the pixel include an EL element, an element used in an FED (Field Emission Display) and the like.

Note that a plurality of the gate line driver circuits 4102 and the signal line driver circuits 4110 may be disposed.

A configuration of the signal line driver circuit 4110 can be divided into a plurality of portions. As an example, it can be roughly divided into a shift register 4103, a first latch circuit (LAT1) 4104, a second latch circuit (LAT2) 4105, and a digital-analog converter circuit 4106. The digital-analog converter circuit 4106 comprises a function to convert a voltage into a current, and it may also comprise a function to provide a gamma correction. That is, the digital-analog converter circuit 4106 comprises a circuit for outputting a current (a video signal) to the pixel, that is a current source circuit to which the invention can be applied.

Further, the pixel comprises a display element such as an EL element. A circuit for outputting a current (a video signal) to the display element, that is a current source circuit is provided as well, to which the invention can also be applied.

An operation of the signal line driver circuit 4110 is described briefly. The shift register 4103 is formed by using a plurality of columns of flip-flop circuits (FF) or the like and inputted with a clock signal (S-CLK), a start pulse (SP), and an inverted clock signal (S-CLKb). Sampling pulses are outputted in accordance to the timing of these signals.

The sampling pulses outputted from the shift register 4103 are inputted to the first latch circuit (LAT1) 4104. The first latch circuit (LAT1) 4104 is inputted with a video signal from the video signal line 4108 and holds a video signal in each column in accordance with the timing at which the sampling pulses are inputted. In the case where the digital-analog converter circuit 4106 is disposed, the video signal has a digital value. Further, the video signal in this phase is a voltage in many cases.

However, in the case where the first latch circuit 4104 and the second latch circuit 4105 are circuits which can store analog values, the digital-analog converter circuit 4106 can be omitted in many cases. It is often the case that the video signal is a current in that case. Further, in the case where data outputted to the pixel arrangement 4101 has a binary value, that is a digital value, the digital-analog converter circuit 4106 can be omitted in many cases.

When the retainment of the video signals up to the last column is completed in the first latch circuit (LAT1) 4104, a latch pulse is inputted from a latch control line 4109 in a horizontal retrace period and the video signals held in the first latch circuit (LAT1) 4104 are transferred to the second latch circuit (LAT2) 4105 all at once. After that, the video signals held in the second latch circuit (LAT2) 4105 are inputted to the digital-analog converter circuit 4106 one row at a time. Then, a signal outputted from the digital-analog converter circuit 4106 is inputted to the pixel arrangement 4101.

While the video signal held in the second latch circuit (LAT2) 4105 is inputted to the digital-analog converter circuit 4106 and inputted to the pixel 4101, a sampling pulse is outputted from the shift register 4103 again. That is, two operations are performed at the same time. Thus, a line sequential drive can be performed. This operation is repeated hereafter.

Provided that a current source circuit in the digital-analog converter circuit 4106 is a circuit which performs the set operation and the output operation, a circuit to flow a current to the current source circuit is required. In that case, a reference current source circuit 4114 is disposed.

In some cases, the signal line driver circuit and a part of it are not over the same substrate as the pixel arrangement 4104, but formed by using an external IC chip, for example. In that case, the IC chip and the substrate are connected by using COG (Chip On Glass), TAB (Tape Auto Bonding), a printed substrate and the like.

Note that a configuration of the signal line driver circuit and the like is not limited to FIG. 41.

Figure 42:
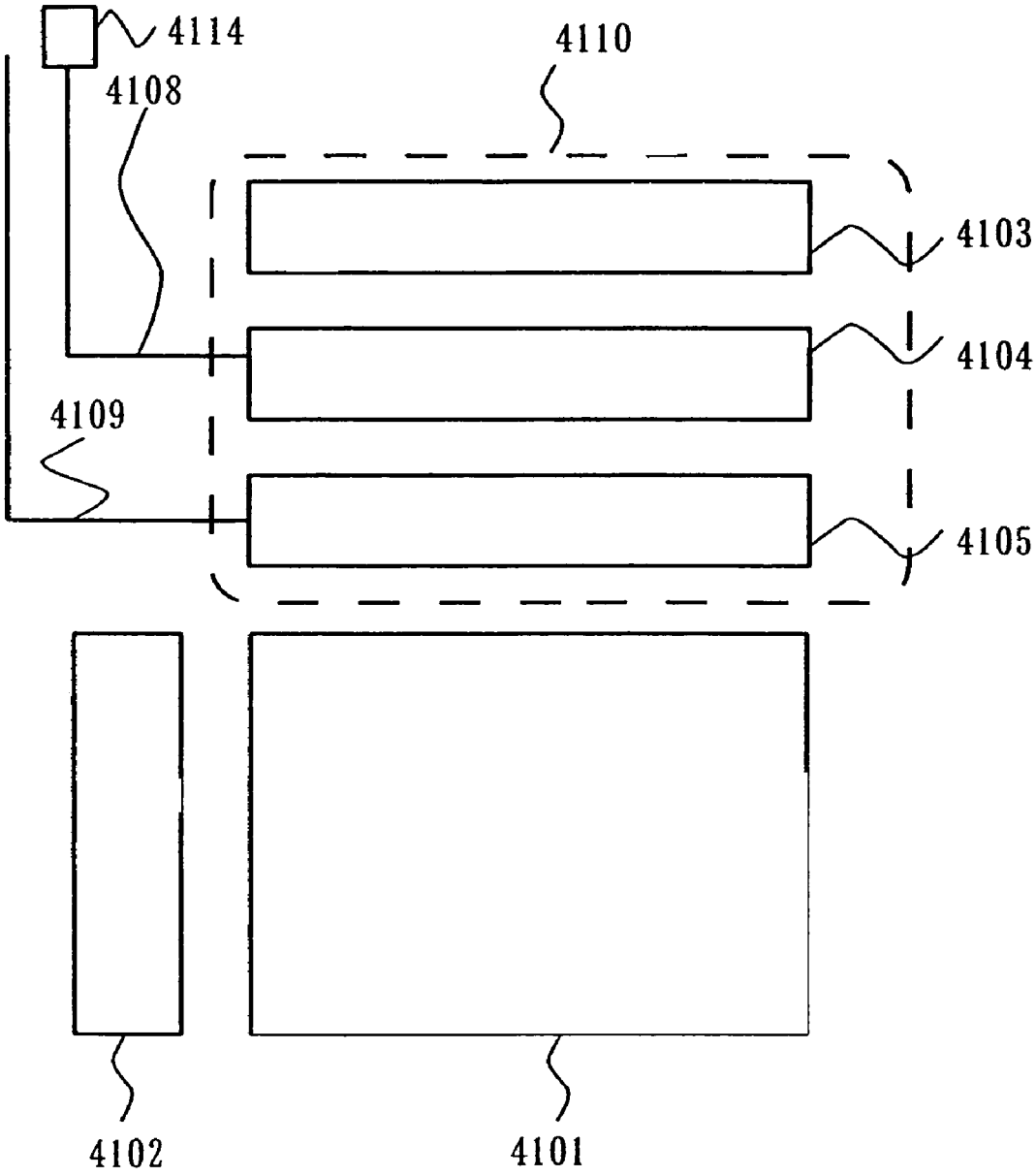
FIG. 42 is a diagram showing a configuration of the display device of the invention.

For example, in the case where the first latch circuit 4104 and the second latch circuit 4105 can store analog values, a video signal (analog current) is inputted to the first latch circuit (LAT1) 4104 from the reference current source circuit 4114 as shown in FIG. 42 in some cases. Also, the second latch circuit 4105 is not provided in FIG. 42 in some cases.

Embodiment Mode 5

A specific configuration of the signal line driver circuit 4110 described in Embodiment Mode 4 is described now.

Figure 43:
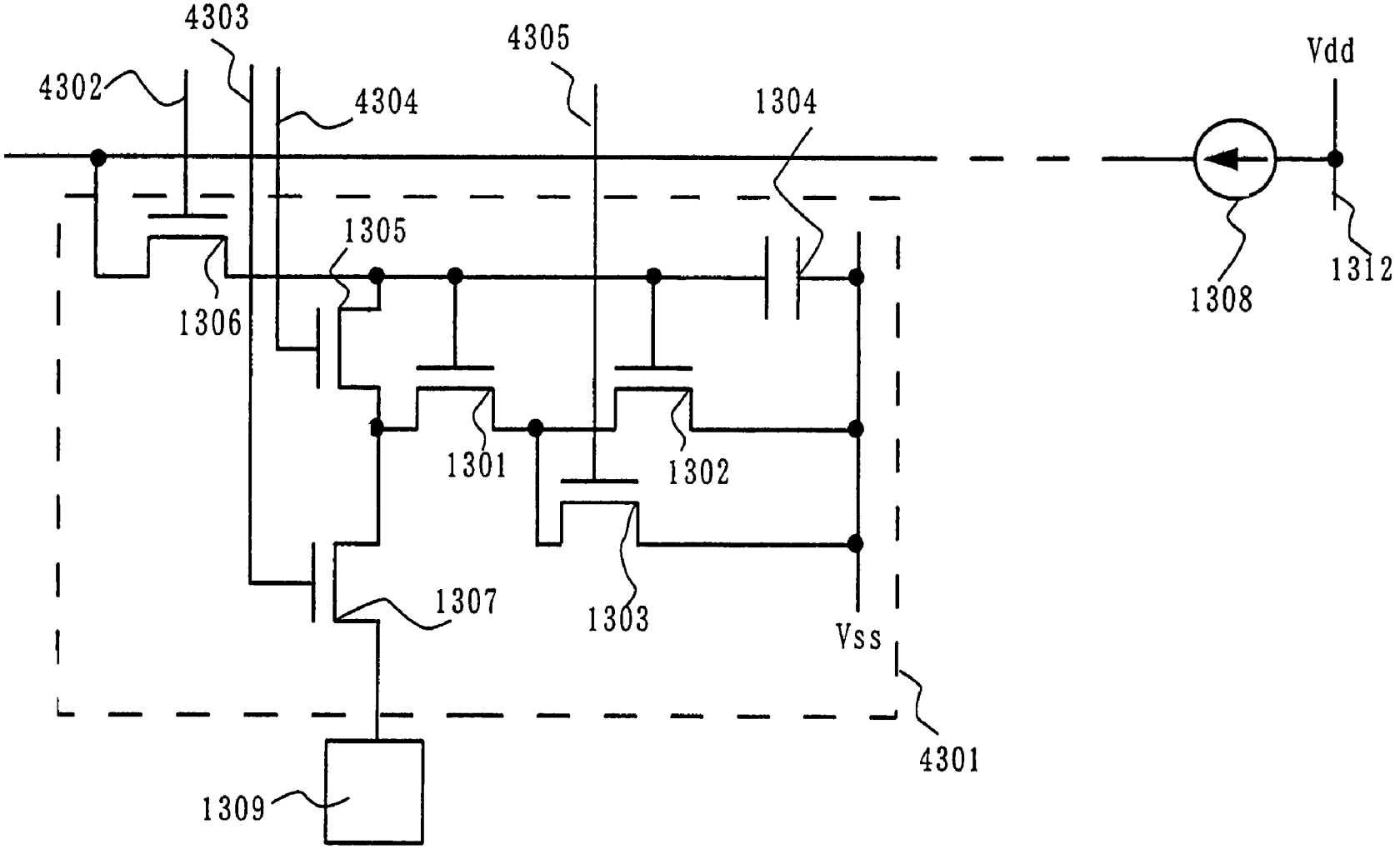
FIG. 43 is a diagram showing a configuration of the current source circuit of the invention.

First, FIG. 43 shows an example in the case of applying the invention to a signal line driver circuit. The current source circuit 4301 switches between the set operation and the output operation, and between the short-circuit operation and the current source operation by wirings 4302, 4303, 4304, and 4305. A current is inputted from the basic current source 1308 in the set operation. In the output operation, a current is outputted from the current source circuit 4301 to the load 1309.

First, the case of FIG. 41 is described. A current source in the reference current source circuit 4114 corresponds to the basic current source 1308 in FIG. 43. The load 1309 in FIG. 43 corresponds to a switch, a signal line 4902, or a pixel connected to the signal line 4902. A constant current is outputted from the basic current source 1308. In the configuration of FIG. 43, the output operation cannot be performed at the same time with the set operation. Therefore, when they are required to be performed at the same time, it is preferable to provide two or more current source circuits and change over them. That is, the set operation is performed to one current source circuit while the output operation is performed to the other current source circuit at the same time, and this is switched at an arbitrary cycle. Thus, the set operation and the output operation can be performed at the same time.

Figure 44:
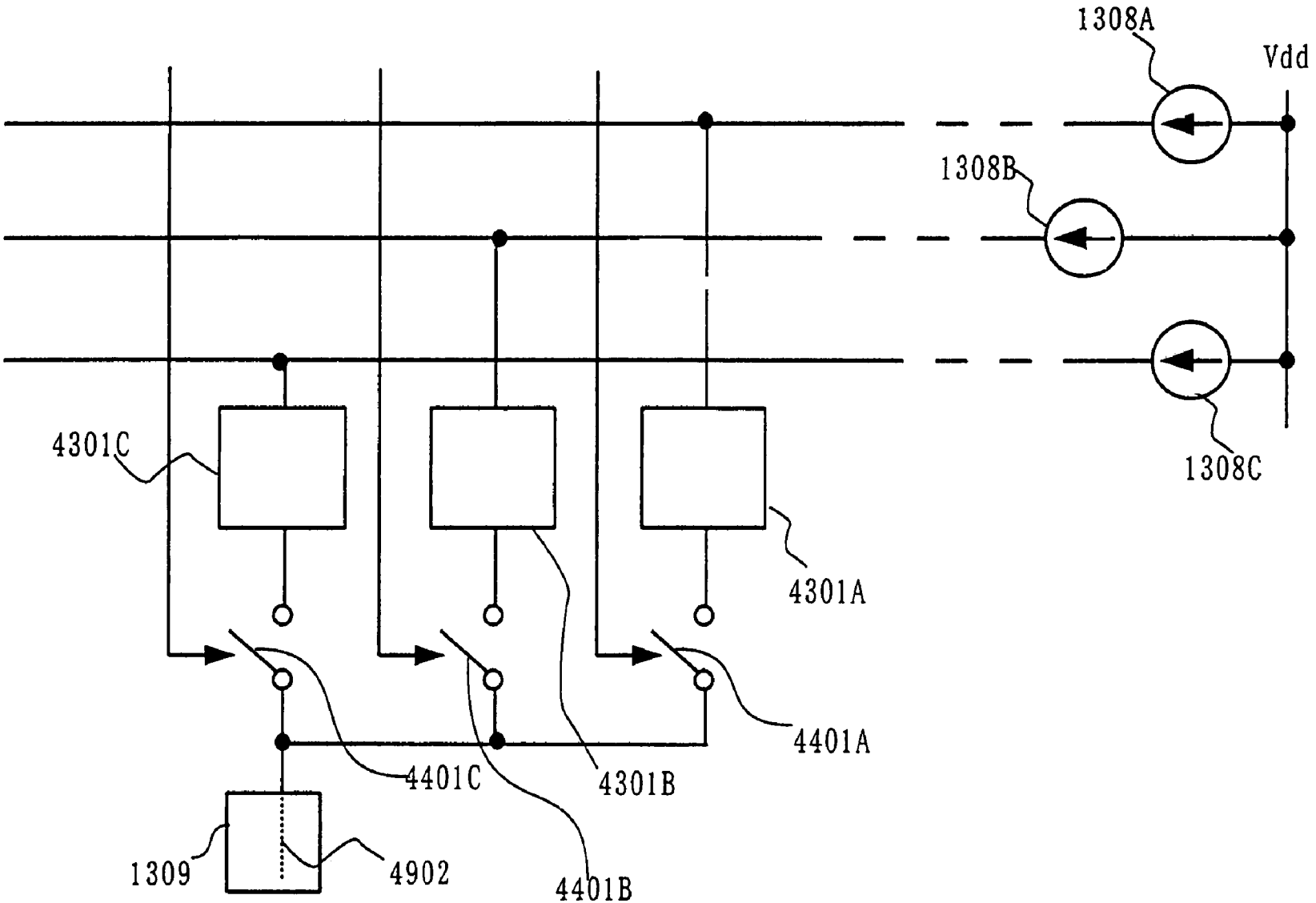
FIG. 44 is a diagram showing a configuration of the current source circuit of the invention.

Further, in the case where an analog current is outputted to a pixel as a video signal, a configuration shown in FIG. 44 is employed since a digital value is required to be converted into an analog value. In FIG. 44, the case of 3 bit is described for simplicity. That is, there are basic current supplies 1308A, 1308B, and 1308C of which current values are Ic, 2*Ic, and 4*Ic respectively, to which each current source circuit 4301A, 4301B, and 4301C is connected. Therefore, the current source circuits 4301A, 4301B, and 4301C output current of Ic, 2*Ic, and 4*Ic in the output operation. Switches 4401A, 4401B, and 4401C are connected in series to each current source circuit. These switches are controlled by a video signal outputted from the second latch circuit (LAT2) 4105. A sum of the current outputted from each current source circuit and switch is outputted to the load 1309, that is the signal line 4902. By operating as described above, an analog current is outputted to the pixel as a video signal.

The case of 3 bit is described in FIG. 44 for simplicity, however, the invention is not limited to this. By configuring similarly, the number of bits can be changed easily. In the case of the configuration of FIG. 44 also, the output operation can be performed at the same time while the set operation is performed by disposing the current source circuits in parallel and operating them by changing over them.

In the case of performing the set operation respectively to the current source circuit, the timing thereof is required to be controlled. In that case, a dedicated driver circuit (a shift register and the like) may be disposed for controlling the set operation. Alternatively, the set operation to the current source circuit may be controlled by using a signal outputted from the shift register for controlling the LAT1 circuit. That is, both of the LAT1 circuit and the current source circuit may be controlled by one shift register. In that case, a signal outputted from the shift register for controlling the LAT1 circuit may be inputted to the current source circuit directly, or in order to separate the control of the LAT1 circuit and the control of the current source circuit, the current source circuit may be controlled via a circuit for controlling the separation. The set operation to the current source circuit may be controlled by using a signal outputted from the LAT2 circuit as well. The signal outputted from the LAT2 circuit is typically a video signal. Therefore, in order to separate the case of using as a video signal and the case of controlling the current source circuit, the current source circuit may be controlled via a circuit for controlling the separation. In this manner, a circuit configuration for controlling the set operation and the output operation, an operation of the circuit and the like are described in International Publication WO03/038793, International Publication WO03/038794, and International Publication WO03/038795, of which contents can be applied to the invention.

The case of FIG. 42 is described now. A current source in the reference current source circuit 4114 corresponds to the basic current source 1308 in FIG. 43. The load 1309 in FIG. 43 corresponds to a current source circuit disposed in the second latch circuit (LAT2) 4105. In this case, a video signal is outputted as a current from the current source in the reference current source circuit 4114. Note that the current may have a digital value or an analog value.

Note that a digital video signal (current value) corresponding to each bit may be inputted to the first latch circuit 4104. By adding together the digital video signal current corresponding to each bit, a digital value can be converted into an analog value. In that case, it is more preferable to apply the invention to the case of inputting a signal of a bit of a small digit number because a current value of a signal becomes small. In view of this, the current value of the signal can be large by applying the invention. Thus, a write speed of a signal is increased. It should be noted in FIG. 42 that two or more current source circuits may be disposed in parallel in the first latch circuit 4104 and used by changing over them in the case where the second latch circuit 4105 is not provided. Accordingly, the set operation and the output operation can be performed at the same time, which allows the second latch circuit 4105 to be omitted. A configuration and an operation of such a circuit are described in International Publication WO03/038796 and International Publication WO03/038797, of which contents can be applied to the invention.

It may also be considered that the current source circuit disposed in the first latch circuit 4104 corresponds to the basic current source 1308 in FIG. 43 and the current source circuit disposed in the second latch circuit 4105 corresponds to the load 1309 in FIG. 43.

Furthermore, it can be applied to the reference current source circuit 4114 shown in FIGS. 41 and 42. That is, the reference current source circuit 4114 corresponds to the load 1309 in FIG. 43 and another current source corresponds to the basic current source 1308 in FIG. 43.

It may also be considered that the pixel corresponds to the load 1309 in FIG. 43 and the current source circuit for outputting a current to the pixel in the signal line driver circuit 4110 corresponds to the basic current source 1308 in FIG. 43.

Figure 24:
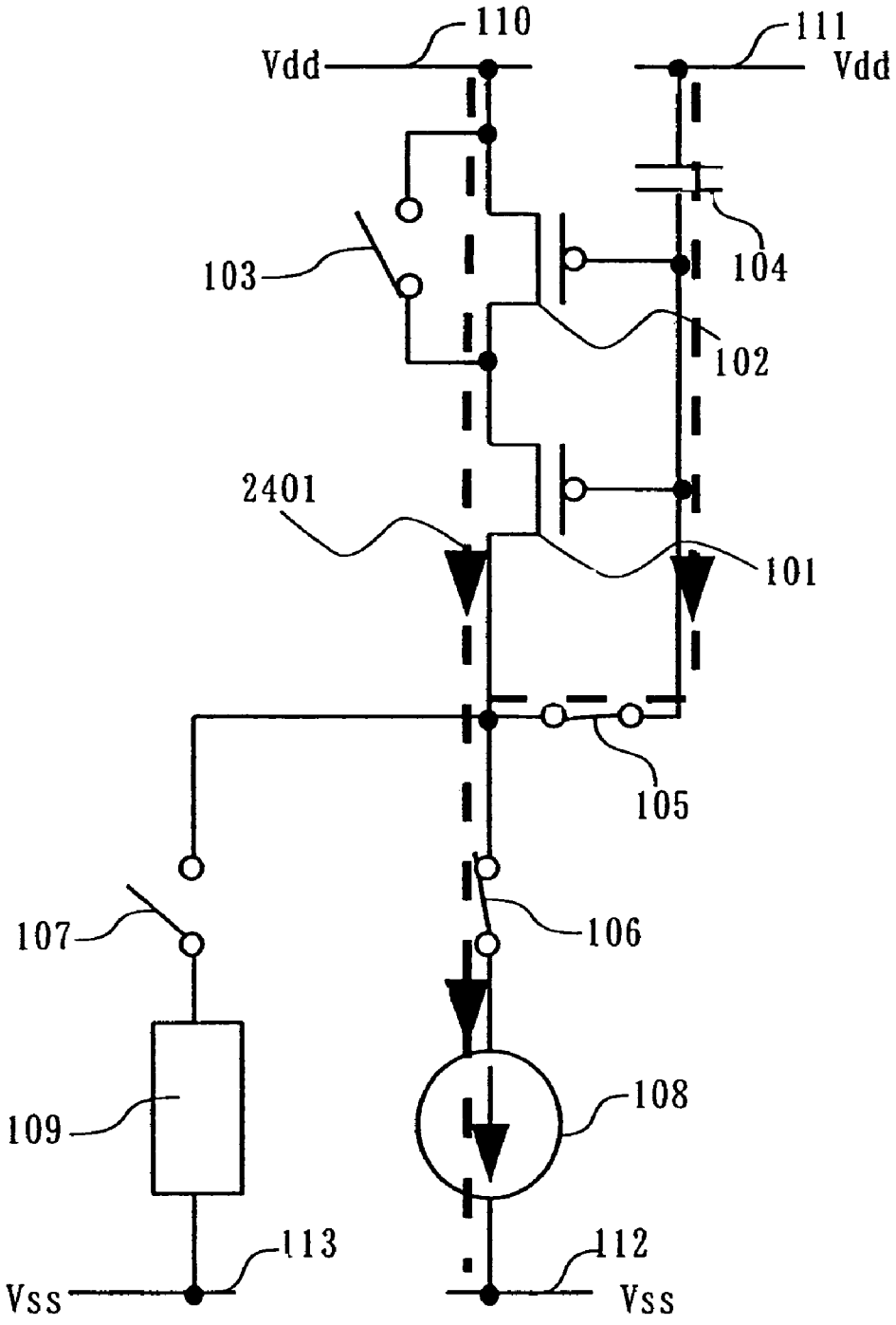
FIG. 24 is a diagram showing an operation of the current source circuit of the invention.
Figure 25:
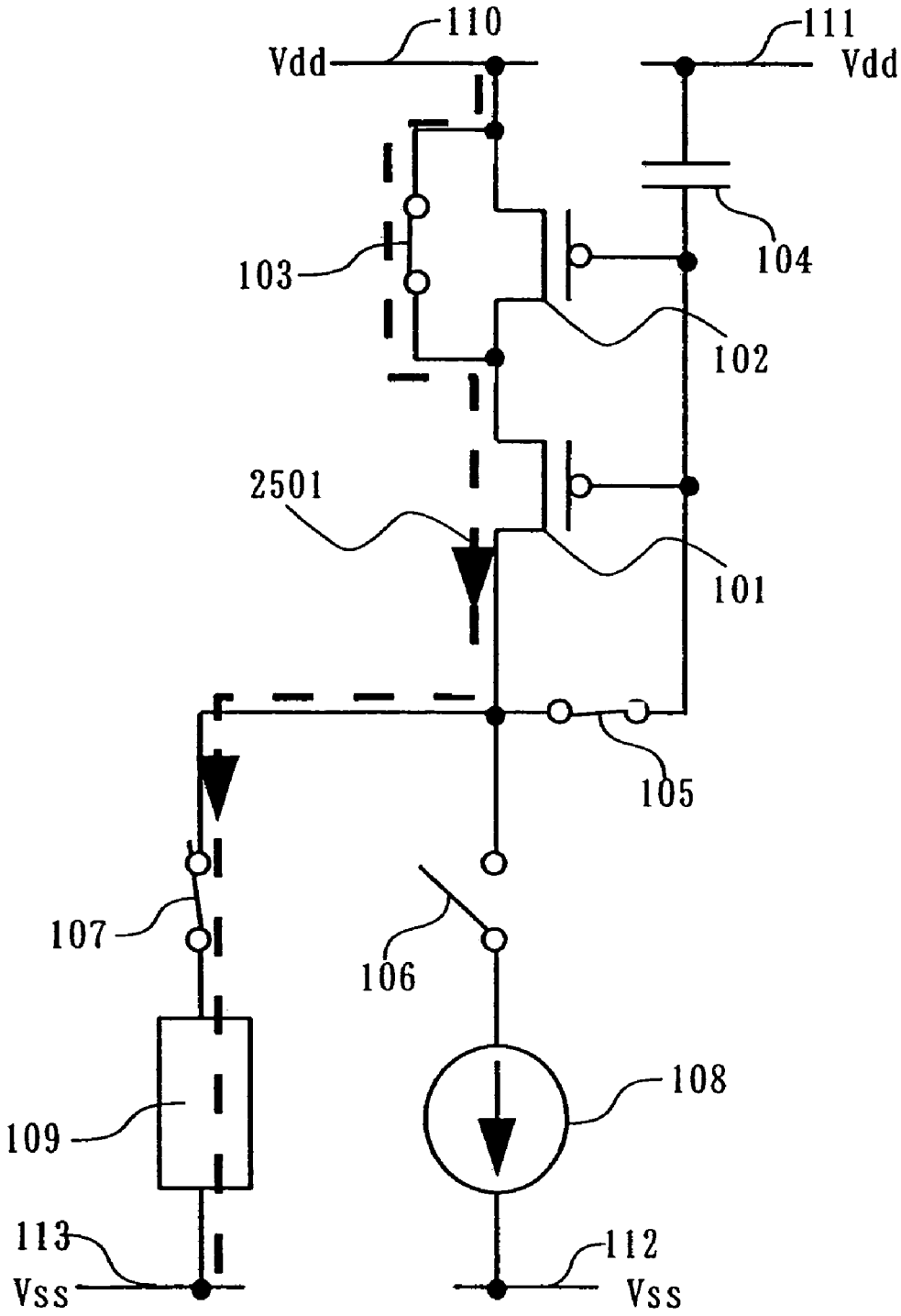
FIG. 25 is a diagram showing an operation of the current source circuit of the invention.

Further, in the case where a larger current flows in the output operation than in the set operation as shown in FIGS. 24 and 25, which means a signal is amplified, the invention can be applied to various analog circuits.

In this manner, the invention can be applied to various portions.

Note that the configuration of FIG. 13 is used as a configuration of the current source circuit 4301 in FIG. 43, however, the invention is not limited to this. Various configurations according to the invention can be employed.

The content described in this embodiment mode corresponds to the one which utilized the contents of Embodiment Modes 1 to 4. Therefore, the contents described in Embodiment Modes 1 to 4 can be applied to this embodiment mode as well.

Embodiment Mode 6

In this embodiment mode, a specific configuration of a pixel arranged in array in a pixel arrangement 41 is described.

Figure 45:
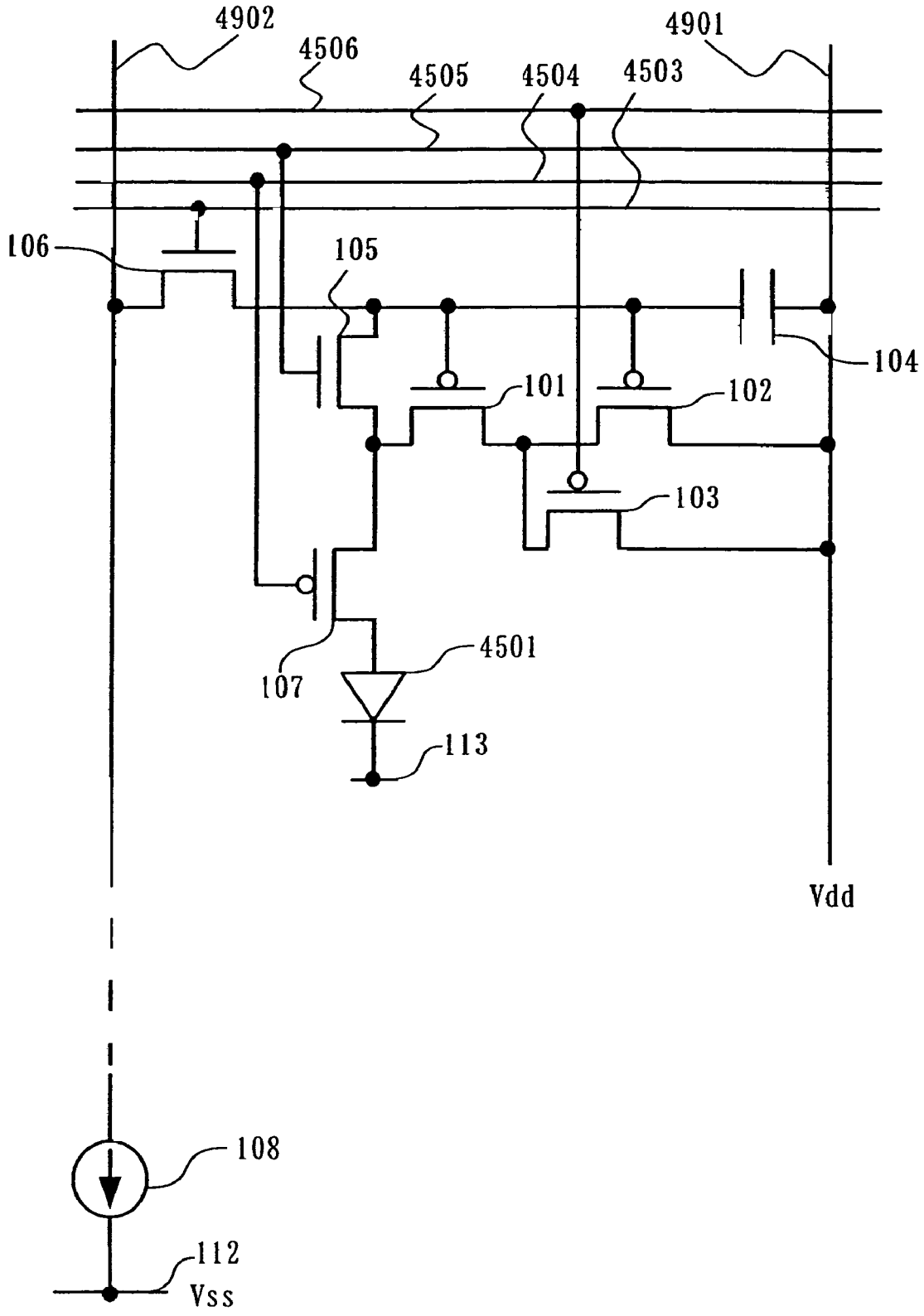
FIG. 45 is a diagram showing a pixel configuration of the invention.

First, FIG. 45 shows the case of applying the configuration shown in FIG. 1 to the pixel. The load 109 in FIG. 1 corresponds to an EL element 4501 in FIG. 45. The basic current source 108 in FIG. 45 corresponds to the current source circuit disposed in the digital-analog converter circuit 4106 in FIG. 41 and the current source circuit disposed in the second latch circuit 4105 in FIG. 42.

Each switch (transistor in FIG. 45) is controlled to be turned ON/OFF by using gate lines 4503 to 4506. Note that the detailed operation is similar to FIG. 1, therefore, description is omitted here.

Figure 46:
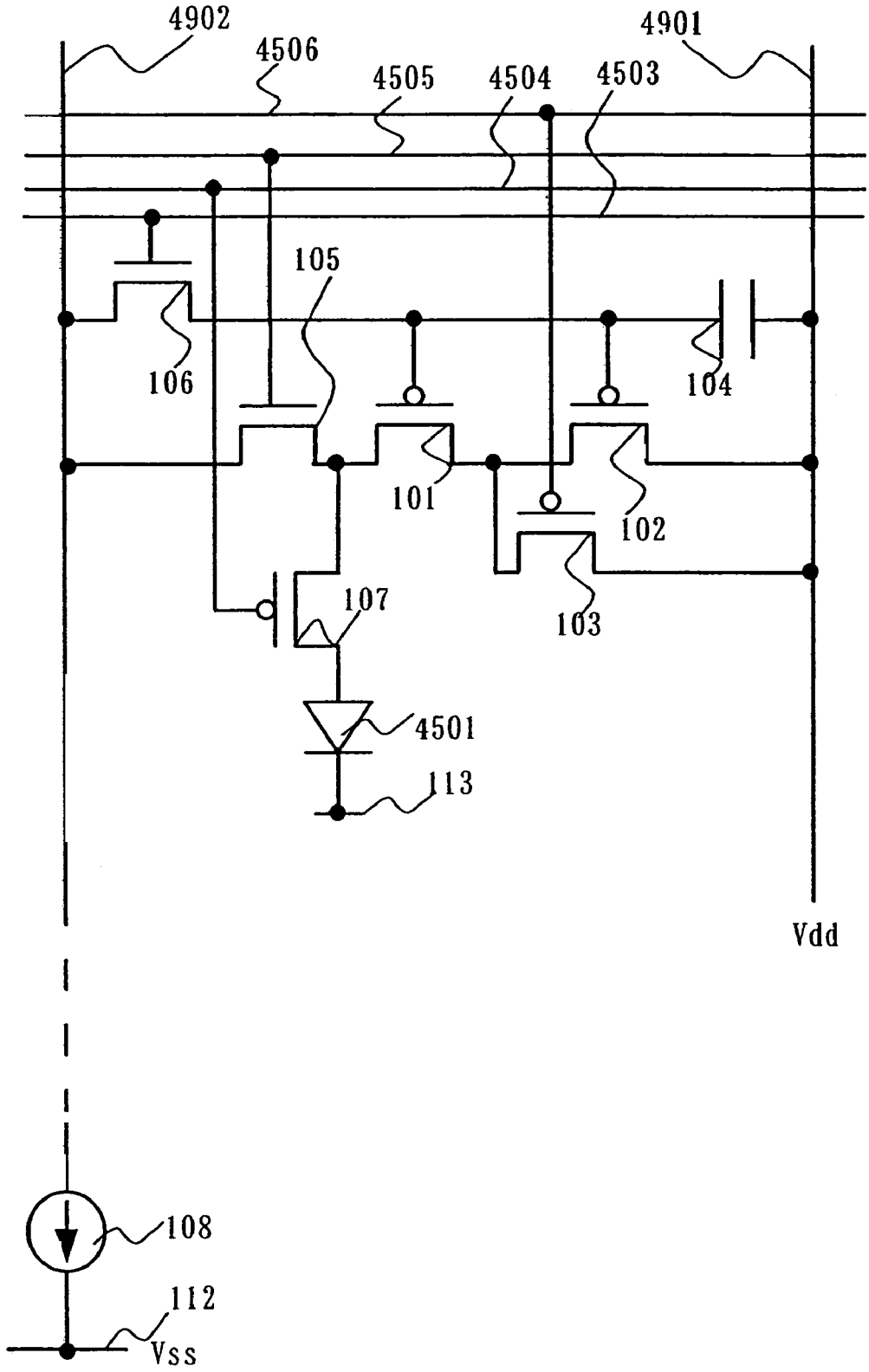
FIG. 46 is a diagram showing a pixel configuration of the invention.

Further, FIG. 46 shows the case of applying the configuration shown in FIG. 4 to the pixel. Similarly, FIG. 47 shows the case of applying the configuration shown in FIG. 36 to the pixel.

Figure 47:
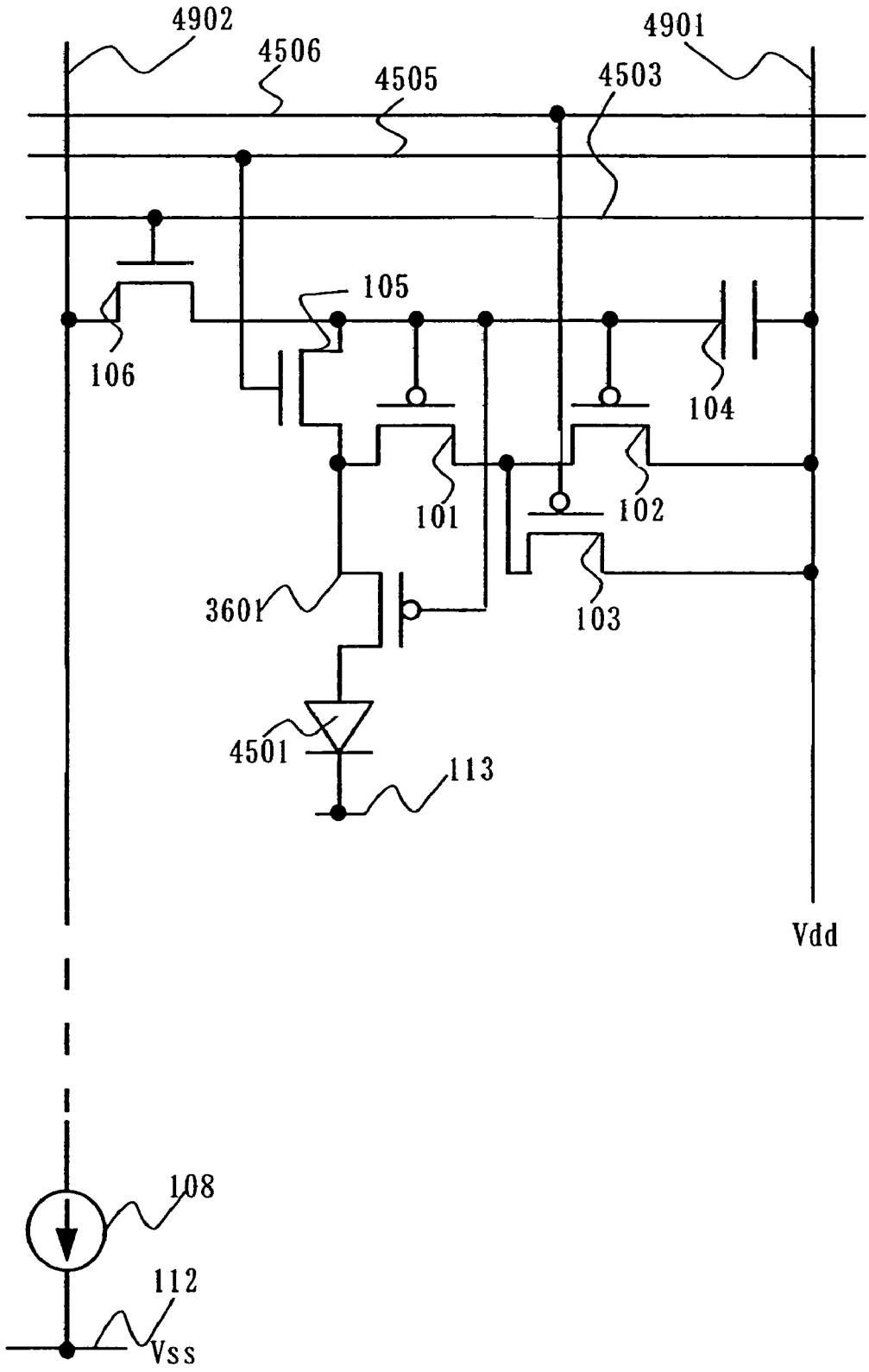
FIG. 47 is a diagram showing a pixel configuration of the invention.

The configuration applied to the pixel is not limited to the configurations shown in FIGS. 45 to 47. The pixel can be configured by using the various configurations described in Embodiment Modes 1 to 3.

For example, polarity (conductivity) of the transistors in FIGS. 45 to 47 are not limited to this. In particular, in the case of operating a transistor as a switch, the polarity (conductivity) of the transistor can be changed without changing the connecting relation.

Further, the current flows from a current source line 4901 in the direction of the wiring 113 in FIGS. 45 to 47, however, the invention is not limited to this. By controlling potentials of the current source line 4901 and the wiring 113, a current may flow from the wiring 113 in the direction of the power supply line 4901. In that case, however, the EL element 4501 is required to be disposed inversely. This is because a current typically flows from an anode to a cathode in the EL element 4501.

Note that the EL element may emit light to either the anode side or the cathode side.

Note that the gate lines 4503 to 4506 or the power supply line 4901 are used for connection in FIGS. 45 to 47, however, the invention is not limited to this.

Figure 48:
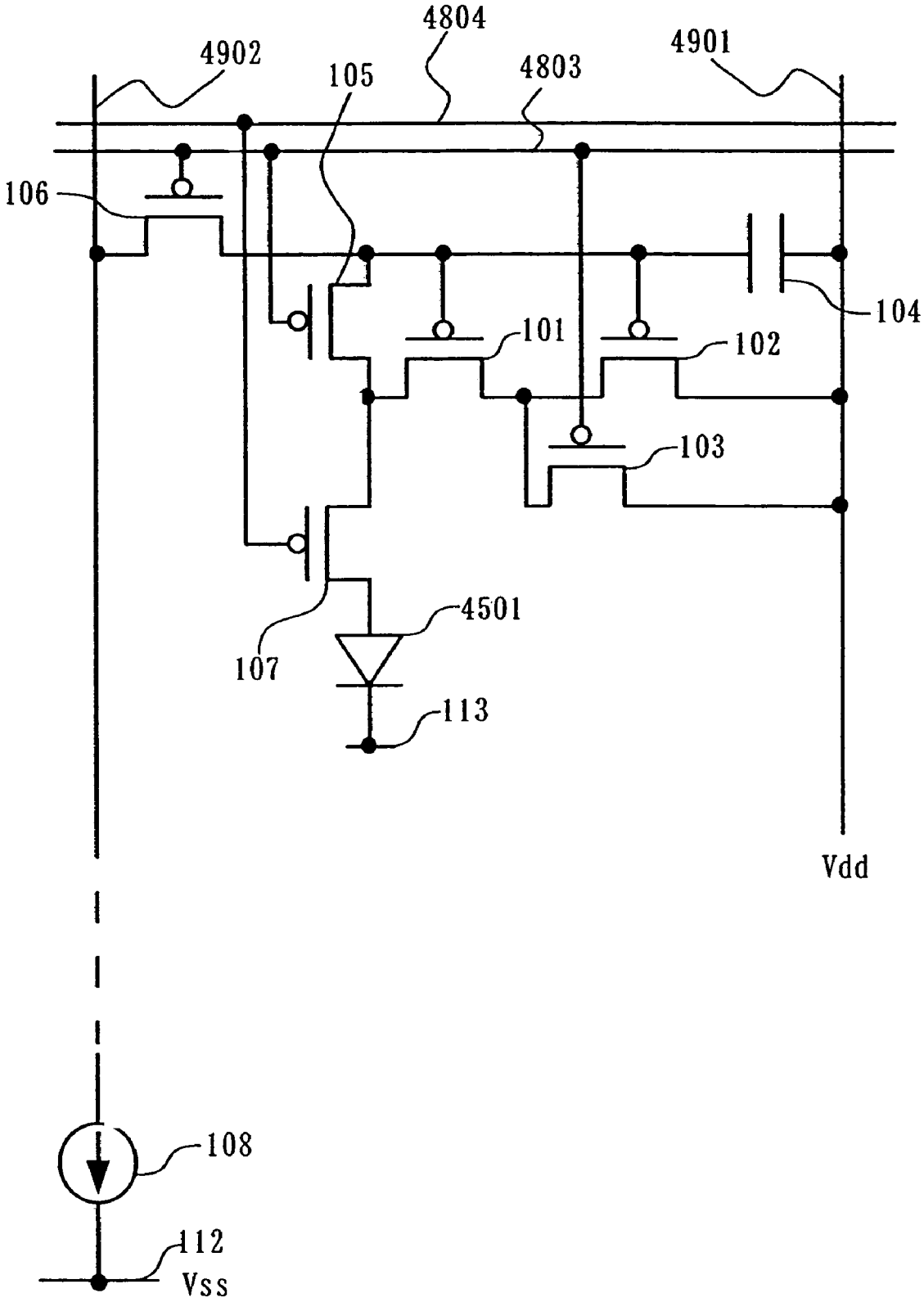
FIG. 48 is a diagram showing a pixel configuration of the invention.
Figure 49:
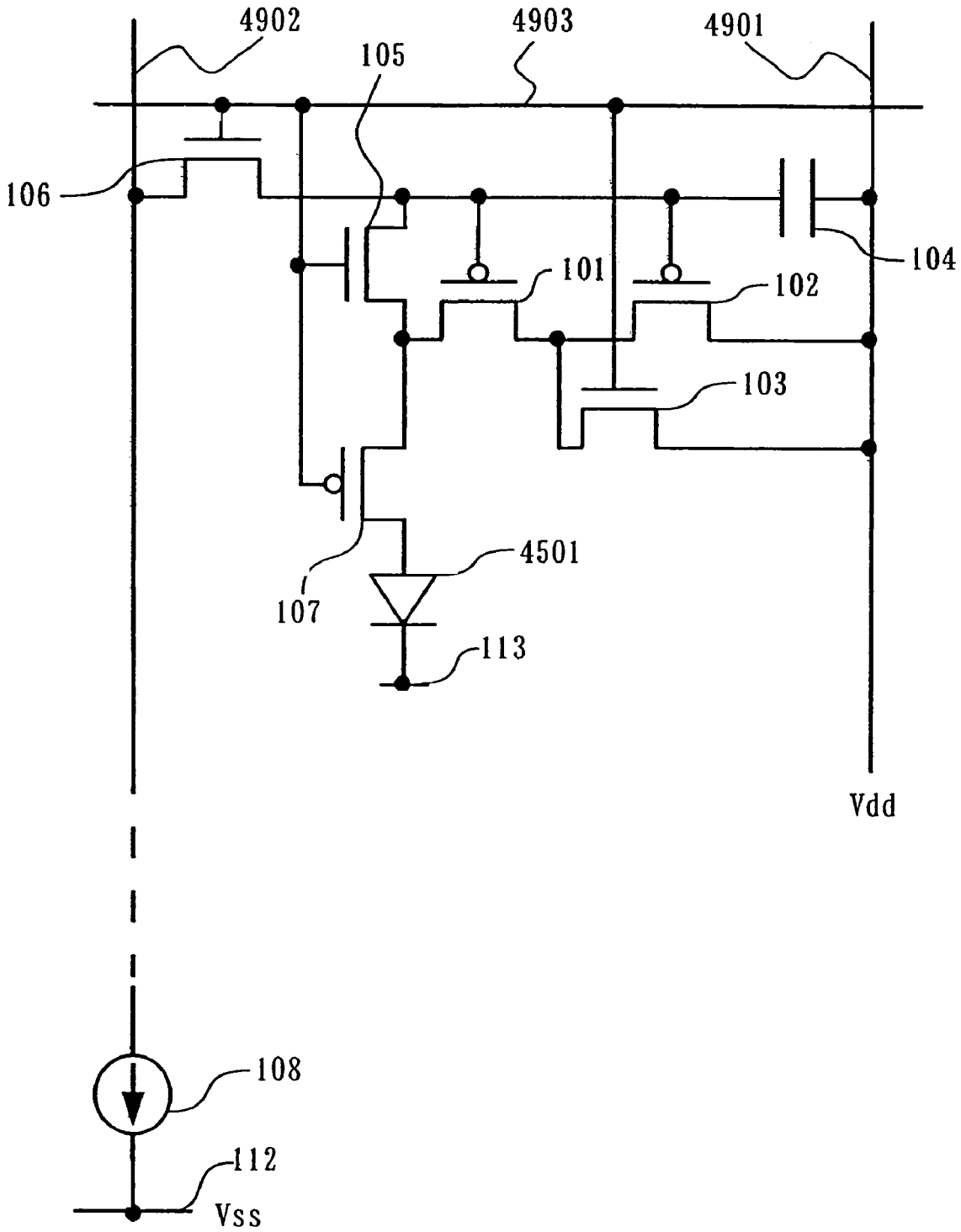
FIG. 49 is a diagram showing a pixel configuration of the invention.

For example, the number of gate lines can be reduced in the circuit of FIG. 45 as in FIG. 48 or FIG. 49, whereby ON/OFF of each switch and polarity (conductivity) of a transistor are required to be considered.

Further, the capacitor 104 is connected to the power supply line 4901 in FIGS. 45 to 47, however, it may be connected to another wiring, for example a gate line of another pixel and the like.

The power supply line 4901 is disposed in FIGS. 45 to 47, however, it may be removed and substituted by a gate line of another pixel and the like.

In this manner, the pixel can employ various configurations.

In the case of displaying an image by using these pixels, a gray scale can be displayed by using various methods.

For example, the gray scale can be displayed by inputting an analog video signal (analog current) from the signal line 4902 to the pixel and flowing a current corresponding to the video signal to a display element. Alternatively, a two-level gray scale can be displayed by inputting a digital video signal (digital current) from the signal line 4902 to the pixel and flowing a current corresponding to the video signal to the display element. In this case, however, a multilevel gray scale is to be obtained by combining a time gray scale method, an area gray scale method and the like in many cases.

When making the display element not to emit light forcibly, a current is to be stopped flowing to the display element. Therefore, for example, the transistor 107 or the transistor 3601 are to be turned OFF. Alternatively, by controlling the state of charge in the capacitor 104, a current may be stopped flowing to the display element in consequence. In order to realize the aforementioned, a switch and the like may be provided additionally.

A detailed description on the time gray scale method is omitted here, however, methods described in Japanese Patent Application No. 2001-5426 and Japanese Patent Application No. 2000-86968 can be referred to.

Figure 50:
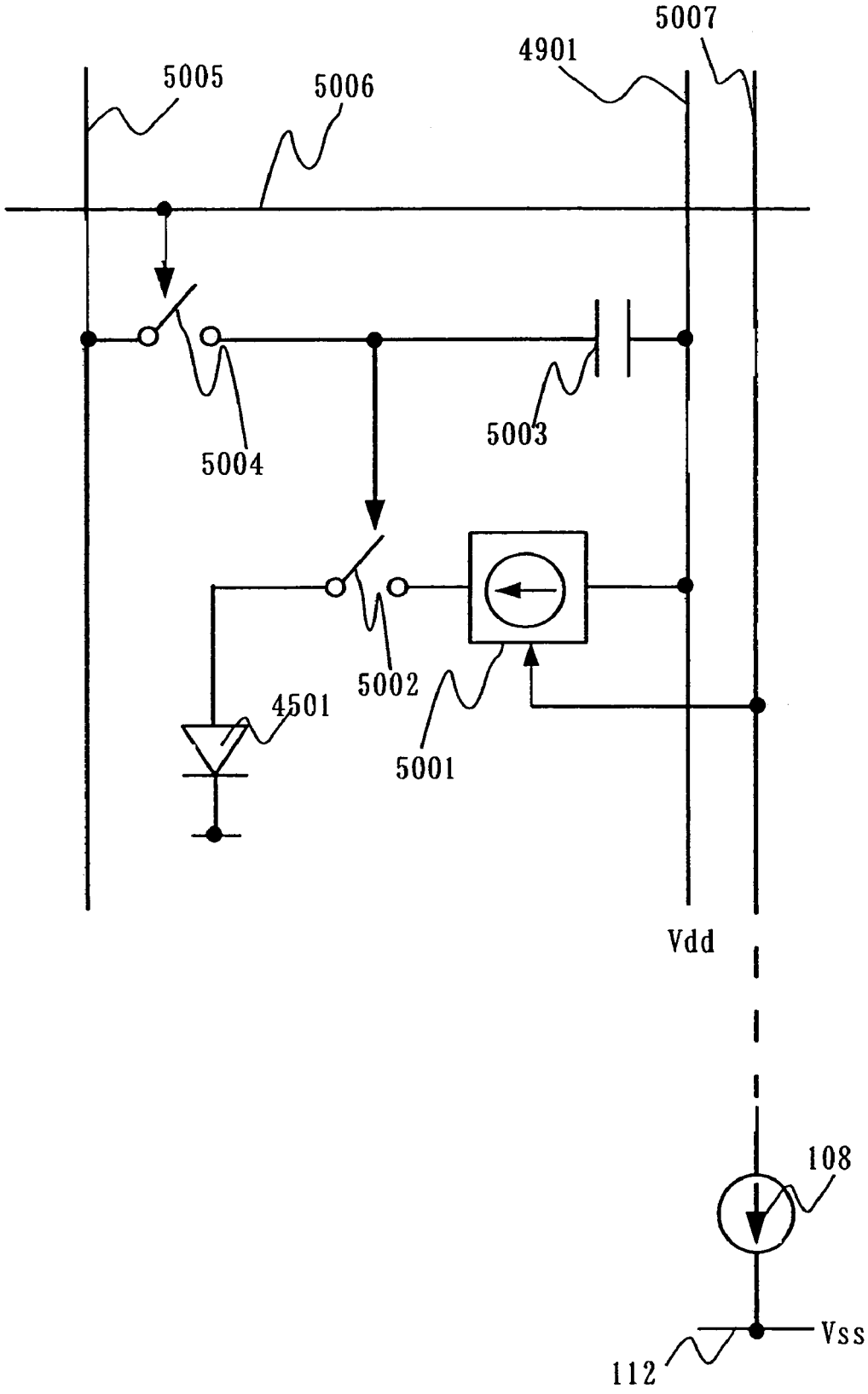
FIG. 50 is a diagram showing a pixel configuration of the invention.

A pixel configuration may be adopted such that a two-level gray scale is displayed by inputting a digital video signal (digital voltage) from a signal line 5005 to the pixel and controlling whether to supply a current to the display element or not corresponding to the video signal. Therefore, in this case also, a multilevel gray scale is to be obtained by combining the time gray scale method, the area gray scale method and the like in many cases. FIG. 50 shows a schematic diagram. A switch 5004 is turned ON/OFF by controlling a gate line 5006 and a voltage (video signal) is inputted from a signal line 5005 to a capacitor 5003. Then, a switch 5002 disposed in series to a current source circuit 5001 is controlled according to its value to determine whether to flow a current to the EL element 4501 or not. The invention can be applied to the current source circuit 5001. That is, the set operation is performed by flowing a current from the basic current source 108 to the current source circuit 5001, from which a current flows to the EL element 4501 as a load. By doing like this, the current source circuit 5001 can output a constant current while reducing an influence of variations in current characteristics of transistors.

Furthermore, the set operation may be performed by flowing a current from another current source to the basic current source 108 to flow the current to the current source circuit 5001 as a load. By doing like this, the basic current source 108 can output a constant current.

Figure 51:
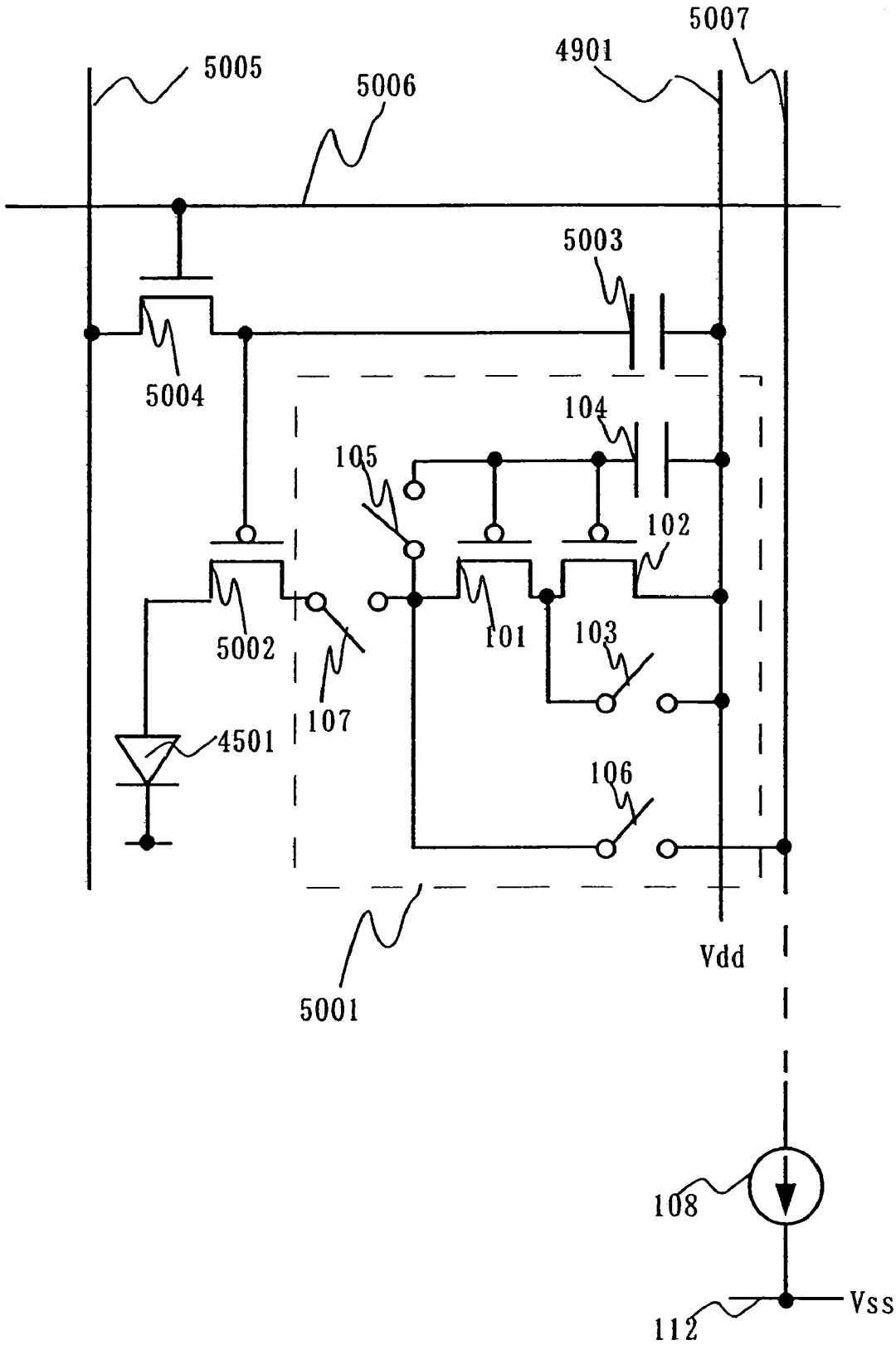
FIG. 51 is a diagram showing a pixel configuration of the invention.

Then, FIG. 51 shows an example of applying the circuit shown in FIG. 1 as a current source circuit 4801.

A detailed description on the circuit shown in FIG. 50 is omitted here, however, methods described in International Publication WO03/027997 and the like may be referred to, and can be combined with the invention. The configuration is not limited to the circuit shown in FIG. 51. The various configurations described in the invention can be applied.

Note that the content described in this embodiment mode corresponds to the one which utilized the contents described in Embodiment Modes 1 to 5. Therefore, the contents described in Embodiment Modes 1 to 5 can be applied to this embodiment mode as well.

Embodiment Mode 7

Figure 52:
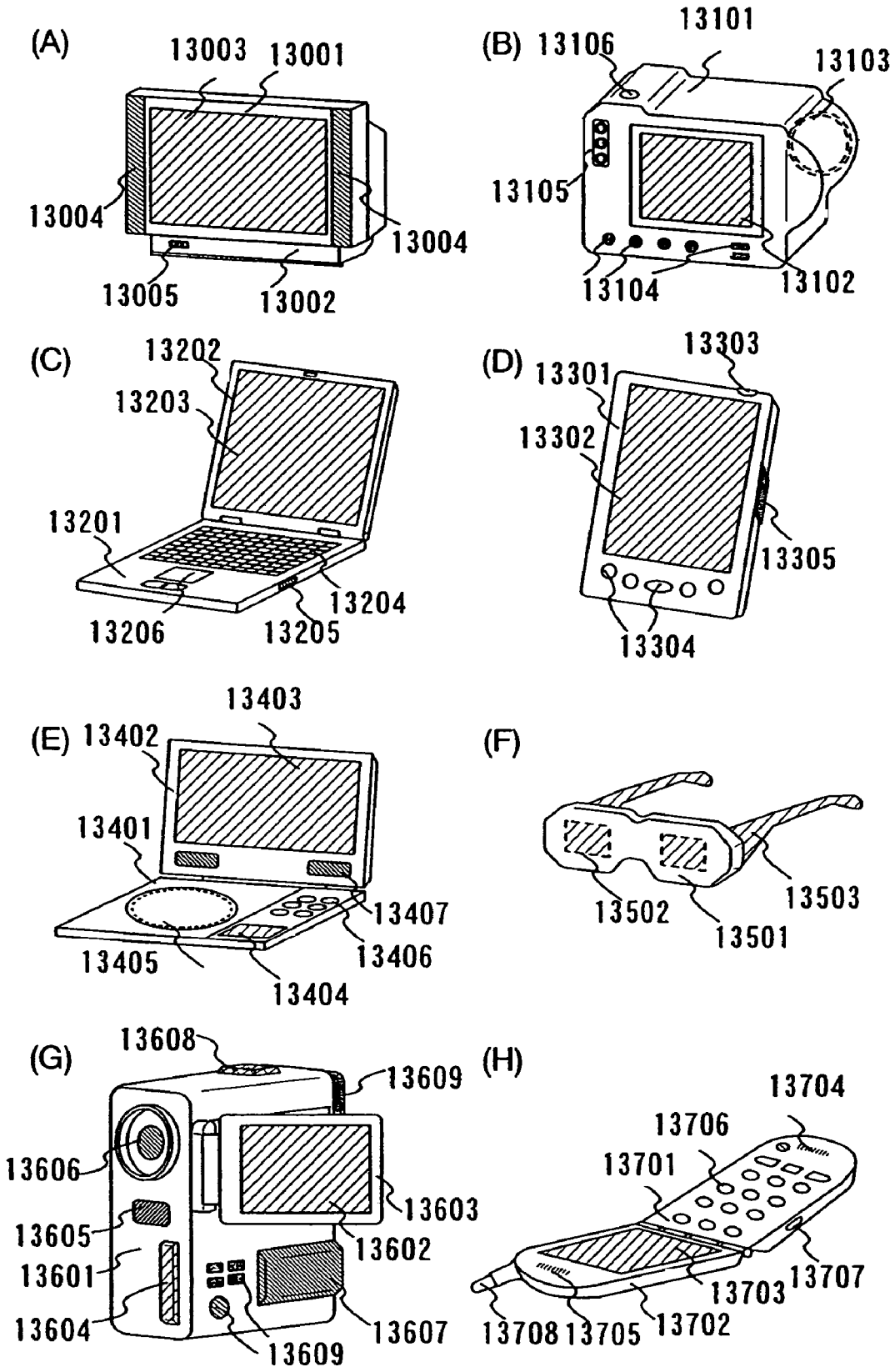
FIGS. 52A to 52H are views of electronic apparatuses to which the invention is applied.

Electronic apparatuses using the invention include a video camera, a digital camera, a goggle type display (a head mounted display), a navigation system, an audio reproducing apparatus (a car audio system, an audio component system and the like), a notebook type personal computer, a game machine, a portable information terminal (a mobile computer, a portable phone, a portable game machine, an electronic book and the like), an image reproducing apparatus provided with a recording medium (specifically an apparatus provided with a display capable of reproducing the recording medium such as a Digital Versatile Disk (DVD), etc. and displaying the image thereof) and the like. Specific examples of these electronic apparatuses are shown in FIG. 52.

FIG. 52A illustrates a light emitting device including a housing 13001, a support base 13002, a display portion 13003, speaker portions 13004, a video input terminal 13005 and the like. The invention can be used in an electronic circuit which forms the display portion 13003. The light emitting device shown in FIG. 52A is completed by the invention. The light emitting device is a self-luminous type, therefore, a backlight is not required and a thinner display portion than that of a liquid crystal display can be obtained. Note that the light emitting device includes all the display devices for displaying information, including ones for personal computers, for TV broadcasting reception, and for advertisement or the like.

FIG. 52B illustrates a digital still camera including a body 13101, a display portion 13102, an image receiving portion 13103, operating keys 13104, an external connecting port 13105, a shutter 13106 and the like. The invention can be used in an electronic circuit which forms the display portion 13102. The digital still camera shown in FIG. 52B is completed by the invention.

FIG. 52C illustrates a notebook type personal computer including a body 13201, a housing 13202, a display portion 13203, a keyboard 13204, an external connecting port 13205, a pointing mouse 13206 and the like. The invention can be used in an electronic circuit which forms the display portion 13203. The light emitting device shown in FIG. 52C is completed by the invention.

FIG. 52D illustrates a mobile computer including a body 13301, a display portion 13302, a switch 13303, operating keys 13304, an infrared port 13305 and the like. The invention can be used in an electronic circuit which forms the display portion 13302. The mobile computer shown in FIG. 52D is completed by the invention.

FIG. 52E illustrates a portable type image reproducing device provided with a recording medium (specifically a DVD reproducing device), including a body 13401, a housing 13402, display portions A13403, B13404, a recording medium (DVD and the like) reading portion 13405, an operating key 13406, a speaker portion 13407 and the like. The display portion A13403 mainly displays image data while the display portion B13404 mainly displays text data. The invention can be used in electronic circuits which form the display portions A13403 and 13404B. Note that the image reproducing device provided with a recording medium includes a home game machine and the like. The DVD reproducing device shown in FIG. 52E is completed by the invention.

FIG. 52F illustrates a goggle type display (a head mounted display) including a body 13501, a display portion 13502, and an arm portion 13503. The invention can be used in an electronic circuit which forms the display portion 13502. The goggle type display shown in FIG. 52F is completed by the invention.

FIG. 52G illustrates a video camera including a body 13601, a display portion 13602, a housing 13603, an external connecting port 13604, a remote control receiving portion 13605, an image receiving portion 13606, a battery 13607, an audio input portion 13608, operating keys 13609 and the like. The invention can be used in an electronic circuit which forms the display portion 13602. The video camera shown in FIG. 52G is completed by the invention.

FIG. 52H illustrates a portable phone including a body 13701, a housing 13702, a display portion 13703, an audio input portion 13704, an audio output portion 13705, an operating key 13706, an external connecting port 13707, an antenna 13708 and the like. The invention can be used in an electronic circuit which forms the display portion 13703. Note that current consumption of the portable phone can be suppressed by displaying white text on a black background in the display portion 13703.

Provided that a light emission luminance of a light emitting material becomes high in the future, the light including outputted image data can be expanded and projected by using a lens and the like to be used for a front or rear type projector.

Furthermore, the aforementioned electronic apparatuses are becoming to be more used for displaying information distributed through a telecommunication line such as Internet, a CATV (cable television), and in particular for displaying moving picture information. The display device is suitable for displaying moving pictures since the light emitting material can exhibit high response speed.

It is preferable to display data with as small light emitting portion as possible because the light emitting device consumes power in the light emitting portion. Therefore, in the case of using the light emitting device in the display portions of the portable information terminal, in particular a portable phone or an audio reproducing device which mainly displays text data, it is preferable to drive so that the text data is formed by a light emitting portion with a non-light emitting portion as a background.

As described above, the application range of the invention is so wide that the invention can be used in electronic apparatuses of various fields. The electronic apparatuses described in this embodiment mode can use any configuration of the semiconductor device described in Embodiment Modes 1 to 6.

The invention claimed is:

1. A semiconductor device comprising:

a first transistor comprising a gate terminal, a first terminal, and a second terminal;

a second transistor comprising a gate terminal, a first terminal, and a second terminal;

a switch wherein the gate terminal of the first transistor and the first terminal of the first transistor are connected via the switch; and means for short-circuiting between the first terminal of the first transistor and the second terminal of the first transistor, wherein the second terminal of the first transistor is connected to the first terminal of the second transistor; and wherein the gate terminal of the first transistor is connected to the gate terminal of the second transistor.

2. The semiconductor device according to claim 1, wherein the second terminal of the first transistor is connected to the first terminal of the second transistor via a third transistor.

3. The semiconductor device according to claim 1, further comprising means for short-circuiting between the first terminal of the second transistor and the second terminal of the second transistor.

4. The semiconductor device according to claim 1, wherein the first transistor and the second transistor have the same conductivity.

5. The semiconductor device according to claim 1, wherein a capacitor is provided and the gate terminal of the first transistor and one terminal of the capacitor are connected.

6. The semiconductor device according to claim 5, wherein the gate terminal of the first transistor is connected to one terminal of the capacitor, and the other terminal of the capacitor is connected to a second terminal of the second transistor.

7. The semiconductor device according to claim 1, wherein the first terminal of the first transistor or the second terminal of the second transistor is connected to a current source circuit.

8. The semiconductor device according to claim 1, wherein the first terminal of the first transistor or the second terminal of the second transistor is connected to a display element.

9. The semiconductor device according to claim 8, wherein the display element is an EL element.

10. A display device comprising the semiconductor device according to claim 1.

11. An electronic apparatus comprising the display device according to claim 10.

12. A digital still camera comprising the semiconductor device according to claim 1.

13. A personal computer comprising the semiconductor device according to claim 1.

14. A video camera comprising the semiconductor device according to claim 1.

15. A portable phone comprising the semiconductor device according to claim 1.

16. An image reproducing apparatus provided with a recording medium, comprising the semiconductor device according to claim 1.

17. A semiconductor device comprising:

a first transistor comprising a gate terminal, a first terminal, and a second terminal;

a second transistor comprising a gate terminal, a first terminal, and a second terminal; and a switch wherein the gate terminal of the first transistor and the first terminal of the first transistor are connected via the switch; and means for short-circuiting between the first terminal of the second transistor and the second terminal of the second transistor, wherein the second terminal of the first transistor is connected to the first terminal of the second transistor;

wherein the gate terminal of the first transistor is connected to the gate terminal of the second transistor.

18. The semiconductor device according to claim 17, wherein the second terminal of the first transistor is connected to the first terminal of the second transistor via a third transistor.

19. The semiconductor device according to claim 17, wherein the first transistor and the second transistor have the same conductivity.

20. The semiconductor device according to claim 17, wherein a capacitor is provided and the gate terminal of the first transistor and one terminal of the capacitor are connected.

21. The semiconductor device according to claim 17, wherein the first terminal of the first transistor or the second terminal of the second transistor is connected to a current source circuit.

22. The semiconductor device according to claim 17, wherein the first terminal of the first transistor or the second terminal of the second transistor is connected to a display element.

23. A display device comprising the semiconductor device according to claim 17.

24. A personal computer comprising the semiconductor device according to claim 17.

25. A video camera comprising the semiconductor device according to claim 17.

26. A portable phone comprising the semiconductor device according to claim 17.

27. An image reproducing apparatus provided with a recording medium, comprising the semiconductor device according to claim 17.

28. A semiconductor device comprising:

a first transistor comprising a gate terminal, a first terminal, and a second terminal;

a second transistor comprising a gate terminal, a first terminal, and a second terminal; and a first switch and a second switch wherein the gate terminal of the first transistor and the first terminal of the first transistor are connected via the first switch, wherein the second terminal of the first transistor is connected to the first terminal of the second transistor;

wherein the gate terminal of the first transistor is connected to the gate terminal of the second transistor; and wherein the first terminal of the second transistor and the second terminal of the second transistor are connected via the second switch.

29. The semiconductor device according to claim 28, wherein the second terminal of the first transistor is connected to the first terminal of the second transistor via a third transistor.

30. The semiconductor device according to claim 28, wherein the first transistor and the second transistor have the same conductivity.

31. The semiconductor device according to claim 28, wherein a capacitor is provided and the gate terminal of the first transistor and one terminal of the capacitor are connected.

32. The semiconductor device according to claim 28, wherein the first terminal of the first transistor or the second terminal of the second transistor is connected to a current source circuit.

33. The semiconductor device according to claim 28, wherein the first terminal of the first transistor or the second terminal of the second transistor is connected to a display element.

34. A display device comprising the semiconductor device according to claim 28.

35. A personal computer comprising the semiconductor device according to claim 28.

36. A video camera comprising the semiconductor device according to claim 28.

37. A portable phone comprising the semiconductor device according to claim 28.

38. An image reproducing apparatus provided with a recording medium, comprising the semiconductor device according to claim 28.

* * * * *